US005302777A

United States Patent [19]

Okuda et al.

[11] Patent Number: 5,302,777

[45] Date of Patent: Apr. 12, 1994

[54] MUSIC APPARATUS FOR DETERMINING TONALITY FROM CHORD PROGRESSION FOR IMPROVED ACCOMPANIMENT

[75] Inventors: Hiroko Okuda, Tokyo; Hiroshi Yoshimura, Kawasaki; Chisato Nakamura, Tokyo, all of Japan

[73] Assignee: Casio Computer Co., Ltd., Tokyo, Japan

[21] Appl. No.: 906,275

[22] Filed: Jun. 26, 1992

[30] Foreign Application Priority Data

| | | | |
|---|---|---|---|
| Jun. 29, 1991 | [JP] | Japan | 3-185410 |
| Oct. 16, 1991 | [JP] | Japan | 3-294817 |
| Oct. 16, 1991 | [JP] | Japan | 3-294818 |
| Dec. 30, 1991 | [JP] | Japan | 3-360544 |

[51] Int. Cl.[5] ..... G10H 1/38

[52] U.S. Cl. ..... 84/637; 84/669; 84/DIG. 22

[58] Field of Search ..... 84/613, 637, 650-652, 84/669, 715, DIG. 22

[56] References Cited

U.S. PATENT DOCUMENTS

| | | | |
|---|---|---|---|
| 4,982,643 | 1/1991 | Minamitaka . | |
| 5,003,860 | 4/1991 | Minamitaka . | |
| 5,179,241 | 1/1993 | Okuda et al. | 84/637 X |

FOREIGN PATENT DOCUMENTS

| | | |
|---|---|---|
| 2-29787 | 1/1990 | Japan . |
| 2-29788 | 1/1990 | Japan . |
| 2-29789 | 1/1990 | Japan . |
| 2-29791 | 1/1990 | Japan . |
| 2-29792 | 1/1990 | Japan . |
| 2-29793 | 1/1990 | Japan . |
| 2-83591 | 3/1990 | Japan . |

*Primary Examiner*—Stanley J. Witkowski

*Attorney, Agent, or Firm*—Frishauf, Holtz, Goodman & Woodward

[57] ABSTRACT

A tonality extractor analyzes a chord progression (CP) to determine an available pitch class set (PCS) at each chord time of CP using stored musical knowledge base. The available PCS is determined differently depending on musical situations. A resultant PCS succession is most accurate and assures a natural stream of musical tonality free of a spurious modulation. An automatic accompaniment apparatus utilizes the tonality extractor for desired accompaniment performance. A modulation compensator avoids generation of a pitch range shift in the accompaniment line at the time of modulation (change of key). A style-grouped pitch change table in combination with a style-grouped reference accompaniment pattern memory optimizes accompaniment pitch contents to respective musical styles while requiring only a small storage space. An accompaniment pitch forming device using stored accompaniment note index data and a pitch table linked to the note index and tonality data controls accompaniment pitch line so as to vary in a pleasing way depending on tonalities.

14 Claims, 59 Drawing Sheets

| (ROOT) TYPE | POSSIBLE FUNCTIONS & PCS | | | | | | | COMMON PC |
|---|---|---|---|---|---|---|---|---|
| (C) MAJOR | I:C | D | E | F | G | A | B | CDEGA |
| | V:C | D | E | F# | G | A | B | |
| | IV:C | D | E | F | G | A | $B^b$ | |
| (A)MINOR | VIm:A | B | C | D | E | (F#/F) | (G#/G) | ACDE |
| | IIm:A | B | C | D | E | F# | G | |
| | IIIm:A | $B^b$ | C | D | E | F | G | |
| (G)7th | V7:G | A | B | C | D | E | F | GBCDF |
| | III7:G | $A^b$ | B | C | D | $E^b$ | F | |
| | III7:G | A | B | C | D | $E^b$ | F | |
| add9th | SAME AS MAJOR | | | | | | | SAME AS MAJOR |
| madd9th | SAME AS MINOR | | | | | | | SAME AS MINOR |
| 6th | SAME AS MAJOR | | | | | | | SAME AS MAJOR |
| (A)m6th | IIm6:A | B | C | D | E | F# | G | ABCDEF# |
| | VIm6:A | B | C | D | E | F# | G# | |

FIG. 1F

CKT

| ADDRESS | MEMBER DATA | COMMENT | |
|---|---|---|---|
| 0 | 0 | ROOT | MAJOR |
| 1 | 4 | MAJOR THIRD | |
| 2 | 7 | PERFECT FIFTH | |
| 3 | 15 | DUMMY | |
| 4 | 0 | ROOT | 6th |
| 5 | 4 | MAJOR THIRD | |
| 6 | 7 | PERFECT FIFTH | |
| 7 | 9 | MAJOR SIXTH | |

FIG. 5

NEW CHORD

| | | | |
|---|---|---|---|
| CDN | CDNr | CDNt | ROOT, TYPE |

IMMEDIATELY PRECEDING CHORD

| | | | |
|---|---|---|---|
| CDB | CDBr | CDBt | ROOT, TYPE |

NEW CHORD FUNCTION NAME

| | | | |
|---|---|---|---|
| FDN | FDNd | FDNt | ROOT, TYPE |

IMMEDIATELY PRECEDING CHORD FUNCTION NAME

| | | | |
|---|---|---|---|
| FDB | FDBd | FDBt | ROOT, TYPE |

CURRENT TONALITY

| | | | |
|---|---|---|---|
| TDN | TDNk | TDNs | KEYNOTE, SCALE |

(EXAMPLE)

| | | | COMMENT |
|---|---|---|---|
| CDN | 0 | 0 | CMAJOR |
| FDN | 2 | 0 | IIMAJOR |
| TDN | 0 | 0 | C Ionian |

FIG.6A

TDK

| ADDRESS | DATA (KEYNOTE) | DATA (SCALE) | COMMENT |
|---|---|---|---|
| 0 | | | DOMINANT |
| 1 | | | SUBDOMINANT |
| 2 | | | DOMINANT OF DOMINANT |
| 3 | | | SUBDOMINANT OF SUBDOMINANT |

FDK

| ADDRESS | DATA (DEGREE) | DATA (TYPE) | COMMENT |
|---|---|---|---|
| 0 | | | NEW CHORD FUNCTION IN DOMINANT KEY |
| 1 | | | OLD CHORD FUNCTION IN DOMINANT KEY |
| 2 | | | NEW CHORD FUNCTION IN SUBDOMINANT KEY |
| 3 | | | OLD CHORD FUNCTION IN SUBDOMINANT KEY |
| 4 | | | NEW CHORD FUNCTION IN D OF D KEY |
| 5 | | | OLD CHORD FUNCTION IN D OF D KEY |
| 6 | | | NEW CHORD FUNCTION IN S OF S KEY |
| 7 | | | OLD CHORD FUNCTION IN S OF S KEY |

POINTER I

FIG. 6B

| ADDR | DATA | | COMMENT |
|---|---|---|---|
| | FUNC (DEG) | TYPE | |
| 0 | 0 | 0 | I |
| 1 | 0 | 1 | I6 |
| 2 | 0 | 5 | IM7 |
| 3 | 0 | 2 | IaDD9 |
| 4 | 2 | 6 | IIm |
| 5 | 2 | 3 | IIm6 |
| 6 | 2 | 7 | IIm7 |
| OFT 7 | 4 | 6 | IIIm |
| 8 | 4 | 7 | IIIm7 |
| 9 | 5 | 0 | IV |
| 10 | 5 | 1 | IV6 |
| 11 | 5 | 5 | IVM7 |
| 12 | 7 | 0 | V |
| 13 | 7 | 1 | V6 |
| 14 | 7 | 9 | V7 |
| 15 | 7 | 10 | V7#5 |
| 16 | 7 | 11 | V7b5 |
| 17 | 7 | 15 | V9 |
| 18 | 7 | 16 | V7#9 |
| 19 | 7 | 17 | V7 b9 |
| 20 | 7 | 13 | V7sus4 |
| 21 | 7 | 14 | S/D |
| 22 | 9 | 6 | VIm |
| 23 | 9 | 3 | VIm6 |
| 24 | 9 | 7 | VIm7 |
| 25 | 9 | 8 | VImM7 |
| 26 | 9 | 4 | VImadd9 |
| 27 | 11 | 12 | VIm7b5 |
| 28 | 15 | - | END |

FIG.10

| ADDR | DEG | TYPE | |
|---|---|---|---|
| 0 | 0 | 0 | I |
| 1 | 4 | 0 | III |
| 2 | 0 | 1 | I6 |
| 3 | 4 | 0 | III |
| 4 | 0 | 2 | Iadd9 |
| 5 | 4 | 0 | III |
| 6 | 0 | 5 | IM7 |
| 7 | 4 | 0 | III |
| 8 | 2 | 6 | IIm |
| 9 | 4 | 0 | III |
| 10 | 2 | 3 | IIm6 |
| 11 | 4 | 0 | III |
| 12 | 2 | 7 | IIm7 |
| 13 | 4 | 0 | III |
| 14 | 5 | 0 | IV |
| 15 | 4 | 0 | III |
| 16 | 5 | 5 | IVM7 |
| 17 | 4 | 0 | III |
| 18 | 5 | 1 | IV6 |
| 19 | 4 | 0 | III |
| 20 | 7 | 0 | V |
| 21 | 4 | 0 | III |
| 22 | 7 | 1 | V6 |
| 23 | 4 | 0 | III |
| 24 | 9 | 6 | VIm |
| 25 | 4 | 0 | III |
| 26 | 11 | 12 | VIIm7b5 |
| 27 | 4 | 0 | III |
| 28 | 0 | 0 | I |
| 29 | 4 | 9 | III7 |
| 30 | 0 | 1 | I6 |
| 31 | 4 | 9 | III7 |
| 32 | 0 | 2 | Iadd9 |
| 33 | 4 | 9 | III7 |
| 34 | 0 | 5 | IM7 |
| 35 | 4 | 9 | III7 |
| 36 | 2 | 6 | IIm |
| 37 | 4 | 9 | III7 |
| 38 | 2 | 3 | IIm6 |
| 39 | 4 | 9 | III7 |
| 40 | 2 | 7 | IIm7 |
| 41 | 4 | 9 | III7 |
| 42 | 5 | 0 | IV |
| 43 | 4 | 9 | III7 |

MCST

FIG.12A

| ADDR | DEG | TYPE | |
|---|---|---|---|
| 44 | 5 | 5 | IVM7 |
| 45 | 4 | 9 | III7 |
| 46 | 5 | 1 | IV6 |
| 47 | 4 | 9 | III7 |
| 48 | 7 | 0 | V |
| 49 | 4 | 9 | III7 |
| 50 | 7 | 1 | V6 |
| 51 | 4 | 9 | III7 |
| 52 | 9 | 6 | VIm |
| 53 | 4 | 9 | III7 |
| 54 | 11 | 12 | VIIm7b5 |
| 55 | 4 | 9 | III7 |
| 56 | 0 | 0 | I |
| 57 | 4 | 13 | III7sus4 |
| 58 | 0 | 1 | I6 |
| 59 | 4 | 13 | III7sus4 |
| 60 | 0 | 2 | Iadd9 |
| 61 | 4 | 13 | III7sus4 |
| 62 | 0 | 5 | IM7 |
| 63 | 4 | 13 | III7sus4 |
| 64 | 2 | 6 | IIm |
| 65 | 4 | 13 | III7sus4 |
| 66 | 2 | 3 | IIm6 |
| 67 | 4 | 13 | III7sus4 |
| 68 | 2 | 7 | IIm7 |
| 69 | 4 | 13 | III7sus4 |
| 70 | 5 | 0 | IV |
| 71 | 4 | 13 | III7sus4 |
| 72 | 5 | 5 | IVM7 |
| 73 | 4 | 13 | III7sus4 |
| 74 | 5 | 1 | IV6 |
| 75 | 4 | 13 | III7sus4 |
| 76 | 7 | 0 | V |
| 77 | 4 | 13 | III7sus4 |
| 78 | 7 | 1 | V6 |
| 79 | 4 | 13 | III7[illegible] |
| 80 | 9 | 6 | VIm |
| 81 | 4 | 13 | III7sus4 |
| 82 | 11 | 12 | VIIm7b5 |
| 83 | 4 | 13 | III7sus4 |
| 84 | 15 | — | END |

FORMAT

| | | |
|---|---|---|
| EVEN ADDR | OLD CHORD DEG | OLD CHORD TYPE |
| ODD ADDR | NEW CHORD DEG | NEW CHORD TYPE |

FIG.12B

PDB

| ADDR | DATA | | COMMENT |
|---|---|---|---|
| | DEG | TYPE | |
| 0 | 0 | 0 | I |
| 1 | 2 | 6 | IIm |
| 2 | 4 | 6 | IIIm |
| 3 | 5 | 0 | IV |
| 4 | 7 | 0 | V |
| 5 | 9 | 6 | VIm |

FIG.14

MDB

| ADDR | DATA | | COMMENT |
|---|---|---|---|
| | DEG | TYPE | |
| 0 | 0 | 0 | I |
| 1 | 2 | 6 | IIm |
| 2 | 4 | 6 | IIIm |
| 3 | 5 | 0 | IV |
| 4 | 7 | 0 | V |
| 5 | 9 | 6 | VIm |
| 6 | 11 | 21 | VIIm-5 |

FIG.15

| CPDt | CPDr |
|---|---|
| MAJOR | |
| MAJOR | 2 |
| 100 | 7 |
| MAJOR | |
| minor | - 2 |
| 100 | 0 |
| MAJOR | |
| minor | - 4 |
| MAJOR | - 1 |
| 100 | 0 |
| | |
| | |
| | |
| | |

CPDt[I](LAST CHORD TYPE)

CPDt[I+1](FIRST PRECEDING CHORD TYPE),

CPDr[I+1](ROOT DIFFERENCE FROM LAST CHORD),

CPDr[I+2](LAST CHORD FUNCTION)

CPD

FIG.18

| ADDR | DATA | | COMMENT |
|---|---|---|---|
| 0 | 0 | 0 | I |
| 1 | 0 | — | IONIAN |
| 2 | 4 | 0 | III |
| 3 | 2 | — | MIXOLYDIAN |
| 4 | 5 | 0 | IV |
| 5 | 1 | — | LYDIAN |
| 6 | 7 | 0 | V |
| 7 | 2 | — | MEXOLYDIAN |
| 8 | 0 | 1 | I6 |
| 9 | 0 | — | IONIAN |
| 10 | 5 | 1 | IV6 |
| 11 | 1 | — | LYDIAN |
| 12 | 7 | 1 | V6 |
| 13 | 2 | — | MIXOLYDIAN |
| 14 | 0 | 5 | IM7 |
| 15 | 0 | — | IONIAN |
| 16 | 5 | 5 | IVM7 |
| 17 | 1 | — | LYDIAN |
| 18 | 0 | 4 | IMadd9 |
| 19 | 0 | — | IONIAN |
| 20 | 2 | 6 | IIm |
| 21 | 3 | — | DORIAN |
| 22 | 4 | 6 | IIIm |
| 23 | 4 | — | PHRYGIAN |
| 24 | 9 | 6 | VIm |
| 25 | 5 | — | MELODIC MINOR |
| 26 | 2 | 3 | IIm6 |
| 27 | 3 | — | DORIAN |
| 28 | 9 | 3 | VIm6 |
| 29 | 5 | — | MELODIC MINOR |
| 30 | 2 | 7 | IIm7 |
| 31 | 3 | — | DORIAN |
| 32 | 4 | 7 | IIIm7 |
| 33 | 4 | — | PHRYGIAN |
| 34 | 9 | 7 | VIm7 |
| 35 | 6 | — | AEORIAN |
| 36 | 11 | 12 | VIIm7b5 |
| 37 | 7 | — | LOCRIAN |
| 38 | 9 | 8 | VImM7 |
| 39 | 5 | — | MELODIC MINOR |
| 40 | 9 | 4 | VImadd9 |
| 41 | 5 | — | MELODIC MINOR |

SCT

FIG. 24A

| ADDR | DATA | | COMMENT |
|---|---|---|---|
| 42 | 4 | 9 | III7 |
| 43 | 2 | — | MIXOLYDIAN |
| 44 | 7 | 9 | V7 |
| 45 | 2 | — | MEXOLYDIAN |
| 46 | 7 | 13 | V7sus4 |
| 47 | 2 | — | MIXOLYDIAN |
| 48 | 7 | 10 | V7#5 |
| 49 | 8 | — | MELODIC MINOR 5th below |
| 50 | 7 | 11 | V7b5 |
| 51 | 9 | — | LYDIAN 7th |
| 52 | 7 | 15 | V9 |
| 53 | 2 | — | MIXOLYDIAN |
| 54 | 7 | 16 | V7th#9th |
| 55 | 10 | — | ALTERED |
| 56 | 7 | 17 | V7thb9th |
| 57 | 11 | — | HARMONIC MINOR 5th below |
| 58 | 7 | 14 | V S/D |
| 59 | 2 | — | MEXOLYDIAN |
| 60 | 14 | 18 | Aug |
| 61 | 12 | — | whole tone |
| 62 | 14 | 19 | dim |
| 63 | 13 | — | Diminished |
| 64 | 14 | 20 | sus4 |
| 65 | 14 | — | sus4 |
| 66 | 15 | — | END |

FORMAT

| | | |
|---|---|---|
| EVEN ADDR | DEG | TYPE |
| ODD ADDR | SCALE | NOT USED |

FIG. 24B

| ADDR | DATA | COMMENT |
|---|---|---|
| 0 | 21 | MAJOR SCALE 1 |
| 1 | 21 | 6th SCALE 1 |
| 2 | 21 | add 9th SCALE 1 |
| 3 | 22 | minor SCALE 2 |
| 4 | . | . |
| 5 | . | . |
| . | . | . |
| . | . | . |
| . | . | . |

CFD

FIG.26

| ADDR | PITCH $AM_P$ | COLUMN POINTER $AM_T$ |
|---|---|---|
| 0 | C5 | 0 |
| 1 | | |
| 2 | E5 | 1 |
| 3 | | |
| 4 | B4 | 2 |
| 5 | | |
| 6 | E5 | 1 |
| 7 | | |
| 8 | A4 | 3 |
| 9 | | |
| 10 | E5 | 1 |
| 11 | | |
| 12 | B4 | 2 |
| 13 | | |
| 14 | E5 | 1 |
| 15 | | |

AM

FIG. 30

| COMMENT | SCALE | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|
| IMajor etc | IONIAN | 0 | 0 | 0 | 0 | | | | | | | | | | | | |
| VMajor etc | MIXOLYDIAN | -1 | -2 | -2 | -2 | | | | | | | | | | | | |
| | DORIAN | | | | | | | | | | | | | | | | |
| IVMajor etc | LYDIAN | 0 | -1 | 0 | 0 | | | | | | | | | | | | |
| | LYDIAN7th | | | | | | | | | | | | | | | | |
| FUNCTION-BASED SCALES | PHRYGIAN | | | | | | | | | | | | | | | | |
| | AEORIAN | | | | | | | | | | | | | | | | |
| | M.MINOR | | | | | | | | | | | | | | | | |
| | LOCRIAN | | | | | | | | | | | | | | | | |
| | M.MINOR5b | | | | | | | | | | | | | | | | |
| | H.MINOR5b | | | | | | | | | | | | | | | | |
| | ALTERED | | | | | | | | | | | | | | | | |
| KEY INDEPENDENT CHORDS | WHLETONE | | | | | | | | | | | | | | | | |
| | DIMINISHED | | | | | | | | | | | | | | | | |
| | SUS4 | | | | | | | | | | | | | | | | |
| Major etc | SCALE1 | 0 | 0 | -4 | 0 | | | | | | | | | | | | |
| | SCALE2 | | | | | | | | | | | | | | | | |
| | SCALE3 | | | | | | | | | | | | | | | | |
| | SCALE4 | | | | | | | | | | | | | | | | |
| TYPE-BASED SCALES | SCALE5 | | | | | | | | | | | | | | | | |
| | SCALE6 | | | | | | | | | | | | | | | | |
| | SCALE7 | | | | | | | | | | | | | | | | |
| | SCALE8 | | | | | | | | | | | | | | | | |
| | SCALE9 | | | | | | | | | | | | | | | | |

PCT

FIG. 31

| ADDR | NOTE ON/OFF & PITCH | | | | | |
|---|---|---|---|---|---|---|
| | KEY C | | KEY D | | KEY A | |
| 0 | C4 | ON | D4 | ON | C#4 | ON |
| 1 | C4 | OFF | D4 | OFF | C#4 | OFF |
| 2 | G4 | ON | F#4 | ON | A4 | ON |
| 3 | G4 | OFF | F#4 | OFF | A4 | OFF |
| 4 | E4 | ON | D4 | ON | E4 | ON |
| 5 | E4 | OFF | D4 | OFF | E4 | OFF |
| 6 | G4 | ON | F#4 | ON | A4 | ON |
| 7 | G4 | OFF | F#4 | OFF | A4 | OFF |
| 8 | C4 | ON | D4 | ON | C#4 | ON |
| 9 | C4 | OFF | D4 | OFF | C#4 | OFF |
| 10 | G4 | ON | F#4 | ON | A4 | ON |
| 11 | G4 | OFF | F#4 | OFF | A4 | OFF |
| 12 | E4 | ON | A4 | ON | E4 | ON |
| 13 | E4 | OFF | A4 | OFF | E4 | OFF |
| 14 | G4 | ON | D4 | ON | A4 | ON |
| 15 | G4 | OFF | D4 | OFF | A4 | OFF |
| 16 | | | | | | |
| 17 | | | | | | |
| 18 | | | | | | |
| 19 | | | | | | |

FIG. 35

| | PITCH INDEX | | | | | | | | | | | | | |
|---|---|---|---|---|---|---|---|---|---|---|---|---|---|---|
| TYPE & FUNC | 0 | 1 | 2 | 3 | 4 | 5 | 6 | 7 | 8 | 9 | 10 | 11 | 12 | 13 |
| Major I | 0 | 0 | 0 | 0 | | | | | | | | | | 0 |
| Major II | 0 | 0 | 0 | 0 | | | | | | | | | | 0 |
| Major III | 0 | 0 | 0 | 0 | | | | | | | | | | 0 |
| Major IV | 0 | +1 | 0 | 0 | | | | | | | | | | 0 |
| Major V | -1 | -2 | -2 | -2 | | | | | | | | | | 0 |
| 6thI | 0 | 0 | 0 | | | | | | | | | | | 0 |
| 6thIV | 0 | 0 | 0 | | | | | | | | | | | 0 |
| 6th V | 0 | 0 | 0 | | | | | | | | | | | 0 |
| Majot7thI | 0 | 0 | 0 | | | | | | | | | | | 0 |
| Major7thIV | 0 | 0 | 0 | | | | | | | | | | | 0 |
| Add9th | 0 | 0 | 0 | | | | | | | | | | | 0 |
| mimor II | 0 | -1 | 0 | | | | | | | | | | | 0 |
| minor III | 0 | -1 | 0 | | | | | | | | | | | 0 |
| minor VI | 0 | -1 | 0 | | | | | | | | | | | 0 |
| minor6th II | 0 | -1 | 0 | | | | | | | | | | | 0 |
| minor6th VI | 0 | -1 | 0 | | | | | | | | | | | 0 |
| minor7th II | 0 | -1 | 0 | | | | | | | | | | | 0 |
| minor7th III | 0 | -1 | 0 | | | | | | | | | | | 0 |
| minor7th VI | 0 | -1 | 0 | | | | | | | | | | | 0 |
| madd 9th | 0 | -1 | 0 | | | | | | | | | | | 0 |
| 7th III | 0 | 0 | 0 | | | | | | | | | | | 0 |
| 7th V | 0 | 0 | 0 | | | | | | | | | | | 0 |
| 9th | 0 | 0 | 0 | | | | | | | | | | | 0 |
| b9th | 0 | 0 | 0 | | | | | | | | | | | 0 |
| #9th | 0 | 0 | 0 | | | | | | | | | | | 0 |
| IIm7/BassV | 0 | -1 | 0 | | | | | | | | | | | -7 |
| IV/BassV | 0 | 0 | 0 | | | | | | | | | | | -7 |
| m7b5 | 0 | -1 | -1 | | | | | | | | | | | 0 |
| mM7th | 0 | -1 | 0 | | | | | | | | | | | 0 |
| 7th#5 | 0 | 0 | 1 | | | | | | | | | | | 0 |
| 7Sus4 | 0 | 1 | 0 | | | | | | | | | | | 0 |
| Sus4 | 0 | 1 | 0 | | | | | | | | | | | 0 |
| Aug | 0 | 0 | 1 | | | | | | | | | | | 0 |
| dim | 0 | -1 | -1 | | | | | | | | | | | 0 |

PCH [ ]

FIG. 39

KPM

| PITCH TYPE (PMN) | k1 | k2 | k3 |
|---|---|---|---|
| KEY | | | |
| C(0) | PNT+PCT(CCM)(PMN) | PNT+PCT(CCM)(PMN) | PNT+PCT(CCM)(PMN) |
| C#(1) | PNT+PCT(CCM)(PMN)+1 | PNT+PCT(CCM)(PMN)+1 | PNT+PCT(CCM)(PMN)+1 |
| D(2) | PNT(k3)+PCT(CCM)(k3)-12+2 | PNT(k1)+PCT(CCM)(k1)+2 | PNT(k2)+PCT(CCM)(k2)+2 |
| Eb(3) | PNT(k3)+PCT(CCM)(k3)-12+3 | PNT(k1)+PCT(CCM)(k1)+3 | PNT(k2)+PCT(CCM)(k2)+3 |
| E(4) | PNT(k3)+PCT(CCM)(k3)-12+4 | PNT(k1)+PCT(CCM)(k1)+4 | PNT(k2)+PCT(CCM)(k2)+4 |
| F(5) | PNT(k3)+PCT(CCM)(k3)-12+5 | PNT(k1)+PCT(CCM)(k1)+5 | PNT(k2)+PCT(CCM)(k2)+5 |
| F#(6) | PNT(k2)+PCT(CCM)(k2)-(12-6) | PNT(k3)+PCT(CCM)(k3)-(12-6) | PNT(k1)+PCT(CCM)(k1)+12-(12-6) |
| G(7) | PNT(k2)+PCT(CCM)(k2)-(12-7) | PNT(k3)+PCT(CCM)(k3)-(12-7) | PNT(k1)+PCT(CCM)(k1)+12-(12-7) |
| Ab(8) | PNT(k2)+PCT(CCM)(k2)-(12-8) | PNT(k3)+PCT(CCM)(k3)-(12-8) | PNT(k1)+PCT(CCM)(k1)+12-(12-8) |
| A(9) | PNT(k2)+PCT(CCM)(k2)-(12-9) | PNT(k3)+PCT(CCM)(k3)-(12-9) | PNT(k1)+PCT(CCM)(k1)+12-(12-9) |
| Bb(10) | PNT+PCT(CCM)(PMN)-(12-10) | PNT+PCT(CCM)(PMN)-(12-10) | PNT+PCT(CCM)(PMN)-(12-10) |
| B(11) | PNT+PCT(CCM)(PMN)-(12-11) | PNT+PCT(CCM)(PMN)-(12-11) | PNT+PCT(CCM)(PMN)-(12-11) |

FIG. 42

| CCM | k1 | k2 | k3 |
|---|---|---|---|
| MajorI | 0 | 0 | 0 |
| MajorIII | | | |
| MajorIV | 0 | 1 | 2 |
| MajorV | - 1 | - 2 | 0 |
| 6thI | | | |
| 6thIV | | | |
| 6thV | | | |
| Major7thI | | | |
| Major7thIV | | | |
| Add9th | | | |
| minorII | | | |
| minorIII | | | |
| minorVI | | | |
| minor6thII | | | |
| minor6thVI | | | |
| minor7thII | | | |
| minor7thIII | | | |
| minor7thVI | | | |
| madd9th | | | |
| 7thIII | | | |
| 7thV | | | |
| 9thV | | | |
| b9thV | | | |
| mM7thIV | | | |
| mM7thVI | | | |
| 7Sus4III | | | |
| 7Sus4V | | | |
| Sus4 | | | |
| Aug | 0 | 0 | 1 |
| dim | | | |

FIG. 43

| ADDRESS | PITCH PNT | PITCH TYPE PMN |
|---|---|---|
| 0 | C4 | K1 |
| 1 | | |
| 2 | E4 | K2 |
| 3 | | |
| 4 | G4 | K3 |
| 5 | | |
| 6 | E4 | K2 |
| 7 | | |
| 8 | C4 | K1 |
| 9 | | |
| 10 | E4 | K2 |
| 11 | | |
| 12 | G4 | K3 |
| 13 | | |
| 14 | E4 | K2 |
| 15 | | |

REF

| ADDRESS | PITCH AMP | POINTER AMT |
|---|---|---|
| 0 | C5 | K1 |
| 1 | | |
| 2 | E5 | 1 |
| 3 | | |
| 4 | B4 | 2 |
| 5 | | |
| 6 | E5 | 1 |
| 7 | | |
| 8 | A4 | 3 |
| 9 | | |
| 10 | E5 | 1 |
| 11 | | |
| 12 | B4 | 2 |
| 13 | | |
| 14 | E5 | 1 |
| 15 | | |

AM[ ]

FIG. 51

| STYLE | FUNC NAME | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|
| STYLE 1 | Major I | 0 | 0 | 0 | 0 | | | | | | | | | | | | | |
| | Major II | | | | | | | | | | | | | | | | | |
| | Major IV | 0 | 1 | 0 | 0 | | | | | | | | | | | | | |
| | Major V | -1 | -2 | -2 | -2 | | | | | | | | | | | | | |
| | 6thI | | | | | | | | | | | | | | | | | |
| | 6thIV | | | | | | | | | | | | | | | | | |
| | 6thV | | | | | | | | | | | | | | | | | |
| | Major7thI | | | | | | | | | | | | | | | | | |
| | Major7thIV | | | | | | | | | | | | | | | | | |
| | Add9th | | | | | | | | | | | | | | | | | |
| | minor II | | | | | | | | | | | | | | | | | |
| | minor III | | | | | | | | | | | | | | | | | |
| | minor VI | | | | | | | | | | | | | | | | | |
| | minor 6th II | | | | | | | | | | | | | | | | | |
| | minor 6th VI | | | | | | | | | | | | | | | | | |
| | minor 7th II | | | | | | | | | | | | | | | | | |
| | minor 7th III | | | | | | | | | | | | | | | | | |
| | minor 7th VI | | | | | | | | | | | | | | | | | |
| | madd 9th | | | | | | | | | | | | | | | | | |
| | 7th III | | | | | | | | | | | | | | | | | |
| | 7th V | | | | | | | | | | | | | | | | | |
| | 9th V | | | | | | | | | | | | | | | | | |
| | b9thV | | | | | | | | | | | | | | | | | |
| | mM 7th IV | | | | | | | | | | | | | | | | | |
| | mM 7th VI | | | | | | | | | | | | | | | | | |
| | 7Sus4 III | | | | | | | | | | | | | | | | | |
| | 7Sus4 V | | | | | | | | | | | | | | | | | |
| | Sus4 I | | | | | | | | | | | | | | | | | |
| | Sus4 II | | | | | | | | | | | | | | | | | |
| | Sus4 III | | | | | | | | | | | | | | | | | |
| | Sus4 V | | | | | | | | | | | | | | | | | |
| | Sus4VI | | | | | | | | | | | | | | | | | |
| | Aug I | 0 | 0 | -3 | 1 | | | | | | | | | | | | | |
| | Aug I# | 1 | 1 | -2 | 2 | | | | | | | | | | | | | |
| | Aug II | -2 | -2 | -3 | -3 | | | | | | | | | | | | | |
| | Aug II# | | | | | | | | | | | | | | | | | |
| | Aug III | | | | | | | | | | | | | | | | | |
| | Aug IV | | | | | | | | | | | | | | | | | |
| | Aug IV# | | | | | | | | | | | | | | | | | |
| | Aug V | | | | | | | | | | | | | | | | | |
| | Aug V# | | | | | | | | | | | | | | | | | |
| | Aug VI | | | | | | | | | | | | | | | | | |
| | Aug VI# | | | | | | | | | | | | | | | | | |
| | Aug VII | | | | | | | | | | | | | | | | | |
| | dim I | | | | | | | | | | | | | | | | | |
| | dim I# | | | | | | | | | | | | | | | | | |
| | dim II | | | | | | | | | | | | | | | | | |
| | dim II# | | | | | | | | | | | | | | | | | |
| | dim III | | | | | | | | | | | | | | | | | |
| | dim IV | | | | | | | | | | | | | | | | | |
| | dim IV# | | | | | | | | | | | | | | | | | |
| | dim V | | | | | | | | | | | | | | | | | |
| | dim V# | | | | | | | | | | | | | | | | | |
| | dim VI | | | | | | | | | | | | | | | | | |
| | dim VI# | | | | | | | | | | | | | | | | | |
| | dim VII | | | | | | | | | | | | | | | | | |

STYLE 2 PITCH CHANGE TABLE

PCT

FIG.52

MEASURE NO. / BEAT NO. / BEAT / NOTE ON TIME / PITCH IN C MAJOR / GATE TIME (DURATION) / INDEX rtl.nrm.cl

| | | | |
|---|---|---|---|
| 1-2/4-00/12 | G_5 | 08 | rt6 |
| 1-2/4-00/12 | D_5 | 08 | rt7 |
| 1-2/4-00/12 | A#4 | 08 | rt8 |
| 1-2/4-09/12 | D_5 | 02 | rt7 |
| 1-2/4-09/12 | A#4 | 02 | rt8 |
| 1-4/4-00/12 | D_5 | 02 | rt7 |
| 1/4/4-06/12 | G_5 | 11 | rt6 |
| 1-4/4-06/12 | D_5 | 08 | rt7 |
| 1-4/4-06/12 | A#4 | 08 | rt8 |
| 2-1/4-06/12 | G_5 | 02 | rt6 |
| 2-1/4-06/12 | D_5 | 05 | rt7 |
| 2-1/4-06/12 | A#4 | 05 | rt8 |
| 2-2/4-06/12 | C_4 | 05 | bb1 |
| 2-3/4-00/12 | C_5 | 05 | ep9 |
| 2-3/4-00/12 | A_4 | 04 | rt9 |
| 2-3/4-00/12 | F_4 | 04 | rt3 |
| 2-4/4-00/12 | C_5 | 04 | ep6 |
| 2-4/4-00/12 | D#4 | 05 | rt4 |
| 2-4/4-06/12 | E_4 | 05 | rt5 |

rtl.nrm.c2

| | | | |
|---|---|---|---|
| 1-1/4-00/12 | G_4 | 05 | r25 |
| 1-1/4-06/12 | C_4 | 05 | bb1 |
| 1-2/4-00/12 | A_4 | 05 | r26 |
| 1-2/4-06/12 | C_4 | 05 | bb1 |
| 1-3/4-00/12 | G_4 | 05 | r25 |
| 1-3/4-00/12 | F#4 | 02 | rt1 |
| 1-3/4-06/12 | C_4 | 05 | bb1 |
| 1-4/4-00/12 | A_4 | 05 | r26 |
| 1-4/4-06/12 | C_4 | 05 | bb1 |
| 2-1/4-00/12 | G_4 | 05 | r25 |
| 2-1/4-06/12 | C_4 | 05 | bb1 |
| 2-2/4-00/12 | A_4 | 05 | r26 |
| 2-2/4-06/12 | C_4 | 05 | bb1 |
| 2-3/4-00/12 | G_4 | 05 | r25 |
| 2-3/4-06/12 | C_4 | 05 | bb1 |
| 2-4/4-00/12 | A_4 | 05 | r26 |
| 2-4/4-06/12 | C_4 | 05 | bb1 |

rtl.nrm.b

| | | | |
|---|---|---|---|
| 1-1/4-00/12 | C_4 | 17 | bb1 |
| 1-2/4-06/12 | G_4 | 05 | r25 |
| 1-3/4-00/12 | A#4 | 10 | rt10 |
| 1-4/4-00/12 | C_5 | 05 | ep9 |
| 1-4/4-06/12 | C_4 | 23 | bb1 |
| 2-2/4-06/12 | G_4 | 05 | r25 |
| 2-3/4-00/12 | A#4 | 05 | rt10 |
| 2-3/4-06/12 | C_5 | 05 | ep9 |
| 2-4/4-00/12 | A#4 | 05 | rt10 |
| 2-4/4-06/12 | G_4 | 05 | r25 |

rtl.nrm.r

| | | |
|---|---|---|
| 1-1/4-00/12 | 030 | cc4 |
| 1-1/4-00/12 | 030 | bd1 |
| 1/2/4-00/12 | 030 | rc2 |
| 1-2/4-00/12 | 030 | sd2 |
| 1-2/4-06/12 | 030 | th3 |
| 1-3/4-00/12 | 030 | rc2 |
| 1-3/4-00/12 | 030 | bd1 |
| 1-3/4-06/12 | 030 | th3 |
| 1-3/4-06/12 | 030 | bd1 |
| 1-4/4-00/12 | 030 | th1 |
| 1/4/4-00/12 | 030 | rc2 |
| 1/4/4-00/12 | 030 | sd2 |
| 1-4/4-06/12 | 030 | th3 |
| 1-4/4-06/12 | 030 | bd1 |
| 2-1/4-00/12 | 030 | rc2 |

AM [R&B]

FIG. 55

| | 1_M | 1M7 | 2_m | 2m7 | 2m7 | 3_m | 3m7 | 3_M | 3_7 | 37s | 4_M | 4M7 | 4_m | 4mM | 5_M | 5_7 | 57s | 6_m | 6m7 | 6mM | 7m5 | su4 | aug | dim | BAS |
|---|---|---|---|---|---|---|---|---|---|---|---|---|---|---|---|---|---|---|---|---|---|---|---|---|---|
| bb1 | C_4 | C_4 | D_4 | D_4 | D_4 | E_4 | E_4 | E_4 | E_4 | E_4 | F_3 | F_3 | F_3 | F_3 | G_3 | G_3 | G_3 | A_3 | A_3 | A_3 | B_3 | C_4 | C_4 | C_4 | C_4 |
| ep9 | C_5 | C_5 | D_5 | D_5 | D_5 | E_5 | E_5 | E_5 | E_5 | E_5 | F_4 | F_4 | F_4 | F_4 | G_4 | G_4 | G_4 | A_4 | A_4 | A_4 | B_4 | C_5 | C_5 | C_5 | C_5 |
| r25 | G_4 | G_4 | A_4 | A_4 | G#4 | B_4 | B_4 | B_4 | B_4 | B_4 | C_4 | C_4 | C_4 | C_4 | D_4 | D_4 | D_4 | E_4 | E_4 | E_4 | F_4 | G_4 | G#4 | F#4 | G_4 |
| r26 | A_4 | A_4 | B_4 | C_5 | A#4 | C_5 | D_5 | A_4 | D_5 | D_5 | D_4 | D_4 | D_4 | D_4 | E_4 | F_4 | F_4 | A_4 | G_4 | G#4 | A_4 | F_4 | G#4 | A_4 | A_4 |
| rt1 | F#4 | F#4 | G#4 | G#4 | G_4 | A#4 | A#4 | A#4 | A#4 | A#4 | B_3 | B_3 | B_3 | B_3 | C#4 | C#4 | C#4 | D#4 | D#4 | D#4 | E_4 | F#4 | F#4 | F_4 | F_4 |
| rt3 | F_4 | F_4 | G_4 | G_4 | G_4 | A_4 | A_4 | A_4 | A_4 | A_4 | A#3 | E_4 | A#3 | A#3 | C_4 | C_4 | C_4 | D_4 | D_4 | D_4 | E_4 | F_4 | E_4 | D#4 | E_4 |
| rt4 | D#4 | D#4 | E_4 | E_4 | E_4 | F#4 | F#4 | G_4 | G_4 | A_4 | G#3 | G#3 | G_3 | G_3 | A#3 | A#3 | C_4 | D_4 | B_3 | B_3 | E_4 | F_4 | D_4 | D_4 | D_4 |
| rt5 | E_4 | E_4 | F_4 | F_4 | F_4 | G_4 | G_4 | G#4 | G#4 | A_4 | A_3 | A_3 | G#3 | G#3 | B_3 | B_3 | D_4 | C_4 | C_4 | C_4 | D_4 | G_4 | E_4 | D#4 | D_4 |
| rt6 | G_5 | G_5 | A_5 | A_5 | G#5 | B_5 | B_5 | B_5 | G_5 | A_5 | C_5 | C_5 | C_5 | C_5 | D_5 | D_5 | D_5 | A_5 | B_5 | G#5 | F_5 | G_5 | G#5 | A_5 | G_5 |
| rt7 | D_5 | E_5 | F_5 | F_5 | F_5 | G_5 | G_5 | G#5 | D_5 | E_5 | G_4 | G_4 | G#4 | G#4 | A_4 | B_4 | C_5 | E_5 | E_5 | E_5 | D_5 | F_5 | E_5 | D#5 | D_5 |
| rt8 | A#4 | B_4 | E_5 | C_5 | C_5 | E_5 | D_5 | E_5 | G#4 | D_5 | D#4 | D#4 | F_4 | E_4 | F_4 | F_4 | F_4 | C_5 | C_5 | C_5 | A_4 | C_5 | C_5 | C_5 | A_4 |
| rt9 | A_4 | G_4 | A_4 | A_4 | G#4 | B_4 | B_4 | B_4 | B_4 | D_5 | D_4 | C_4 | C_4 | C_4 | E_4 | D_4 | D_4 | E_4 | E_4 | E_4 | F_4 | G_4 | G#4 | A_4 | G_4 |
| rt10 | A#4 | B_4 | C_5 | C_5 | C_5 | D_5 | D_5 | D_5 | D_5 | D_5 | D#4 | E_4 | D_4 | E_4 | F_4 | F_4 | F_4 | G_4 | G_4 | G#4 | A_4 | C_5 | C_5 | A_4 | A_4 |

| | | | | | | | | | | | | | | | | | | | | | | | | | |
|---|---|---|---|---|---|---|---|---|---|---|---|---|---|---|---|---|---|---|---|---|---|---|---|---|---|
| bn,f,e | c2n | c2n | c2n | c1n | c1n | c1n | c1n | c1n | c1n | c1n | c1n | c1n | c1n | c1n | c1n | c1n | c1n | c1n | c1n | c1n | c1n | c1n | c1n | c1n | c1n |

PCT [R&B]

FIG. 56

MUSIC APPARATUS FOR DETERMINING TONALITY FROM CHORD PROGRESSION FOR IMPROVED ACCOMPANIMENT

BACKGROUND OF THE INVENTION

1. Technical Field

This invention generally relates to musical apparatus. In particular the invention pertains to an apparatus for determining a tonality from a chord progression and to an automatic accompaniment performing apparatus.

2. Description of Prior Art

An electronic musical instrument having an automatic accompaniment performing capability is known. A play input device (e.g., musical keyboard) of the musical instrument is used to successively designate chords each represented by a keycode (note number) combination to provide a chord progression. Within the musical instrument there is provided a chord member memory which stores members of each chord in a chord set. Each stored chord member indicates a pitch interval from a chord root. Assuming that one of a plurality of keycodes (note numbers) entered from the keyboard is a root of the chord designated by the plurality of keycodes, a chord root and type determining means converts each entered keycode to a corresponding pitch interval from that root to obtain designated chord member data comparable with that of the chord member memory. The chord root and type determining means identifies a type and root of a designated chord by finding stored chord member data of a particular chord type that matches the designated chord member data. In this manner, there is formed a chord progression in which each chord is represented by a root and a type. The musical instrument further includes an accompaniment pattern memory storing an accompaniment pattern. The accompaniment pattern comprises horizontal (time) component and vertical (pitch) component of an accompaniment line. An accompaniment decoding means converts the stored vertical data to pitch data indicative of an actual pitch of the accompaniment in accordance with an identified chord type and root.

The musical instrument described above has no capability of evaluating a function of a chord in a chord progression. In general, in music, even if a type and root of a chord is known, this is not enough to determine a tonality i.e., a pitch class set available in the time interval of that chord. By way of example, take up a chord of C major (root=C, type=major) having members of C, E and G. If C major chord has a function of tonic (I), a desired set of pitch classes are C, D, E, F, G, A and B which form an ionian scale in a key of C. If the same chord has a function of dominant (V), a set of pitch classes C, D, E, F, G, A and B♭ forming a mixolydian scale in key F may be suitable. In the case when C major chord has a function of subdominant (IV), a desired set of pitch classes will be C, D, E, F#, G, A and B which form a lydian scale in key G. As noted, it is a nature of music that a specified function as well as specified type and root of a chord is required to determine a desired pitch class set (tonality). Nevertheless, this is disregarded in the musical instrument stated above which instead decodes the stored accompaniment pattern by using only a chord root and type to determine accompaniment pitches. The resultant accompaniment can sound unnatural because of undesirable pitches contained therein that weaken or damage the desired tonality. This may be avoided by restricting vertical contents of the accompaniment to, for example, chord member pitches only. This solution, however, will deprive the accompaniment of musical interest because of its poor pitch contents.

U.S. Pat. No. 5,003,860, issued Apr. 2, 1991 and assigned to the same assignee as the present application discloses a tonality determining apparatus which determines a tonality from a chord progression and an automatic accompaniment performing apparatus which uses the results from the tonality determining means to play an accompaniment. This tonality determining apparatus uses algorithms (programs) rather than data to realize musical knowledge required for determining a tonality. Because of its principles, the tonality determining apparatus provides a tonality with a relatively low reliability. In other words, to obtain an accurate tonality, the tonality determining apparatus of this type would require complicated logic and arithmetic operations consuming a considerable time which would not be permissible in real-time applications such as automatic accompaniment performing apparatus.

Another example of tonality determining apparatus and automatic accompaniment performing apparatus is disclosed in Japanese patent application laid open to public as Kokai Hei2-29787. This tonality determining apparatus searches from a given chord progression for a portion indicative of a specific chord pattern having a particular chord type pattern and a particular chord root difference pattern to determine a key. However, the tonality determining apparatus will never use or reference a key determined already for a preceding portion of the chord progression to determine a key for a succeeding chord in the chord progression. This tends to introduce a delay in detecting a modulation (change of key), resulting in wrong key determination for a portion of the chord progression. Thus, an automatic accompaniment performing apparatus, which is an application of such tonality determining apparatus, cannot hope to perform a satisfactory accompaniment for the reasons stated before.

U.S. patent application Ser. No. 07/681,085 filed Apr. 5, 1991, issued on Jan. 12, 1993 as U.S. Pat. No. 5,179,241 and assigned to the same assignee as the present application discloses a tonality determining apparatus which determines a key of a succeeding chord by using a prevailing key as clue. This tonality determining apparatus has a same key function for determining whether a succeeding chord keeps the prevailing key and a modulation detecting function for determining whether a succeeding chord suggests a key related to the prevailing key. Thus, the tonality apparatus can provide a relatively correct recognition of a key of each chord in a chord progression, and detect a modulation to a closedly related key without delay. Yet, in real music, there are various situations all of which the apparatus cannot successfully handle. In actual music, for example, a succeeding key can be unrelated to a preceding key. A beginning portion of a music piece has no preceding key. A preceding or prevailing key can be unspecific or indefinite. These regions of music phenomena are beyond the capability of the tonality determining apparatus which, thus, leaves room for improvement.

The above U.S. Pat. No. 5,179,241 also discloses an automatic accompaniment apparatus which plays an automatic accompaniment by utilizing results (chord function, type and key) from a real-time tonality determining means. The resultant accompaniment has a relatively natural tonality.

However, the accompaniment forming device of the automatic accompaniment apparatus is arranged such that it first forms an accompaniment pattern written in a particular key and then "transposes" it according to a key supplied from the tonality determining apparatus. This gives rise to a pitch-leaping problem in connection with a modulation (change of key). The pitch or range of a played accompaniment line changes or shifts between before and after the modulation to an extent corresponding to the difference between the key before the modulation and the one after the modulation. This is called a leap motion in pitch line.

Such a leap motion phenomenon is undesirable except when the music of interest has such an intention. Users (listeners) of the apparatus would feel unnaturalness.

The same problem is involved in the automatic accompaniment apparatus disclosed in U.S. Pat. No. 5,003,860 and Japanese patent application laid open Hei2-29787.

Whereas the apparatus disclosed in U.S. Pat. No. 5,179,241 can provide an accompaniment with a natural tonality, it still has the limit in its tonality determining capability since musical (tonality) information derivable from a chord progression only is limited due to a nature of music. In fact, a pitch class set suitable in each chord time interval in a given chord progression depends not only on the chord function but also relies on a particular musical style to which an intended accompaniment is directed. As stated the prior art automatic accompaniment apparatus has two distinct types. The first type forms an accompaniment based on a chord root and a chord type. The second type apparatus forms an accompaniment based on a chord tonality (i.e., keynote, function and type). The automatic accompaniment apparatus of the first type provides an accompaniment with undesirable pitches whereas the apparatus of the second type provides a relatively natural accompaniment although it requires means for analyzing a chord progression for extraction of tonality.

An important problem of the accompaniment formation is to provide a natural and real accompaniment while saving the storage capacity required for the accompaniment data. Unfortunately, no prior art automatic accompaniment apparatus has successfully solved this problem.

For example, a prior art chord root/type based automatic accompaniment has a stored accompaniment pattern suited for a reference chord root and type, corrects pitch data in the stored accompaniment pattern according to a detected chord type, and adds a detected chord root to the corrected pitch data. Whereas this arrangement requires only a small amount of storage capacity, it provides an unnatural accompaniment with undesirable pitches. A known tonality based automatic accompaniment apparatus includes a memory storing a large number of accompaniment patterns grouped by accompaniment styles and tonalities and selects, when operated, a particular accompaniment pattern corresponding to a combination of a designated accompaniment style and a recognized tonality. Though it can provide a real accompaniment with a variety, this arrangement requires an enormous amount of storage and is unfeasible when implementing on a single or few chip microcomputer.

SUMMARY OF THE INVENTION

Therefore, an object of the invention is to provide an improved tonality determining apparatus which can successfully handle various musical situations in a chord progression (e.g., when a prevailing key can be a clue to the determination of a succeeding key of a succeeding chord, when the prevailing key cannot be a clue to the determination of the succeeding key, absence of the prevailing or preceding key, or indefinite prevailing key) to thereby increase the tonality determining capability.

A further object of the invention is to provide an automatic accompaniment apparatus capable of providing an accompaniment with a desirable tonality by utilizing such tonality determining apparatus of the invention.

A first aspect of the invention provides a tonality determining apparatus which comprises chord progression providing means for providing a chord progression in which each chord is represented by a root and a type, current keynote storage means for storing data indicative of a current keynote of a current tonality, first tonality determining means for determining a tonality of a new chord from the chord progression based on the current keynote, and second tonality determining means for analyzing a chord pattern formed by the new chord and its preceding at least one chord to thereby determine a tonality of the new chord without relying on the current keynote.

In this arrangement, the first tonality determining means determines a tonality of a new chord by utilizing a current keynote (which precedes the new chord) as a clue whereas the second tonality determining apparatus determines a tonality of the new chord by analyzing a chord pattern formed by the new chord and its preceding chord or chords. Thus, the present tonality determining apparatus can successfully handle both a first musical situation where a preceding keynote or tonality can be a clue to the determination of a succeeding tonality of a succeeding chord, and a second musical situation where a preceding keynote cannot be a clue to the determination of a succeeding tonality.

In an embodiment, the first tonality determining means is operative either when the current key has been specified or identified whereas the second tonality determining apparatus is operative when the current key is unspecified or indefinite (including the case of absence of current keynote), or when the first tonality determining means has failed to specify the tonality of the new chord (because of the musical situation in which the current keynote cannot be a clue to the succeeding tonality).

In a preferred embodiment, the first tonality determining apparatus comprises same keynote keeping table storage means for storing a set of chords keeping a keynote unchanged, modulation chord sequence table storage means for storing a set of chord sequences indicative of a modulation from a keynote to a different keynote, first function and keynote determining means for analyzing the chord progression by using the current keynote storage means, the same keynote keeping table storage means and the modulation chord sequence table storage means to thereby determine a function name and keynote of the new chord, and first tonality data producing means for producing tonality data defining a pitch class set available in a time interval of the new chord based on the function name and keynote from the first function and keynote determining means. The second tonality determining means comprises key establishing chord sequence table storage means for storing a set of chord sequences establishing a keynote, second function and keynote determining means for analyzing the chord progression by using the key establishing chord sequence table storage means to thereby determine a function name and keynote of the new chord, and second tonality data producing means for producing tonality data defining a pitch class set available in the time interval of the new chord based on the function name and keynote from the second function and keynote determining means.

The first function and keynote determining means may preferably comprise same key search means for searching the same keynote keeping table storage means to see whether the new chord has a function of keeping the current keynote, and modulation search means for searching the modulation chord sequence table storage means to see whether the chord pattern formed by the new and its preceding chords has a function of suggesting a modulation from the current keynote to a related keynote. The second function and keynote determining means may preferably comprise key establishment search means for searching the key establishing chord sequence table storage means to see whether the chord pattern formed by the new and its preceding chords has a function of establishing a particular key. The tonality determining apparatus may further comprise first keynote updating means for updating the current keynote storage means to the related keynote when the first tonality determining means determines the related keynote, and second keynote updating means for updating the current keynote storage means to the particular key when the second tonality determining means determines the particular key.

A second aspect of the invention provides an automatic accompaniment apparatus capable of performing a musical accompaniment with a desired tonality by utilizing the tonality determining apparatus of the invention.

Such automatic accompaniment apparatus comprises chord progression providing means for providing a chord progression in which each chord is represented by a root and a type, current keynote storage means for storing data indicative of a current keynote of a current tonality, first tonality determining means for determining a tonality of a new chord from the chord progression based on the current keynote, second tonality determining means for analyzing a chord pattern formed by the new chord and its preceding at least one chord to thereby determine a tonality of the new chord without relying on the current keynote, first accompaniment forming means responsive to when the first tonality determining means specifies a tonality of the new chord for forming an accompaniment in a time interval of the new chord according to the specified tonality of the new chord from the first tonality determining means, and second accompaniment forming means responsive to when the second tonality determining means specifies a tonality of the new chord for forming an accompaniment in a time interval of the new chord according to the specified tonality of the new chord from the second tonality determining means.

In an embodiment, each of the first and second tonality determining means comprises means for supplying a function name and keynote of the new chord as determined tonality information to the first and second accompaniment forming means, respectively. Each of the first and second accompaniment forming means comprises accompaniment pattern generating means for generating an accompaniment pattern according to the supplied function name, and accompaniment pitch forming means for transposing each pitch in the accompaniment pattern from the accompaniment pattern generating means according to the supplied keynote to thereby form a pitch of an accompaniment tone.

A further object of the invention is to provide an automatic accompaniment apparatus capable of desirably maintaining or adjusting pitch range of an accompaniment before and after a musical modulation (change of key).

A third aspect of the invention provides an automatic accompaniment apparatus which comprises chord progression input means for inputting a chord progression, chord progression analyzing means for analyzing the input chord progression with respect to tonality and for detecting a modulation in the input chord progression, and accompaniment forming means for forming an accompaniment based on results from the chord progression analyzing means. The accompaniment forming means comprises modulation compensating means for controlling a pitch line of the accompaniment so as to compensate pitch difference formed between keys before and after the modulation.

This arrangement controls the pitch line of the accompaniment before and after the modulation (change of key) so as to compensate for or cancel the magnitude of the difference formed between those keys before and after the modulation, and therefore successively provides a desired accompaniment free of leap motion or shifting of pitch range.

In an embodiment, the modulation compensating means comprises key-group classified accompaniment pattern storage means for storing accompaniment patterns classified by key groups, reading means responsive to a determined key from the chord progression analyzing means for selectively reading an accompaniment pattern of a key group to which the determined key pertains, and forming means for forming contents of the accompaniment based on the read accompaniment pattern.

The forming means preferably comprises converting table storage means for storing a table of converting data to be used for converting a note type to a pitch, and converting data reading means for receiving accompaniment pattern from the reading means and tonality information from the chord progression analyzing means and for using note type information contained in the received accompaniment pattern and the received tonality information to thereby read appropriate converting data from the converting table storage means.

This arrangement greatly saves the amount of stored data required for the production of accompaniment.

In another embodiment, the modulation compensating means comprises reference accompaniment pattern storage means for storing a reference accompaniment, first converting means for converting pitch information contained in the reference accompaniment pattern according to a keynote contained in the tonality information supplied from the chord progression analyzing means to thereby form a first converted accompaniment pattern, and second converting means for converting pitch information contained in the first converted accompaniment pattern according to a chord type and function combination contained in the tonality information supplied from the chord progression analyzing means to thereby form a second converted accompaniment pattern defining an actually performed accompaniment.

This arrangement also provides a desired accompaniment with a relatively small storage capacity.

For preference, the second converting means comprises converting means comprising converting table storage means which is addressed by a first argument specified by pitch information in the first converted accompaniment pattern and a second argument specified by the chord type and function combination to thereby return pitch interval data indicative of an pitch interval from a keynote or chord root, and computing means for combining data of a pitch class of keynote or chord root supplied from the chord progression analyzing means with the returned pitch interval data to thereby form pitch data of the second converted accompaniment pattern.

A further object of the invention is to provide an automatic accompaniment apparatus capable of performing an accompaniment with greater variations depending on various musical styles and chord progressions while at the same time saving storage capacity for accompaniment.

A fourth aspect of the invention provides an automatic accompaniment apparatus which comprises chord progression providing means for providing a chord progression, tonality determining means for determining a tonality of each chord in the chord progression, and accompaniment forming means for forming an accompaniment based on the determined tonality. The accompaniment forming means comprises style designating means for designating a musical style, and accompaniment pattern generating means for generating a plurality of accompaniment patterns each for a different combination of musical style and tonality such that pitch contents of an accompaniment pattern can be made different depending on musical styles even for the same tonality. The accompaniment pattern generating means comprises style-grouped reference accompaniment pattern storage means for storing accompaniment patterns grouped by musical styles and pitch modifying means for modifying each pitch element in a accompaniment pattern from the style-grouped reference accompaniment storage means according to a combination of musical style and tonality to thereby form a pitch of an accompaniment to be actually performed.

In the operation of this arrangement, a tonality of a chord in a chord progression is determined under a particular musical style designated in advance. An accompaniment pattern corresponding to the designated musical style is read out from the style-grouped reference accompaniment pattern storage means. Then, each pitch element in the read accompaniment pattern is modified based on a particular combination of the determined tonality and the designated style to thereby form pitches of an actually performed accompaniment. Therefore, the arrangement can realize a desired accompaniment which changes in various ways depending on musical styles and chord progressions while saving the required storage capacity for the formation of accompaniment.

A further object of the invention is to provide an automatic accompaniment apparatus capable of providing a natural and real accompaniment with a relatively small amount of storage.

A fifth aspect of the invention provides an automatic accompaniment apparatus which comprises chord progression providing means for providing a chord progression, tonality determining means for analyzing the chord progression to thereby determine a tonality of each chord in the chord progression, and accompaniment forming means for forming an accompaniment based on the determined tonality. The accompaniment forming means comprises reference accompaniment pattern storage means for storing an accompaniment pattern for a reference tonality and accompaniment pitch modifying means for modifying each pitch in the accompaniment pattern read out from the reference accompaniment pattern storage means. The accompaniment pitch modifying means comprises means for modifying an accompaniment pitch such that those pitches contained in the read accompaniment pattern and having the same pitch class are modified to have different pitches from each other for a determined tonality different from the reference tonality.

This arrangement realizes an accompaniment with a natural tonality by the function of the tonality determining means. The use of the reference accompaniment pattern storage means achieves saving of storage capacity for accompaniment. The means is provided which modifies those pitches contained in the reference accompaniment pattern and having the same pitch class such that they have different pitch classes from each other, depending on determined tonalities. With this provision, the apparatus can realize a desired pitch modification which cannot be attained by simply modifying those pitches of the reference pattern and having the same pitch class based on determined tonalities into pitches which are different from the pitches before the modification but have the same pitch class from each other. Thus, the present automatic accompaniment apparatus successfully provides a more natural and real accompaniment with its pitch line and sound varying in diversity depending on tonality variations.

BRIEF DESCRIPTION OF THE DRAWINGS

The invention will now be described in more detail, by way of example, with reference to the following description taken in conjunction with the accompanying drawings in which:

FIG. 1F is a table showing how to get a pitch class set available for a chord with an indefinite function by utilizing a common PC method;

FIG. 5 shows a chord member table residing in ROM 102 in FIG. 2 for chord recognition;

FIGS. 6A, 6B and 6C show a list of variables used in the first embodiment;

FIG. 10 shows a same keynote keeping chord table residing in ROM 102 in FIG. 2;

FIG. 12A illustrates a set of functional chord sequences of a relative key (major-to-relative-minor modulation) chord sequence table residing in ROM 102 in FIG. 2;

FIG. 12B illustrates the memory format of the relative key sequences table of FIG. 12A;

FIG. 14 illustrates a pivot chord table residing in ROM 102 in FIG. 2;

FIG. 15 illustrates a post-modulation chord table residing in ROM 102 in FIG. 2;

FIG. 18 shows a key establishing chord sequence table memory;

FIGS. 24A and 24B show a function name/scale converting table memory residing in ROM 102 in FIG. 2;

FIG. 26 shows a chord type/scale converting table memory residing in ROM 102 in FIG. 2;

FIG. 30 shows an accompaniment pattern memory storing data of the accompaniment pattern shown in FIG. 29;

FIG. 31 shows a pitch change table memory residing in ROM 102 in FIG. 2 and used for modifying pitch contents of the accompaniment pattern from the accompaniment pattern memory for actual play of an accompaniment;

FIG. 35 shows an accompaniment pattern memory which may reside in ROM 102 in FIG. 2 for the second embodiment of the invention, and stores accompaniment patterns grouped by combinations of key, chord function and type;

FIG. 39 shows a pitch change table which is used to modify pitch contents of an accompaniment pattern from the memory shown in FIG. 35, and may reside in ROM 102 in FIG. 2 for the implementation of the second embodiment;

FIG. 42 shows a pitch computation table used in the third embodiment;

FIG. 43 illustrates a pitch change table useful in the third embodiment;

FIG. 51 shows a style-grouped accompaniment pattern memory which stores accompaniment patterns grouped by musical styles in accordance with the fourth embodiment of the invention;

FIG. 52 shows a style-grouped pitch change table memory which stores pitch change data table grouped by musical styles to achieve desired pitch modification of an accompaniment pattern as a function of a musical style in accordance with the fourth embodiment of the invention;

FIG. 55 shows data of accompaniment patterns for rhythm and blues in accordance with the fifth embodiment of the invention;

FIG. 56 shows a pitch change table for rhythm and blues in accordance with the fifth embodiment of the invention.

DETAILED DESCRIPTION OF THE PREFERRED EMBODIMENTS

FIGS. 1A-1E show an automatic accompaniment apparatus incorporating features of the invention. The present automatic apparatus basically comprises a tonality determining apparatus (chord progression analyzer) and an accompaniment forming apparatus.

Figure 1A:
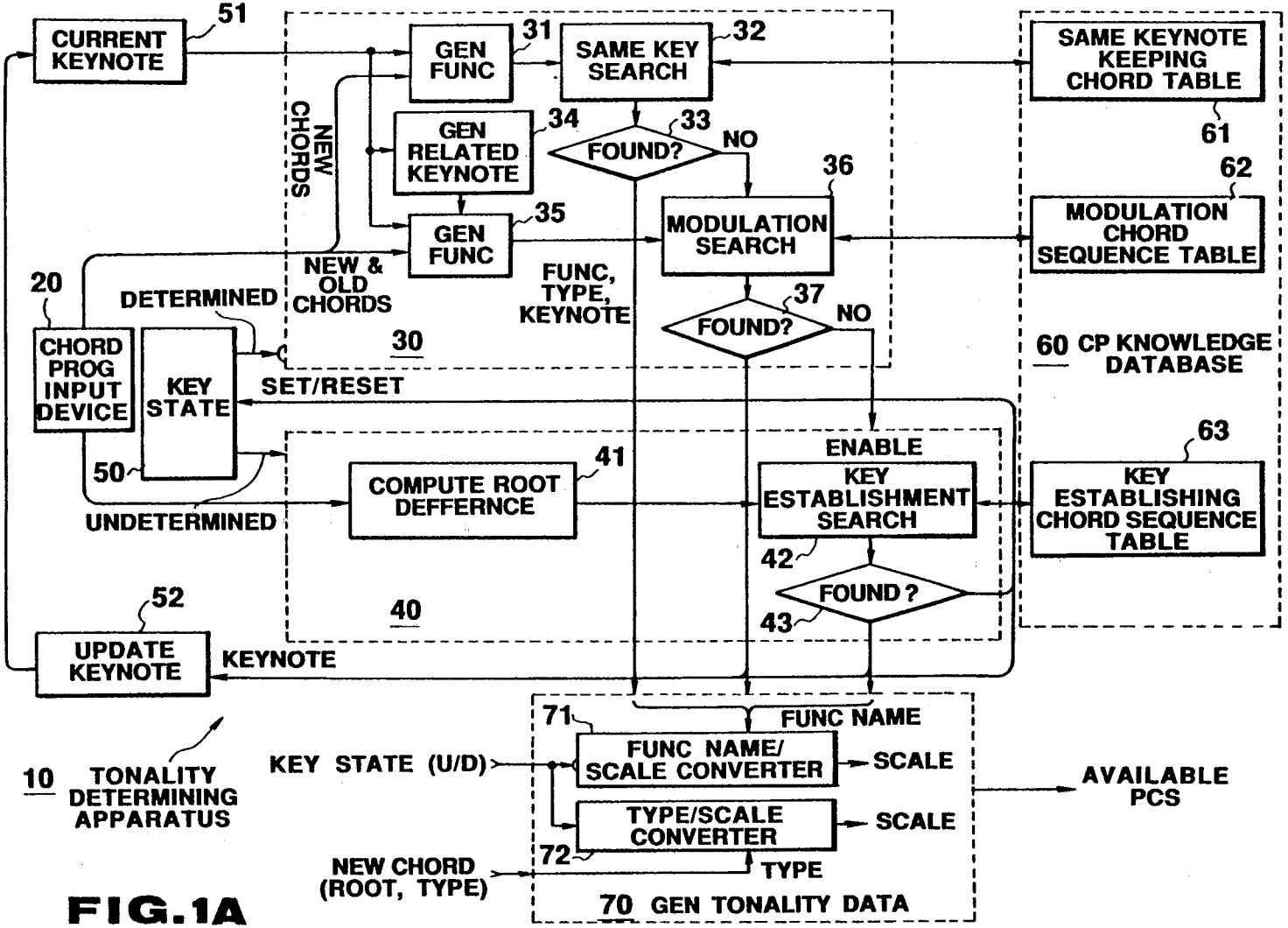
FIG. 1A is a functional block diagram of a tonality determining apparatus in accordance with the first aspect of the invention.

FIG. 1A is a functional block diagram of a tonality determining apparatus which analyzes a chord progression to therefrom extract tonality information in accordance with the first aspect of the invention.

The purpose of the tonality determining apparatus 10 is to produce, from a progression of chords each represented by a root and type, tonality data defining a pitch class set available in respective chord time intervals of the chord progression.

The tonality determining apparatus 10 basically comprises four components, i.e., chord progression input device 20, key and function progression evaluator (including elements 30, 40, 50-52 in FIG. 1A), function knowledge database 60 and tonality data generator 70.

The chord progression input device 20 provides a chord progression in which each chord is represented by a root and a type. The key and function progression extractor extracts, from a chord progression entered from the chord progression input device, a keynote and function of each chord in the chord progression based on musical knowledge stored in the chord progression (CP) knowledge database 60 to thereby produce a progression of keynotes and functions suitable for the chord progression. The tonality data generator 70 receives the progression of keynotes and functions from the key and function progression extractor, and produces tonality data defining a pitch class set available in respective chord time intervals of the chord progression.

In accordance with the first aspect of the invention, the key and function progression extractor comprises first and second key determining modules 30 and 40. The first key determining module 30 determines a keynote and function of a succeeding chord based on a preceding keynote. The second key determining module 40 analyzes an input chord pattern formed by succeeding and preceding chords to thereby determine a keynote and function of the succeeding chord without relying on a preceding keynote. In FIG. 1A, a preceding keynote is termed "current keynote", and a succeeding chord is called "new chord" from the chord progression.

A current keynote memory 51 stores data indicative of the current keynote. Contents of the keynote memory 51 are updated by a keynote updating block 52 each time when the first or second determining module 30, 40 has recognized a new keynote.

The first key determining module 30 is operative when the current keynote has been specified (identified), and determines a keynote and function of a new chord from the chord progression input device 20 by utilizing musical knowledge in the chord progression (CP) knowledge database 60.

The second keynote determining module 40 is operative (a) when the current keynote has been unspecified or indefinite (including the absence of current keynote), or (b) when the first determining module 30 has failed to determine or identify a keynote and function of a new chord). The second determining module 40 then analyzes an input chord pattern formed by the new and its preceding chords entered from the chord progression input device 20 by utilizing musical knowledge in the CP knowledge base 60.

A key state flag 50 is provided to store key state information indicative of whether the current keynote been specified or not (i.e., reserved). Before entering of a chord progression, the key state flag 50 is initialized to a reset condition to indicate absence of current keynote. When the second determining module 40 has identified a current keynote, the key state flag 50 is changed to a set condition to indicate that the current keynote has been specified. Thereafter, when both the first and second determining module have failed to identify a keynote of a new chord, the keynote state flag 50 is changed to the reset condition (key reservation state) to indicate that the current keynote is unidentified.

The first determining module 30 has a key keeping determining feature which tests a new chord based on the musical knowledge stored in the same keynote keeping chord table 61 in CP knowledge database 60 to see whether it keeps the current keynote unchanged. The table memory 61 stores a set of chords each maintaining a keynote. To save storage amount, each chord entry in the same keynote keeping chord table 61 may preferably have a format by which a chord entry is represented by a function name (chord function and type) rather than a combination of keynote, chord root and type. With this function-name format, the same key maintenance determining feature of the first determining module 30 may be realized by a chord function generator 31 and a same key search block 32, as shown in FIG. 1A. The chord function generator 31 generates a new chord function specified (evaluated) by the current keynote stored in the current keynote memory 51. The same key search block 32 searches the same keynote keeping chord table 61 for a chord entry having a new chord function name specified by the function from the chord function generator 31 and the new chord type from the chord progression input device 20. If the search has found a chord entry matching the new chord function name (33), this verifies the new chord function generated by the chord function generator 31 which function has been generated on the assumption that the keynote of the new chord is identical with the current keynote, thus indicating that the current keynote maintains in the new chord time interval. Then, the verified function and keynote of the new chord as well as the type is passed to the tonality data generator 70 which produces tonality data defining a pitch class set available in the new chord time interval.

The first determining module 30 further comprises a modulation detecting means operative when the same keynote keeping chord table 61 does not include a chord entry corresponding to the new chord for examining a possible modulation. The modulation detecting means tests an input chord pattern formed by new and its preceding chords based on the musical knowledge stored in the modulation chord sequence table 62 in the database 60 to see whether the input chord pattern suggests a musical modulation. To this end, the modulation chord sequence table memory 62 stores a set of chord sequences each indicative of a modulation to a related keynote. Each chord sequence entry of the table 62 may have several forms. In one form, each chord sequence entry contains a pivot chord and a post-modulation chord (which succeeds the pivot chord) in which the pivot chord is represented by a function name in a key before the modulation whereas the post-modulation chord is represented by a function name in a key after the modulation. In this case, the modulation detecting means may be realized by relative keynote generator 34, chord function generator 35 and modulation search block 36, as shown in FIG. 1A. The related keynote generator 34 generates a keynote (preferably, plural keynotes) related to the current keynote in the current keynote memory 51. The chord function generator 35 receives the related keynotes and the new chord to generate functions of the new chord evaluated by the respective related keynotes. The function generator 35 further generates a function of the old chord evaluated by the current keynote, and functions of the old chord evaluated by the respective related keynotes. These functions generated in the function generator 35 are supplied to the search block 36 together with data of the new chord type, old chord type, current keynote and related keynotes. Then the search block 36 searches the modulation chord sequence table 62 for an entry matching the supplied chord pattern represented by the old chord type, old chord function specified by the current keynote, old chord functions evaluated by the related keynotes, new chord type, and new chord functions evaluated by the related keynotes. If the modulation chord sequence table 62 includes a chord sequence entry matching the supplied chord pattern with respect to a related keynote (37), then the chord pair or sequence of the old and new chords does indicate a modulation from the current keynote to that related keynote, and the new chord function evaluated by that related keynote is verified. In this case, the related keynote, new chord type and the verified new chord function specified by the related keynote are supplied to the tonality data generator 70 which then produces tonality data defining a pitch class set available in the new chord time interval. In addition, the related keynote is supplied to the keynote updating module 52 which then updates the current keynote memory 51 to the related keynote.

The second key determining module 40 succeeds the task of determining a keynote and function of a new chord when the first module 30 has failed to determine or identify the keynote and function of the new chord (because the same key and modulation search blocks 32 and 36 have not found, in the same keynote keeping chord table 61 and the modulation chord sequence table 62, an entry matching the supplied data). The second determining module 40 also handles the task of key and function determination of a new chord when the current keynote has not been identified.

The second determining module 40 analyzes an input chord pattern formed by new and its preceding chords entered from the chord progression input device 20 based on the musical knowledge stored in the key establishing chord sequence table 63 in CP knowledge database 60 to thereby determine, without relying on the current keynote information, as to whether the input chord pattern has established a specific key. To this end, the key establishing chord sequence table 63 stores a set of chord sequences (key establishing chord sequences) each establishing a key or keynote. Each chord sequence entry in the establishing table 63 may have the form as follows. The last chord of each key establishing chord sequence is represented by a function name (function and type) evaluated by the keynote established by the chord sequence. Each preceding chord is represented by its type and root difference from the immediately succeeding chord. If the key establishing chord sequence table 63 has such representation, the second determining module 40 may be realized by a root difference computing block 41 and a key establishment search block 42, as shown in FIG. 1A. The computing block 41 computes root differences in the input chord pattern to be analyzed (i.e., each root difference between adjacent chords in the chord pattern formed by new chord and its preceding at least one chord). Now the chord pattern to be analyzed is represented in a new form by a type pattern and a root difference pattern. The key establishment search block 42 then searches the key establishing chord sequence table 63 for an entry matching (the new representation of) the input chord pattern under test. If the table 63 includes such entry (43) this verifies that the input chord pattern (ending with the new chord) establishes a keynote. The established keynote is specified from the last chord function contained in the matching entry of chord sequence, and the new chord root supplied from the chord progression input device 20. That is, the established keynote is computed by adding the last chord function (scale degree of root from keynote) to the new chord root.

The success of the key establishment search block 42 (meaning that the function and keynote of the new chord has been specifically identified) causes the second determining module 40 to set the key state flag 50, thus indicating that a new key has been established. The second determining module 40 also causes the keynote updating module 52 to update the current keynote memory 51 to the newly established key. The function and keynote of the new chord determined by the second determining module 40 as well as the new chord type are passed to the tonality data generator 70 which then produces a pitch class set available in the music time interval of the new chord.

On the other hand, the failure of the key establishment search block 42 (meaning the failure of identifying the function and keynote of the new chord) causes the second determining module 40 to reset the key state flag 50, thus indicating that the key has become indefinite. In this case, the tonality data generator 70 produces tonality data defining a pitch class set available in the new chord time interval in the manner to be described.

In accordance with a feature of the invention, the tonality data generator 70 operates differently, depending on whether the new chord function has been successfully identified or not. Specifically, it produces tonality data (defining a pitch class set available in the time interval of a new chord) in a first manner based on narrow interpretation of tonality when the new chord has been successfully analyzed by the key determining module 30 or 40 for its function and keynote. On the other hand, for a new chord whose function and keynote have not been specified by the determining module 30 or 40, the tonality data generator 70 produces tonality data in a second manner (different from the first manner) based on broader interpretation of tonality.

The tonality data generator 70 checks the key state flag 50 to see whether the key and function determining means (including modules 30 and 40) has successfully determined or specified the keynote and function of a new chord. If the flag 50 is in the set state, this indicates that the function and keynote have been specifically determined. If the flag 50 is in the reset state, this indicates undetermined (unspecified) function and keynote. In the reset or reserved key state, the tonality data generator 70 uses the new chord function and keynote specified by the determining module 30 or 40 and the new chord type from the chord progression input device 20 to thereby specify a pitch class set available in the new chord time interval. In the alternative, any equivalent to the combination of new chord function, keynote and type (e.g., new chord root, function and type) may be used to specify the available pitch class set. In general, the tonality data generator 70 can specify the available pitch class set from the combination of any two of the three factors, i.e., new chord function, root and keynote with the new chord type. The pitch class set produced in this manner is suitable for the combination so that a melody or accompaniment using such pitch class set suggests a specific and definite tonality. To obtain such pitch class set, the tonality data generator 70 preferably includes a function name/scale converter table 71 which converts a supplied function name (chord function and type) to a scale suitable therefor. The combination of the converted scale with a supplied keynote defines an available pitch class set (in the case when the first or starting note of each scale in the converter table 71 is represented or defined by a pitch interval from a keynote). In the alternative, a supplied chord root combined with the converted scale specifies such an available pitch class set (in the case the starting note of each scale in the table 71 is defined as equivalent to a chord root).

On the other hand, if the key state flag 50 is in the reset or "key reservation" state, indicative of the failure by either module 30, 40 of specifying a function and keynote of a new chord, the tonality data generator 70 specifies a pitch class set available in the new chord time interval from the new chord type and root based on broader interpretation of tonality which contemplates an unspecified new chord function, or a plurality of functions, one of which the new chord might possibly have. The pitch class set obtained in this manner allows a plurality of possible tonalities when applied to a melody or accompaniment. Normally, this pitch class set constitutes a part of a pitch class set obtained when the new chord function has been specifically identified. For preference, the available pitch class set in the failure of the new chord function identification may be defined by pitch classes common to all possible functions which the new chord might have. This is called common PC method.

FIG. 1F illustrates the common PC method. According to the common PC method, a plurality of possible functions of a chord are derived from type information of the chord. For these possible function, the method determines pitch class sets each for different ones of the possible functions. Then, the method obtains pitch classes common to these pitch class sets. The common pitch classes thus obtained specify a pitch class set available in the music time interval of the chord having the unidentified function.

By way of example, let us take up a chord whose root is C and whose type is major. The type "major" suggests three possible functions of the chord, i.e., 1, IV and V. An available pitch class set (PCS) for the chord C major with I function is C, D, E, F, G, A and B. If the chord has V function, an available pitch class set is given by C, D, E, F♯, G, A and B. In the case of IV function, an available pitch class set is constituted by C, D, E, F, G, A and B♭. The common pitch classes to these available PCSs are C, D, E, G and A. The common pitch classes of C, D, E, G and A define a pitch class set available in the time of chord C major whose function has not been identified. Since the pitch class set (C, D, E, F, G) is constituted by those pitch classes common to the three pitch class sets each for I, IV or V function possibility and each clarifying a specific tonality, it suggests a broad tonality allowing three possible keys of C, G and F. To state it another way, if a melody or accompaniment, is formed by using the common pitch class set (C, D, E, G, A) in the musical time of chord C major having an unidentified function, it will not damage or weaken the surrounding (preceding or succeeding) key even if it is C, G or F. The surrounding key is suggested by a surrounding music which may use PCS (C, D, E, F, G, A, B) for key C, PCS (C, D, E, F♯, G A, B) for key G or PCS (C, D, E, F, G, A B♭) for key F. For example, if a succeeding melody or accompaniment is formed by using PCS (C, D, E, F, G, A, B), a listener will clearly recognize key C at the time when it is played. He or she does mistakingly feel a sense of modulation as the music goes from the preceding melody in the time of the function-unidentified chord C major to the succeeding melody, since the preceding melody does not contain a pitch class or pitch classes weakening or damaging key C which is subsequently suggested by or recognized from the succeeding melody.

Since it takes broad tonality interpretation based on chord type and root for the determination of a pitch class set available at the time of a function-unidentified chord, the present tonality determining apparatus can provide a desired progression of tonalities (PCSS) free of defects or spurious modulations in the tonality stream of music.

In contrast, the prior art tonality apparatus forcely or wrongly specifies a function of a chord without musical grounds (or automatically chooses one of possible plural functions of the chord) even if the musical situation makes it difficult to identify the function of the chord of interest. This will often result in a progression of tonalities (PCSS) having defects or wrong modulations.

Turning back to FIG. 1A, the tonality data generator 70 includes a type/scale converter table memory 72 which converts a supplied chord type to a scale for the generation of an available pitch class set at the time of a chord with an unidentified function. Such pitch class set may be directly obtained by a root and type/PCS converter memory which converts the combination of a supplied chord root and type to a pitch class set, though it requires a relatively large amount of storage. The root and type/PCS converter table may be implemented by a look-up table memory which returns common pitch classes such as those shown in FIG. 1F when looked up by a root and type combination input. The type/scale converter 72 may be implemented by a look-up table memory which, when looked up (addressed) by a type, returns a scale represented in a pitch intervallic structure in which the starting note of the scale is equivalent to a chord root. For example, a scale for chord type "major" is represented by pitch intervallic structure data (0, 2, 4, 7, 9) in which "0" indicates the scale starting note having the same pitch class as that of a chord root, "2" indicates the second note of the scale having a pitch interval of two semitones from the scale starting note, and so on. Let pitch classes C to B be "0" to "11", respectively, and let a supplied chord be C major with an unidentified function. The root data of the C major chord is given by "0" since the root pitch class is "C". Adding the C pitch class root data "0" to the pitch intervallic structure data (0, 2, 4, 7, 9), indicative of the scale for chord type "major" and returned from the type/scale converter memory 72 results in pitch class set data (0, 2, 4, 7, 9) indicative of a pitch class set available at the time of the C major chord having an unidentified function.

In summary, the tonality determining apparatus 10 of FIG. 1A has the following advantages and features:

(A) Unlike the prior art, the present tonality determining apparatus includes both of a first tonality determining feature (30, 61, 62, 70) which determines tonality of a succeeding chord by utilizing a preceding key, and a second tonality determining feature (40, 63, 70) which determines tonality of a succeeding chord without relying on a preceding key.

(B) The first and second tonality determining features compensate for each other's loss or defect. In a musical situation in which a key of a succeeding chord is easily identifiable from its preceding key, the first tonality determining function takes advantage over the second one in the correct identification of the succeeding tonality. On the other hand, if the musical situation of interest makes difficult to derive a succeeding key from a preceding key, then the second tonality determining function will solve the problem (identification of the succeeding tonality) better than the first one. Thus, the present tonality determining apparatus, which combines the first with the second tonality determining function, provides an improved capability of tonality determination over the prior art.

(C) The present apparatus handles both an easy situation in which a tonality is identifiable and a worse situation in which a specific tonality cannot be identified (50), in view of the fact of music that a chord progression can contain a chord whose function is unidentifiable.

(D) For a chord whose function has been identified (by the determining blocks 30, 40), the apparatus takes a narrow interpretation of tonality (71) whereas it takes a broader interpretation of tonality for a chord with an unidentified function. This provides a progression of tonalities with a more natural stream.

(E) Specifically, for a function-identified chord the present tonality determining apparatus uses the combination of the chord type with the chord root and identified function, or its equivalent to determine a pitch class set available at the chord time. For a chord whose function has not been identified, the apparatus uses the chord type and root in view of all possible functions of the chord to thereby determine a pitch class set available at the chord time.

The present tonality determining apparatus provides, when combined with a suitable accompaniment forming apparatus, a desired automatic accompaniment apparatus which plays an accompaniment with a very natural tonal stream.

The accompaniment forming apparatus which forms an accompaniment by utilizing the tonality determining apparatus such as shown in FIG. 1A may take several forms.

Figure 1B:
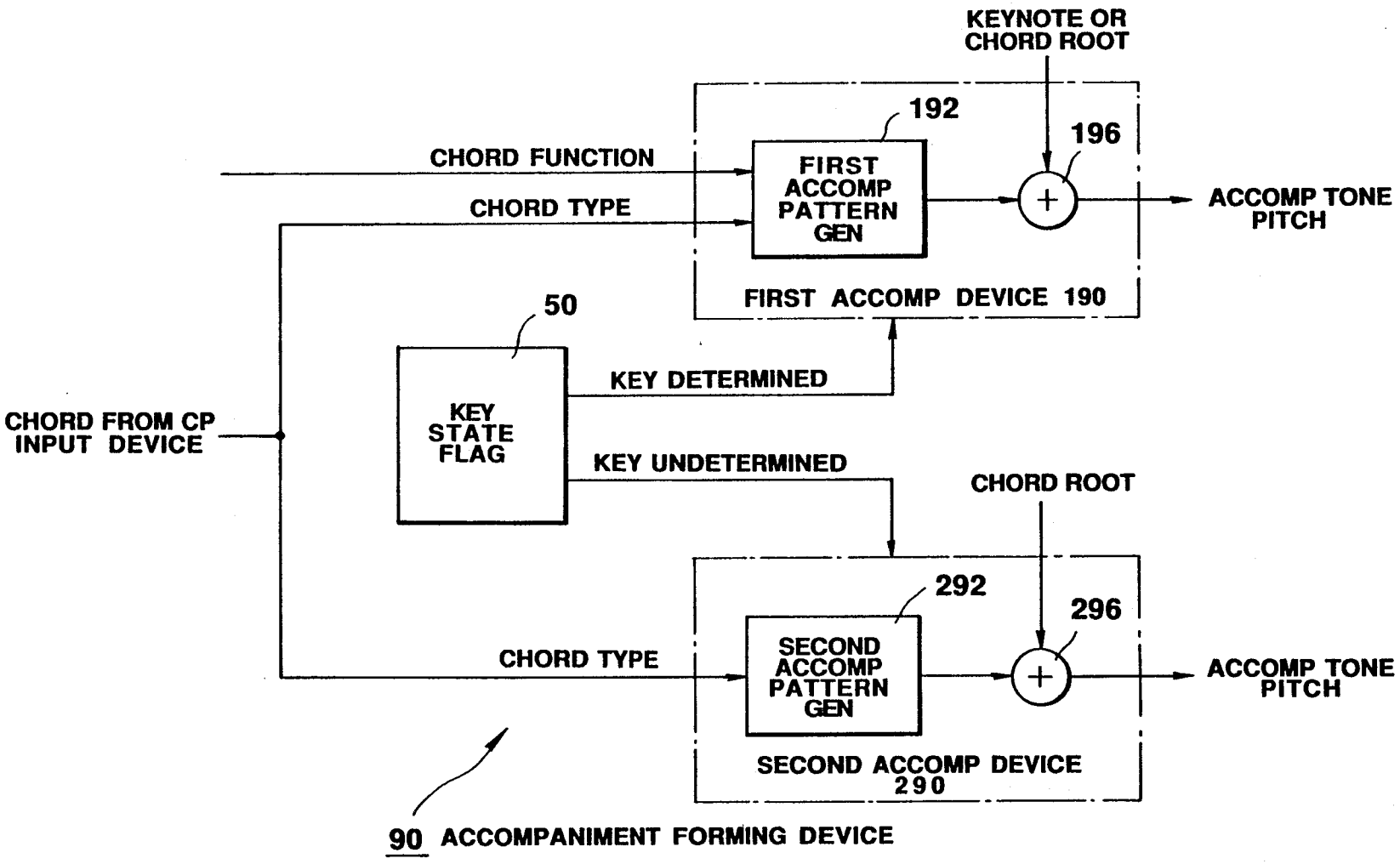
FIG. 1B is a functional block diagram of an accompaniment forming device based on the analysis results from a tonality determining apparatus such as the one shown in FIG. 1A in accordance with the second aspect of the invention.

FIG. 1B shows a basic arrangement of such accompaniment forming apparatus in a functional block diagram. The accompaniment forming apparatus 90 comprises a first accompaniment forming device 190 which forms an accompaniment in the time interval of those chords (in a chord progression) with their function having been identified, and a second accompaniment forming device 290 which forms an accompaniment in the time interval of those chord whose function has not been specified. To this end, the first accompaniment device 190 is operative when the key state flag 50 (which is provided in the tonality determining apparatus, as shown in FIG. 1A, but is also shown in FIG. 1B for convenience) is in the set or "key determined" condition, and it forms an accompaniment in the time of a function-identified chord based on the combination of chord function, type and keynote. Such chord function and keynote information is supplied from the determining module 30 or 40 in FIG. 1A that has succeeded in its identification. The chord type information is supplied from the chord progression input device 20. In place of the chord function, type and keynote combination, the first accompaniment device 190 may receive any combination equivalent thereto (e.g., function, type and root combination), or it may receive a pitch class set available in the time interval of a function-identified chord and supplied from the tonality data generator 70. In either case, the first accompaniment device 190 forms an accompaniment in the musical time of a chord with an identified function such that the formed accompaniment is constituted by those pitches included in the pitch class set available in the musical time with an identified chord function. Thus , the first accompaniment device 190, which receives a chord function, type and keynote combination or its equivalent, explicitly or implicity includes therein tonality pitch class set means that corresponds to part of the tonality data generator 70 and defines a pitch class set available in the time interval of a chord with its function having been identified. For example, the first accompaniment device 190 may have a memory storing, for different one of the combinations of chord function, type and keynote, data of an accompaniment constituted by tones selected from an available pitch class set, and selecting means responsive to a particular combination externally supplied for selecting and outputting a stored accompaniment corresponding to the supplied combination. In this case, the memory and the selecting means realize the tonality pitch class set means. The memory may be modified such that it stores accompaniment data grouped by musical styles as well as combinations of chord function, keynote and type, thus realizing a modified pitch class set means for defining an available pitch class set of tonality in accordance with a chord function, type and keynote combination and in accordance with a musical style.

The first accompaniment device 190 comprises a first accompaniment pattern generator 192 which generates an accompaniment pattern suitable for a supplied chord function and type. The device 190 further includes an adder (pitch generator) 196 which adds pitch data contained in the accompaniment pattern from the first accompaniment pattern generator 192 to a supplied keynote or chord root, to thereby form a pitch of an accompaniment tone to be actually played. If the pitch data contained in the stored accompaniment pattern is represented by a pitch interval from a keynote, it is added to pitch class data of the supplied keynote (rather than chord root) to form an actual accompaniment pitch. If the pitch data from the generator 192 is represented by a pitch interval from a chord root, an actual accompaniment pitch is formed by adding the pitch data to the supplied chord root (rather than keynote). In a contrary or complement, the second accompaniment device 290 operates when the key state flag is in the "key reservation" condition i.e., when the function of a chord has not been identified, and it forms an accompaniment in the musical time of a function-unidentified chord based on the received chord type and root. The second accompaniment device 290 may be modified such that it receives, from the tonality data generator 70, a pitch class set available in the time of the function-unidentified chord in place of the type and root combination. The second accompaniment device 290, arranged to receive the chord type and root, thus includes a pitch class set means which corresponds to part of the tonality data generator 70 and defines or derives a pitch class set available in the musical time of a function-unidentified chord from its type and root in accordance with broader tonality interpretation.

The second accompaniment device 290 comprises a second accompaniment pattern generator 292 which generates an accompaniment pattern suitable for a supplied chord type (with an unidentified function). The second accompaniment device 290 further includes an adder 296 which adds pitch data (represented by a pitch interval from a chord root) contained in the generated accompaniment pattern to a supplied chord root, thus forming an actual accompaniment pitch.

Figure 1C:
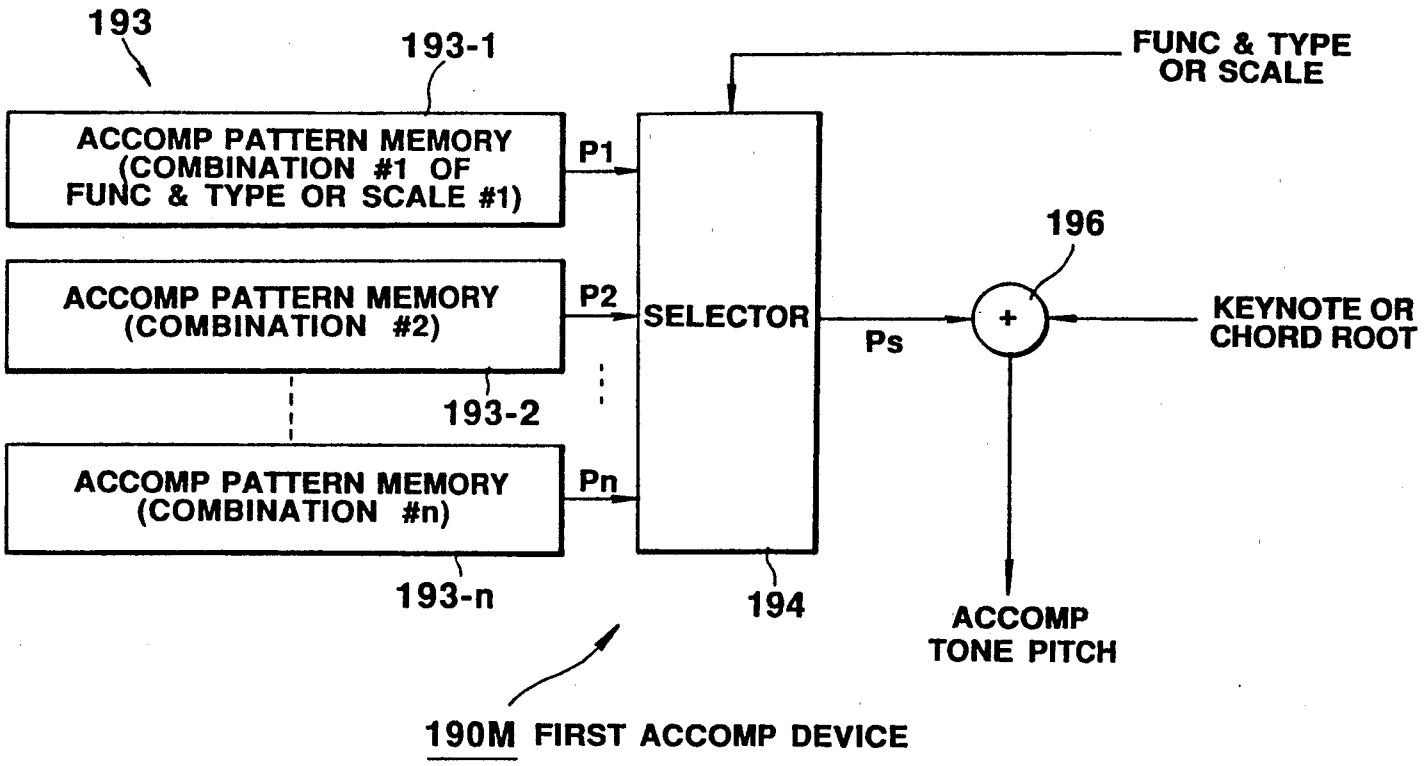
FIG. 1C is a functional block diagram showing an arrangement of the first accompaniment device in FIG. 1B.

FIG. 1C is a functional block diagram of the first accompaniment device, designated here 190M, showing an exemplary arrangement of the first accompaniment pattern generator 192.

Figure 1D:
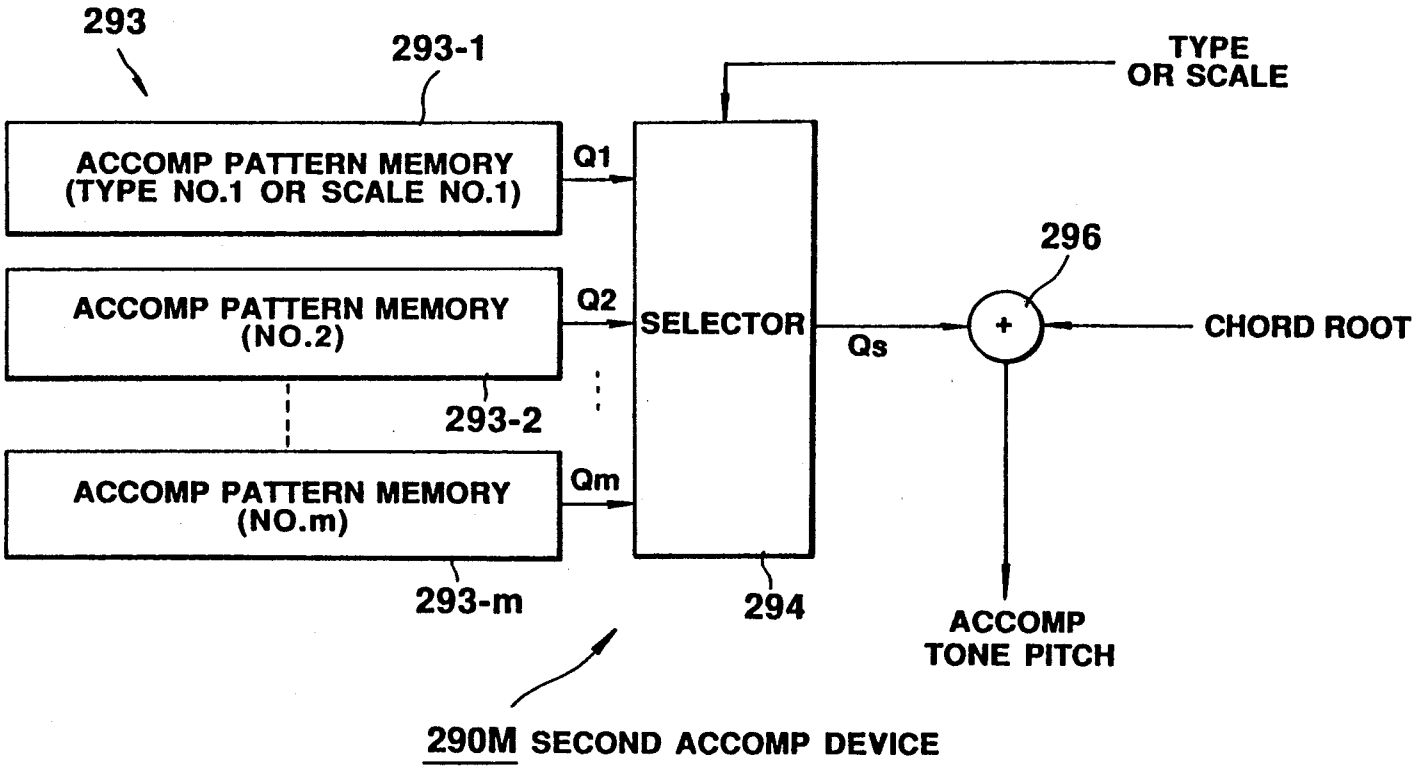
FIG. 1D is a functional block diagram showing an arrangement of the second accompaniment device in FIG. 1B.

FIG. 1D is a block diagram of the second accompaniment device, here designated 290M, showing an exemplary arrangement of the second accompaniment pattern generator 292.

In FIG. 1C, the first accompaniment device 190M comprises a plurality of accompaniment pattern memories, designated collectively by 193 and individually by 193-1 to **193-*n*, each storing an accompaniment pattern having suitable pitch contents for different ones of the combinations of chord function and type, or the scales. For example, the first accompaniment pattern memory 193-1 stores an accompaniment pattern suitable for chord function "I" and type "major", or scale "ionian." The accompaniment device 190M further comprises a selector 194. The selector 194 selects, among from the plurality of accompaniment pattern memories 193-1 to 193-*n*, an accompaniment pattern suitable for and corresponding to a supplied chord function and type, or scale. In FIG. 1C, P1 to Pn denote pitch data contained in the respective accompaniment patterns while Ps denotes selected pitch data contained in the selected accompaniment pattern. The adder 196** adds the pitch data Ps to supplied keynote or chord root data (represented by pitch class), thus outputting a final accompaniment pitch to be actually performed.

The plurality of the accompaniment pattern memories 193 and the selector 194 thus realize the first accompaniment pattern generator 192 in FIG. 1B.

With the arrangement 190M of FIG. 1C, the plurality of accompaniment patterns in the memories 193-1 to **193-*n* can be made independent from one another, and hence their rhythms (accompaniment tone durational sequences) can also be made different from one another. In other words, the first accompaniment device 190M of FIG. 1C** can make an accompaniment with a rhythm varying with scales, or chord function and type combinations so that chord changes in the chord progression input result in rhythm changes in the played accompaniment.

In a similar manner, the second accompaniment device 290M (FIG. 1D) comprises a plurality of accompaniment pattern memories, designated collectively by 293 and individually by 293-1 to **293-*m*, and a selector 294. These components realize the second accompaniment generator 292 discussed in connection with FIG. 1B. Each accompaniment pattern in the memories 293-1 to 293-*m* has, however, pitch contents suitable for different ones of the chord types or scales converted therefrom, rather than the chord function and type combinations. The selector 294 selects, among from the memories 293-1 to 293-*m*, an accompaniment pattern suitable for and corresponding to a chord type supplied from the chord progression input device 20 (or a converted scale from the type/scale converter table 72**).

Figure 1E:
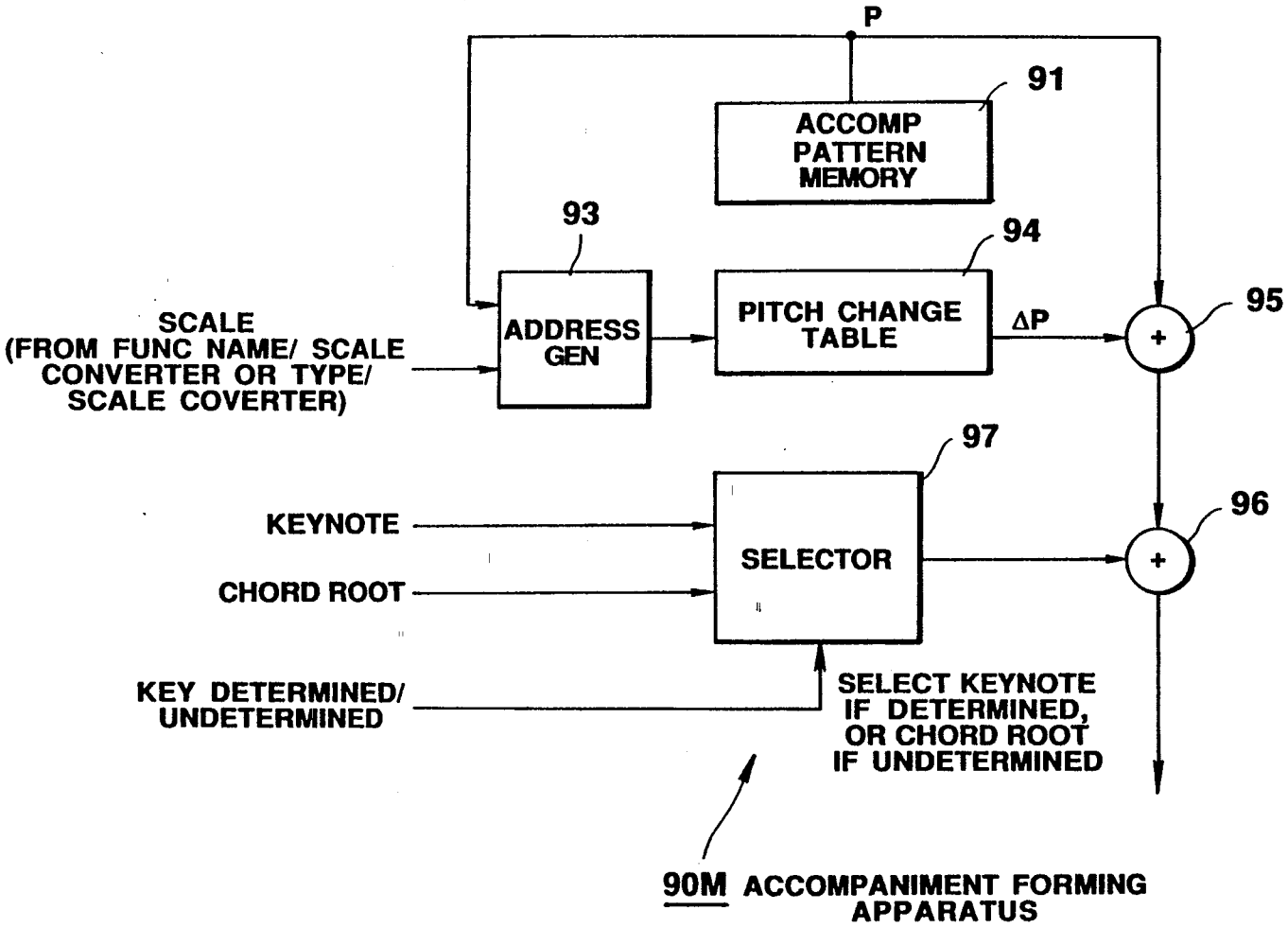
FIG. 1E is a functional block diagram of a modified accompaniment forming apparatus responsive to the tonality determining apparatus in accordance with the second aspect of the invention.

FIG. 1E shows a modified arrangement of the accompaniment forming apparatus, designated 90M. The arrangement of FIG. 1E comprises an accompaniment pattern memory 91 which stores a plurality of reference accompaniment patterns (for a reference tonality) grouped by musical styles. With a selected musical style (not shown), a corresponding reference accompaniment pattern is repeatedly read by suitable reading means (not shown). A reference pitch in the read-out accompaniment pattern is denoted by P. The accompaniment forming apparatus 90M further comprises a pitch change table memory 94. Each table element in the pitch change table 94 stores pitch difference data $\Delta P$ for modifying the pitch data P from the accompaniment pattern memory 91. A combination of a scale and a pitch data item P to be modified serves to specify a table element in the pitch change table memory 94. To this end, a scale from the tonality data generator 70 and a reference pitch P from the accompaniment pattern memory 91 are supplied to an address generator 93 which generates an address specifying a table element in the pitch change table memory 94. Here, the scale is meant by a function-based one supplied from the function name/scale converter table 71 when the chord has been identified with respect to function whereas, for a function-unidentified chord, it is a type-based scale supplied from the type/scale converter table 72. Thus, in place of the scale the address generator 93 may receive a chord function and type for a function-identified chord, or a chord type only for a function-unidentified chord. The pitch difference ΔP stored in the addressed table element is read out and added by an adder 95 to the reference pitch P from the accompaniment pattern memory 91. The modified pitch data from the adder 95 indicates a pitch (represented by, for example a pitch interval from a keynote) suitable for a function-based scale when the chord has been identified for function. When the chord function has not been identified, the adder 95 output indicates a pitch (represented by a pitch interval from a chord root). The adder 95 output is further combined by a second adder 96 with selected data from a selector 97, thus defining an accompaniment tone pitch to be actually performed. The selector 97 selects a keynote from the current keynote memory 52 when the current keynote has been identified, or selects a chord root from the chord progression input device 20 when the current keynote has not been identified. If a modified pitch change table 94 outputs pitch data indicative of a pitch interval from a chord root (rather than keynote) in both cases of key determined (identified) and undetermined, the selector 91 may be omitted by directly adding the chord root to the adder 95 output irrespective of the key state.

In this manner, the accompaniment forming apparatus 90M of FIG. 1E achieves the functions of the first and second accompaniment devices 190 and 290 discussed in connection with FIG. 1B.

Further, the arrangement of FIG. 1E has the advantage of minimizing the storage capacity required for accompaniment over that of FIG. 1B. A first specific embodiment of the invention will now be described in detail with reference to FIGS. 2–33.

Figure 2:
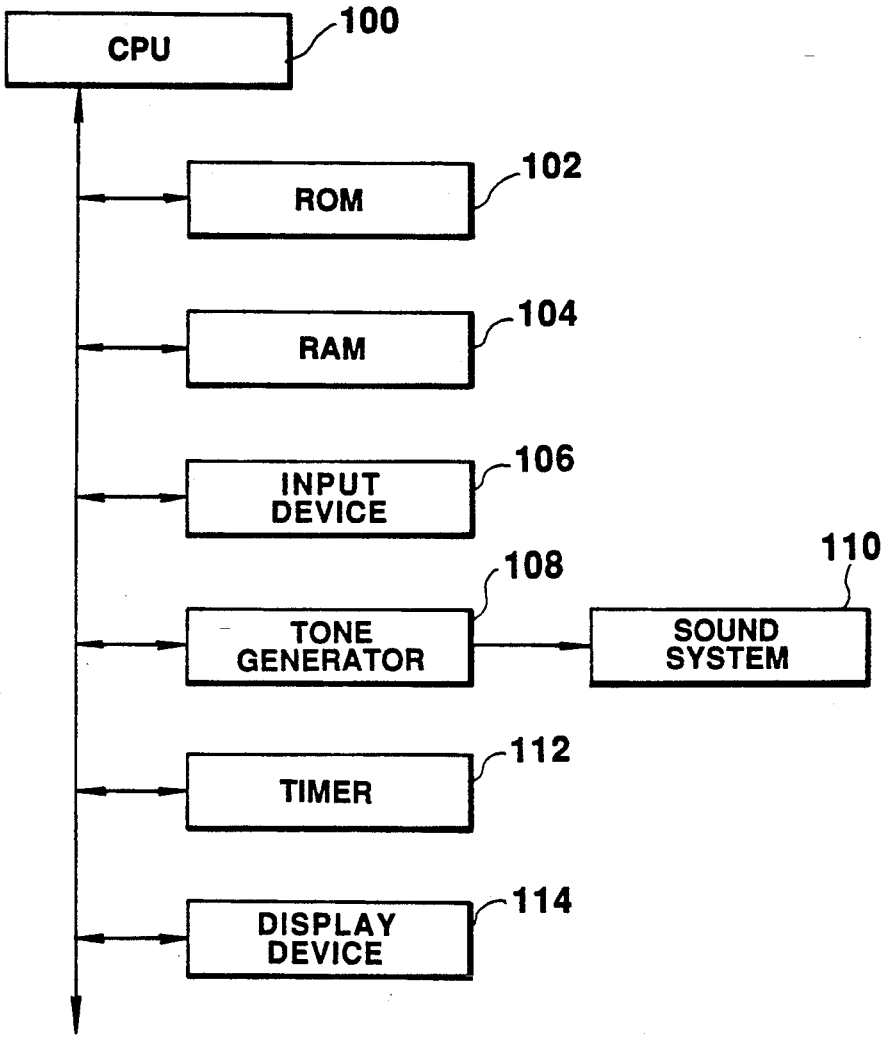
FIG. 2 is a block diagram showing a representative hardware organization of an automatic accompaniment apparatus into which specific embodiments of the invention may be incorporated.

FIG. 2 is a block diagram showing a representative hardware organization of an automatic accompaniment performing apparatus. The first specific embodiment is implemented on this hardware organization. The same organization (which is essentially a microcomputer-based system) may also apply to other specific embodiments of the invention as will be described later in the specification.

In FIG. 2, CPU 100 controls the entire system of the accompaniment apparatus. ROM 102 stores programs to be executed by CPU 100 and also stores permanent data including a chord progression knowledge database accompaniment pattern data and pitch change table. RAM 104 serves as a working memory under the control of CPU 100. An input device 106 includes a musical keyboard for inputting melodies and chords. A tone generator 108 synthesizes a tone signal under the control of CPU 100. A sound system 110 receives the tone signal to reproduce and emit a corresponding sound. A timer 112 measures an elapse of a predetermined time to periodically generate a timer interrupt request signal by which a timer interrupt routine (FIG. 4) is activated. A display device 114 displays data and messages such as chord progression, function progression, keynote progression and tonality (available pitch class set) progression.

Figure 3:
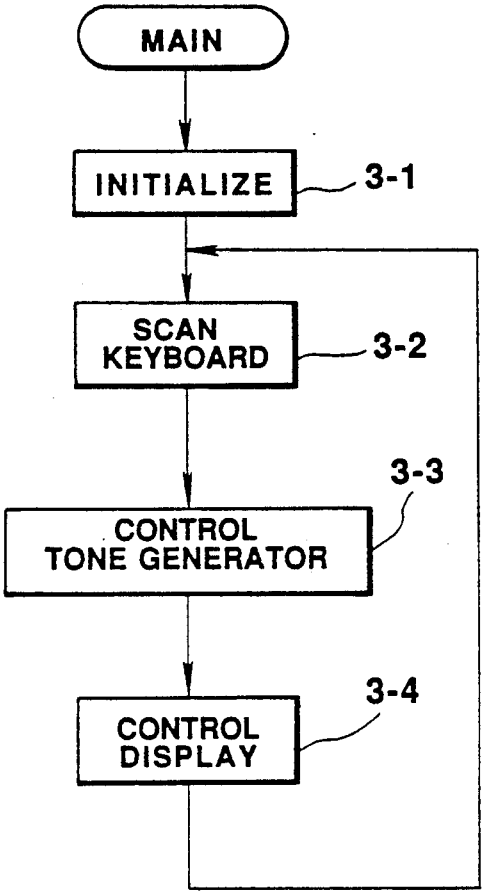
FIG. 3 is a flow chart of a main program executed by CPU 100 in FIG. 2 in accordance with the first embodiment.

FIG. 3 is a flow chart of the main program executed by CPU 100 in accordance with the first specific embodiment. Upon power-on, CPU 100 initializes the tonality determining system (3-1). The initialization process 3-1 comprises initializing variables in FIGS. 6A and 6C to predetermined values. At 3-2, CPU 100 scans the input device 106 in a conventional manner. At 3—3, CPU 100 controls the tone generator 108 based on melody key data entered from a melody section of the musical keyboard to produce a melody tone. At 3-4, CPU 100 controls the display device 114 to display analiyed results of an input chord progression (e.g., a progression of available pitch classes). For example, the display device 3-4 displays a currently available pitch class set in a "navigator" fashion by turning on display elements (e.g., LED lamps) disposed in correspondence to musical keys of those pitch classes in the keyboard. This will facilitate a performer's improvization.

Figure 4:
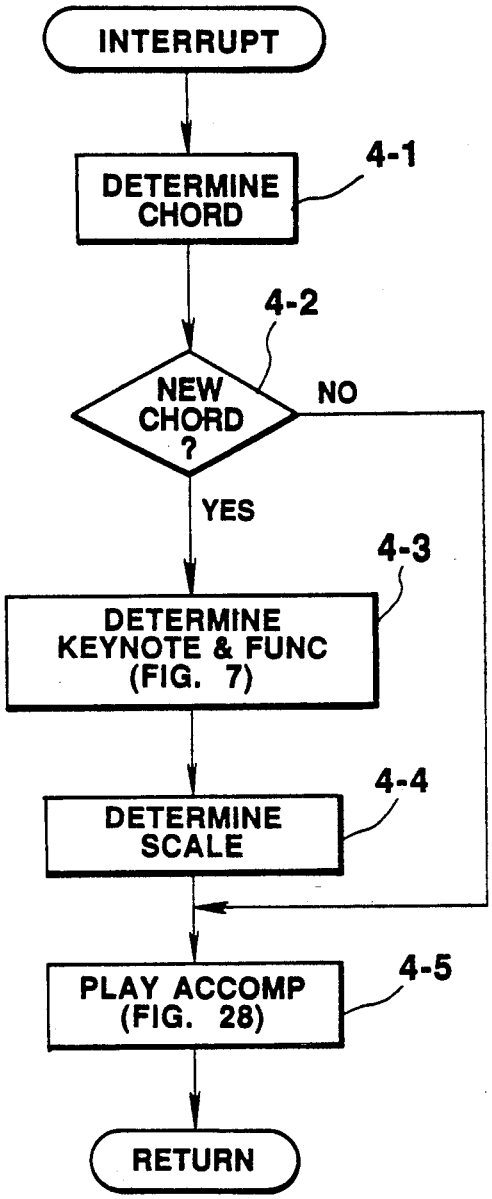
FIG. 4 is a flow chart of a time interrupt routine executed by CPU 100 in FIG. 2 in accordance with the first embodiment.

FIG. 4 shows a timer interrupt routine of the first specific embodiment. The interrupt routine is regularly executed by CPU 100 each time the timer 112 has been timed out. At 4-1, CPU 100 examines accompaniment key data (received by the scan keys routine 3-2) to recognize a type and root of a new chord designated from the keyboard in a conventional manner. When a new chord has been detected (4-2), CPU 100 calls DETERMINE KEYNOTE & FUNC routine 4-3 to determine a function and keynote of that new chord. Then, CPU 100 calls DETERMINE SCALE routine 4—4 to produce tonality data defining a pitch class set available in the time interval of the new chord. Finally, CPU 100 calls PLAY ACCOMP routine 4-5 to play an accompaniment by forming accompaniment data in accordance with the tonality data and controlling the tone generator 108 to produce an accompaniment tone.

FIG. 5 partly illustrates a chord member table CKT residing in ROM 102. The chord member table CKT stores a set of chord members for each chord type. A chord root is represented by member data of "0". A chord member other than a chord root is represented by its pitch interval from the chord root. "1" indicates a pitch interval of half tone (minor second), "2" indicates a whole tone (major second) and so on until "11" indicates a pitch interval of major seventh. Data of "15" indicates a dummy and is used for a trial chord having three members because the table CKT uniformly assigns four contiguous memory locations to every chord. The chord member table CKT is referenced by the DETERMINE CHORD routine 4-1 to identify a type of a chord designated from the keyboard.

Figure 6C:
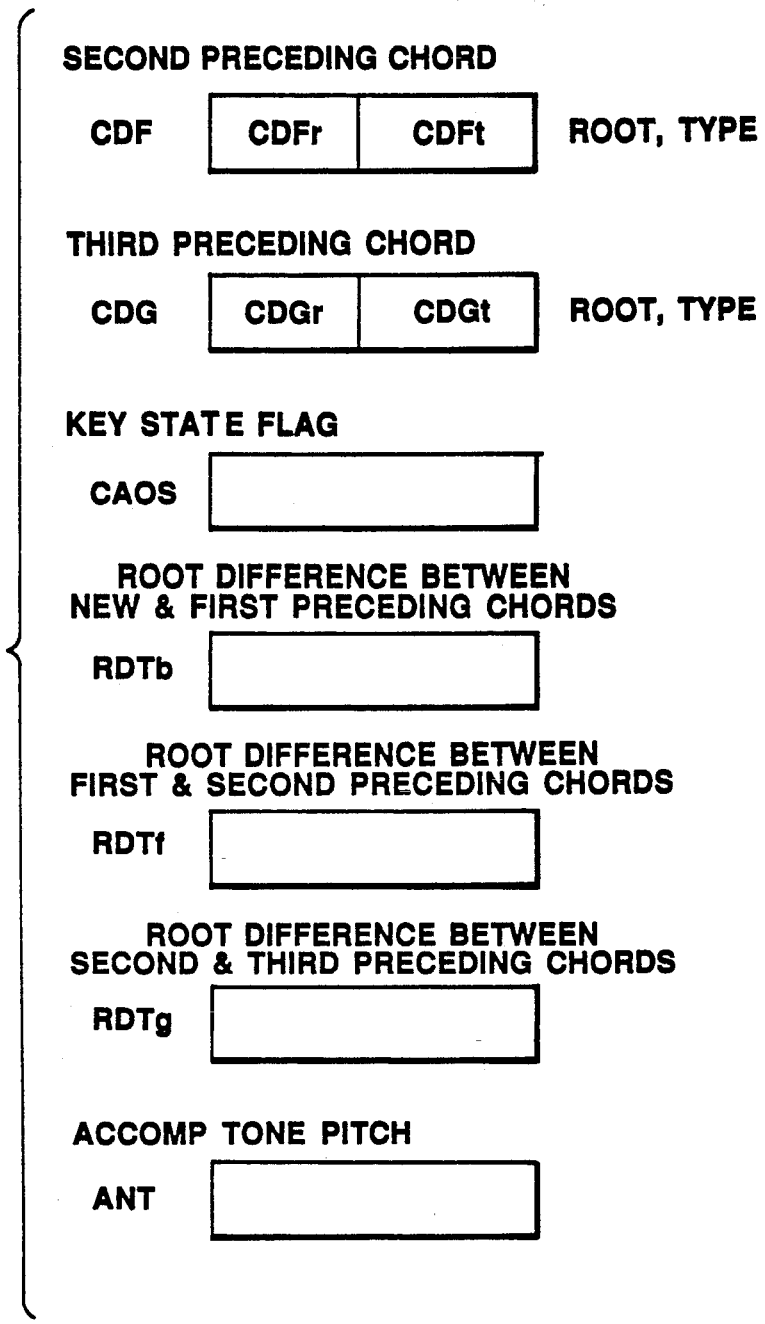

FIGS. 6A–6C depict variables placed in RAM 104 for the implementation of the first specific embodiment. A variable (register) CDN indicates a new chord obtained in the determine chord routine 4-1. CDN comprises a root part $CDN_r$ indicative of a new chord root (pitch class), and a type part $CDN_t$ indicative of a new chord type. For example, a new chord of C major is represented by $CDN_r=0$, and $CDN_t=0$. Variable (register) CDB indicates an old chord immediately preceding the new chord in CDN. CDN comprises a root part $CDB_r$ indicative of an old chord root, and a type part $CDB_t$ indicative of an old chord type. Variable (register) FDN stores a function name (functional representation) of the new chord. FDN comprises a function or degree part $FDN_d$ indicative of a new chord function (scale degree) specified by a current keynote, and a type part $FDN_t$ indicative of the new chord type (same as $CDN_t$). For example, a function name of II major is represented by $FDN_d=2$, and $FDN_t=0$. Variable (register) FDB indicates a function name of the old chord. FDB comprises a function (degree) part $FDB_d$ indicative of an old chord function specified by the current keynote, and a type part $FDB_t$ indicative of the old chord type (same as $CDB_t$). Variable (register) TDN indicates a current tonality when the current keynote has been identified. TDN comprises a keynote part $TDN_k$ indicative of the current keynote, and a scale part $TDN_s$ indicative of a current scale. The combination of $TDN_k$ and $TDN_s$ defines a currently available pitch class set for a function-identified chord. For example, a tonality of C ionian having a pitch class set of C, D, E, F, G, A and B is represented by $TDN_k=0$, and $TDN_s=0$. For a function-unidentified chord, the available pitch class set is defined by $CDN_r$ and $TDN_s$. Variable (table) TDK stores a plurality of, here, four related tonalities to the current tonality. Each tonality data TDK[i] in the table TDK comprises a keynote part $TDK_k[i]$ indicative of a keynote, and a scale part $TDK_s[i]$ indicative of a scale. The keynote part of the first tonality data TDK[0] stored at the first address of table TDK represents a dominant keynote to the current keynote. Similarly, keynote parts of TDK[1], TDK[2] and TDK[3] store a subdominant keynote, a dominant of dominant keynote, and a subdominant of subdominant keynote, respectively, in relation to the current keynote. Variable (table) FDK stores function names of the old and new chords, evaluated by the respective related keynotes $TDK_k[i]$. Each function name FDK[i] comprises a function (degree) part $FDK_d[i]$ indicative of a chord function scale degree, and a type part $FDK_t[i]$ indicative of a chord type. Even addresses of the table FDK store new chord function names evaluated by the respective related keynotes while odd addresses store old chord function names evaluated by the related keynotes. Specifically, data FDK[0] stored at address 0 of the table FDK comprises a new chord scale degree evaluated by the dominant keynote to the current keynote, and the new chord type. Data FDK[1] at address 1 indicates an old chord function name in the dominant key. Similarly, FDK[2] and FDK[3] respectively indicate a new chord function name and an old chord function name, each evaluated by the subdominant key. FDK[4] and FDK[5] respectively indicate a new chord function name and an old chord function name, each evaluated by the dominant of dominant keynote. FDK[6] and FDK[7] respectively indicate a new chord function name and an old chord function name, each evaluated by the subdominant of subdominant keynote. Address i in the related tonality table TDK, which specifies a related key, corresponds to FDK table's addresses $2i$ (for the new chord) and $2i+1$ (for the old chord). Variable i is used as a pointer to an element in various tables. Variable (register) CDF indicates a second preceding chord (to the new chord CDN). CDF has a root part $CDF_r$ and a type part $CDF_t$. Variable (register) CDG indicates a third preceding chord (to CDN). CDG comprises a root part $CDG_r$ and a type part $CDG_t$. Key state flag CAOS indicates whether the key (and therefore chord function) has been identified. Prior to a chord progression input, the flag CAOS is initialized to "key reservation" state (CAOS=1). With a chord progression being entered, when DETERMINE KEYNOTE & FUNC routine 4-3 has succeeded in identifying the function of a chord newly supplied, the key state flag CAOS is changed to "determined (identified) key" state (CAOS=0). When the routine 4-3 has failed to specify a new chord function, the key state flag CAOS is moved back to "key reservation" state for this indication. Variable (register) $RDT_b$ indicates a root difference between the new chord CDN and the first preceding chord CDB. Similarly, variable (register) $RDT_f$ indicates a root difference between the first and second preceding chords CDB and CDF, and variable (register) $RDT_g$ indicates a root difference between the second and third preceding chords CDF and GDG. Variable (register) ANT indicates an accompaniment tone pitch to be actually performed.

Figure 7:
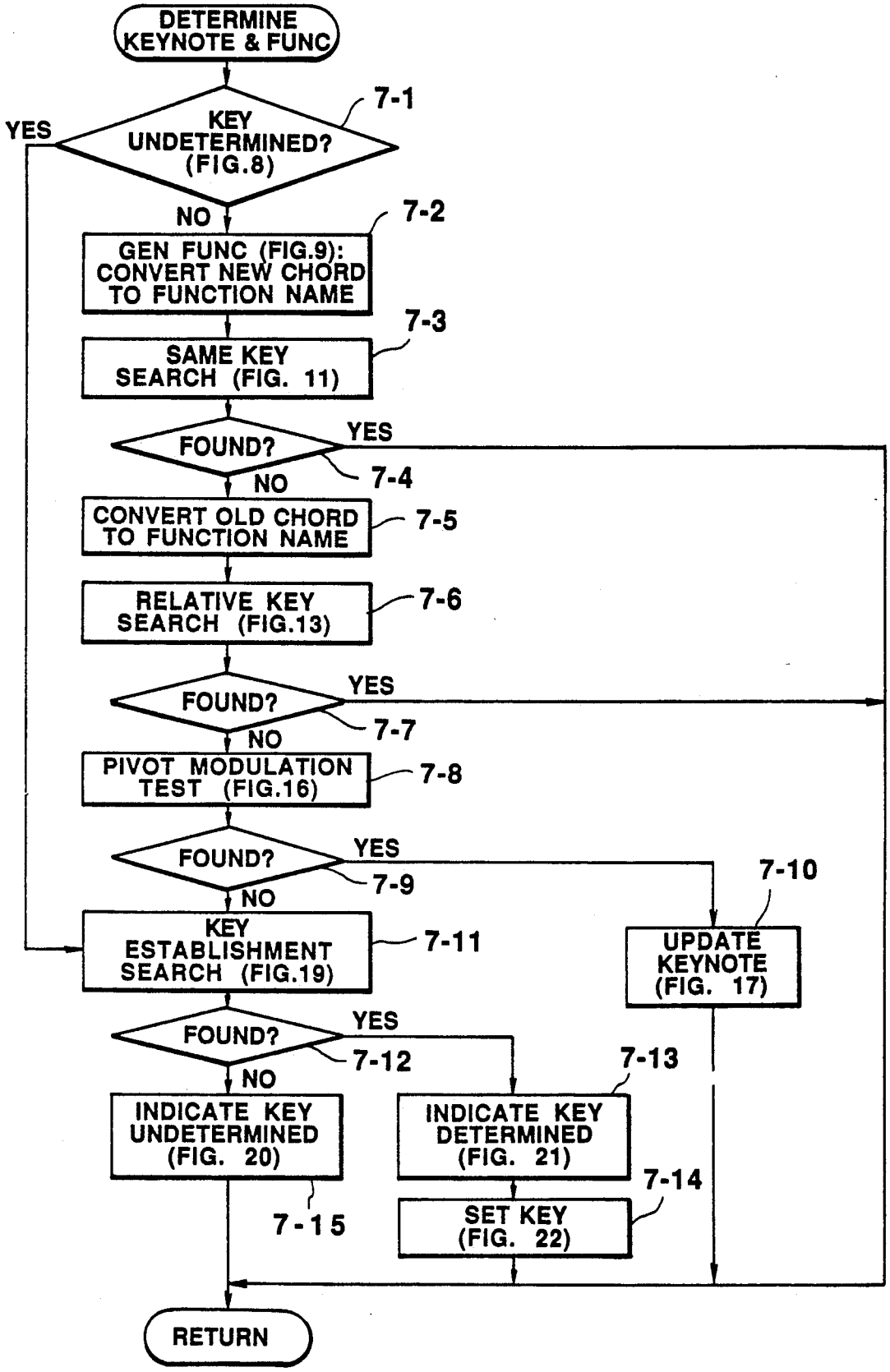
FIG. 7 is a flow chart of a routine of determine keynote and function, used in the first embodiment in accordance with the first aspect of the invention.
Figure 8:
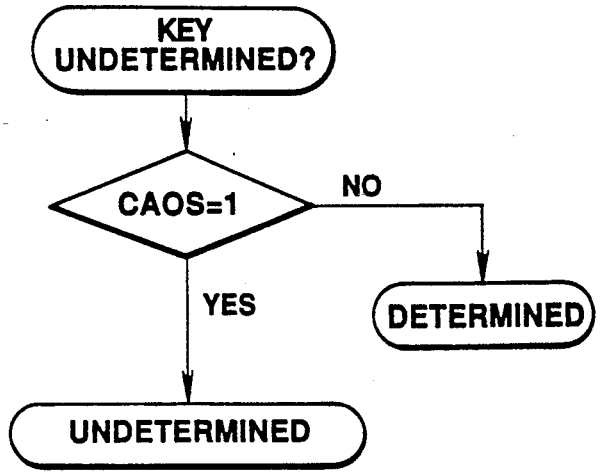
FIG. 8 is a flow chart of a key undetermined ? routine for testing key state in accordance with the first embodiment.
Figure 9:
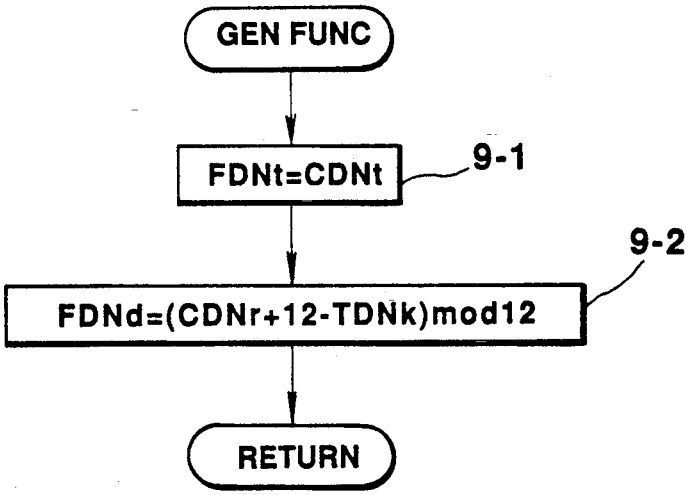
FIG. 9 is a flow chart of a generate function routine.

FIG. 7 shows details of the DETERMINE KEYNOTE & FUNC routine 4-3 (FIG. 4). At step 7-1, CPU 100 tests the current keynote to see whether it has been determined (identified). The details of the step 7-1 are shown in FIG. 8. As indicated in FIG. 8, if the key state flag CAOS=1, the current keynote has not been determined. If CAOS=0, the current keynote has been determined and identified by the $TDN_k$ value. In the latter case, CPU 100 converts the new chord to a function name evaluated by the current keynote at step 7-2 details of which are shown in FIG. 9. As described in FIG. 9, the new chord type $CDN_t$ is copied into $FDN_t$(9-1), and the new chord root (pitch class) $CDN_r$ is converted into a scale degree $FDN_d$ from the current keynote $TDN_k$(10-2).

In the next routine 7-3, called SAME KEY SEARCH, CPU 100 searches a same keynote keeping chord table for the new chord function name (functional representation) FDN. The same keynote keeping chord table resides in ROM 102. An example of the same keynote keeping table is illustrated in FIG. 10, designated by OFT. The table OFT stores a set of chords each keeping the current keynote unchanged. Each chord entry in the table OFT takes the form of a function name having a first part indicative of a function (scale degree), and a second part indicative of a chord type. For example, the entry data (7, 9) at address 14 in the same keynote keeping chord table OFT represents a chord function name of V7. The last address, here 28, of the table OFT stores data "15" indicative of end of the table.

If table OFT includes a chord entry identical with the new chord function name FDN, this verifies the assumptions made in the step 7-2 that the keynote for the new chord is the same as the current keynote, and that the new chord has a function of keeping the current keynote.

Figure 11:
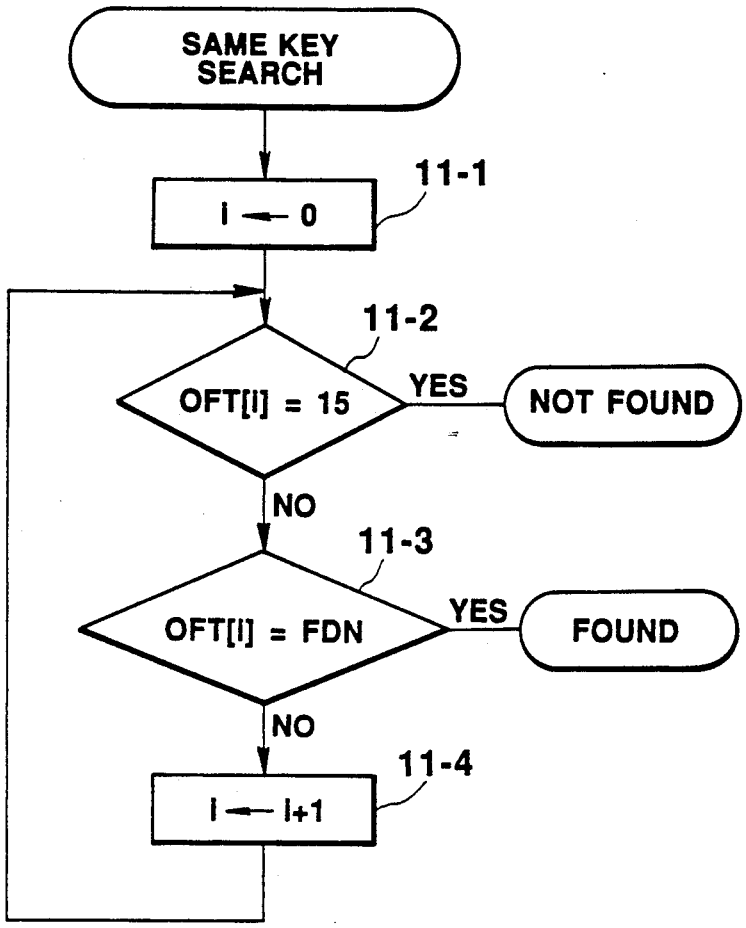
FIG. 11 is a flow chart of a same keynote search routine for searching the same keynote keeping table.

FIG. 11 shows details of the SAME KEY SEARCH routine 7-3. Step 11-1 initializes the pointer i to "0" so as to locate the first address of the same keynote keeping chord table OFT. At step 11-3 in the loop 11-2 to 11-4, the search routine compares an i-th element OFT[i] in the same keynote keeping chord table OFT with the new chord function name FDN evaluated by the current keynote(11-3). If matched at 11-3, the SAME KEY SEARCH routine returns "found." If not matched, pointer i is incremented (11-4) to compare FDN with the next element in OFT table. If the same keynote keeping chord table does not includes an element matching the new chord function name FDN, the search routine will see OFT[i]=15 indicative of end of OFT table (11-2) to return with "unfound" to step 7-5 in FIG. 7 by way of step 7-4.

At step 7-5, CPU 100 generates an old chord function name FDB in accordance with the current keynote $TDN_k$. Specifically CPU 100 sets type variable $FDB_t$ to the old chord type $CDB_t$, and computes an old chord function scale degree $FDB_d$ by ($CDB_r$+12-$TDN_k$) mod 12.

Then, CPU 100 calls RELATIVE KEY SEARCH routine 7-6 to search a relative key chord sequence table for the functional chord pattern of the old and new function names FDB and FDN. The relative key chord sequence table resides in ROM 102. FIGS. 12A and 12B show an example of the relative key chord sequence table, designated MCST. The relative key chord sequence table MCST stores a set of functional chord sequences each indicative of change from a major key to its relative minor key (e.g., C major to A minor) having the same key signature. According the memory format of FIG. 12B, each two consecutive addresses in the relative key chord sequence table MCST store one functional chord pair entry indicative of change from a major key to its relative key, in which an even address stores a function name (scale degree and chord type) of the first chord in the functional chord pair while an odd address stores a function name of the second chord in the functional chord pair. The last address, here 84, in the table MCST stores data "15" indicative of end of the table.

If the relative key chord sequence table MCST includes an entry of functional chord sequence identical with the function name pattern (pair) of the old and new chord function names, it can be concluded that the combination of the old and new chords does indicate a change from major to minor key within the name key signature.

Figure 13:
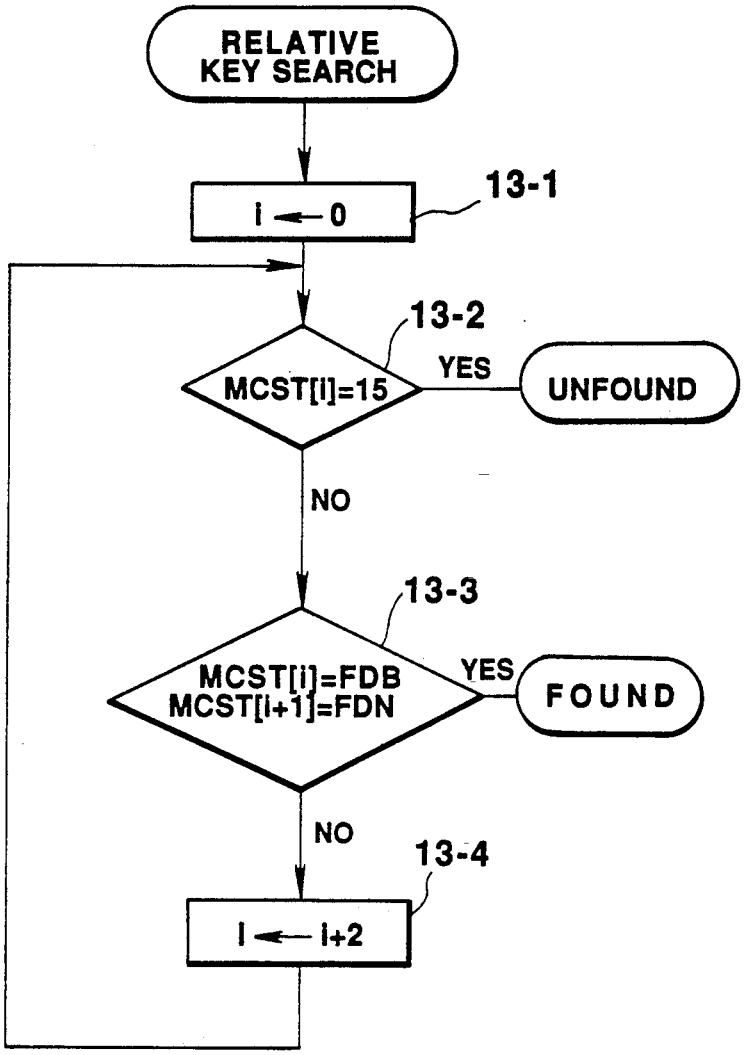
FIG. 13 is a relative key search routine for searching the relative key chord sequence table.

FIG. 13 illustrates a detailed flow chart of the RELATIVE KEY SEARCH routine 7-6. At first (13-1), the search routine initializes the pointer i to "0" to locate the first address of MCST table. In the loop 13-2 to 13-4, at 13-3, the routine tests match/mismatch between a table entry of functional chord pattern and the pair of old and new chord function names by comparing an i-th table element MCST[I] with the old chord function name FDB and by comparing the next table element MCST[i+1] with the new chord function name FDN. If matched, the RELATIVE KEY SEARCH routine successfully terminates by returning "found" so that the DETERMINE KEYNOTE & FUNC routine (FIG. 7) will also be terminated. As a result, the keynote (here, key signature) in the new chord time interval is indicated by the current keynote $TDN_k$ while the correct function of the new chord is represented by FDN. if failed the matching test 13-3, the search routine increments the table address pointer i by two (13-4). If the relative key chord sequence table MCST does not include an entry identical with the functional chord pattern of the old and new chord function names FDB and FDN, the RELATIVE KEY SEARCH routine will reach the table end (MCST[i]=15) at 13-2 so that the process will move to PIVOT MODULATION TEST routine 7-8 in FIG. 7 by way of step 7—7.

The PIVOT MODULATION TEST routine 7-8 examines a possible modulation by the old and new chords from the current keynote to another keynote. To this end, there is provided a modulation chord sequence table in ROM 102. The modulation chord sequence table may be implemented by a pivot chord table PDB shown in FIG. 14 and a post-modulation chord table MDB shown in FIG. 15. The pivot chord table PDB stores a set of chord function names (degrees and types) available in a keynote before modulation. The post-modulation chord table MDB stores a set of chord function names available in a keynote after the modulation.

Figure 16:
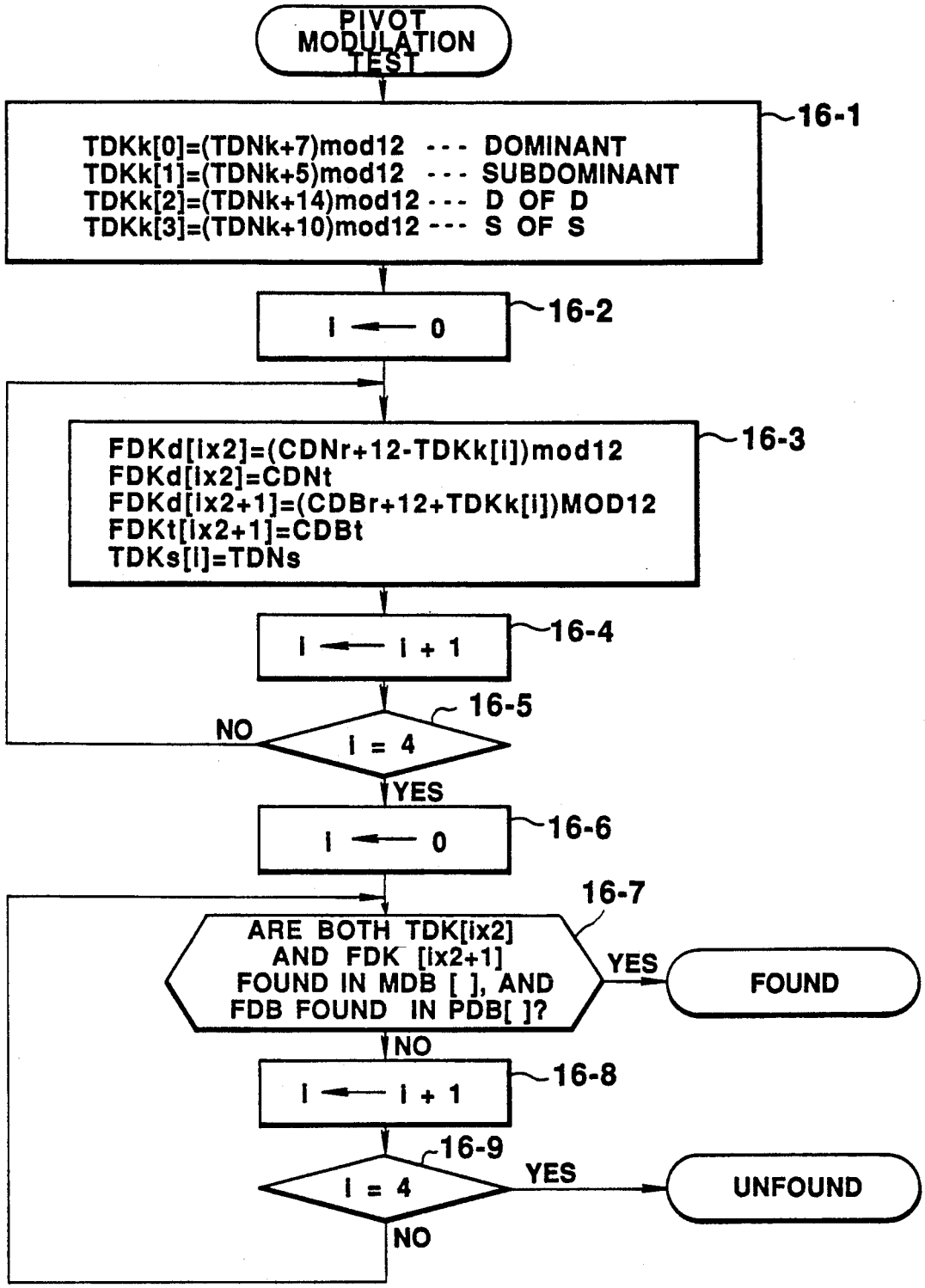
FIG. 16 is a flow chart of a pivot modulation test routine which involves searching the pivot chord table and the post-modulation chord table.

FIG. 16 shows details of the PIVOT MODULATION TEST routine 7-8. At first (16-1), the routine produces four related keynotes (i.e., dominant, subdominant, dominant of dominant, and subdominant of subdominant) of the current keynote $TDN_k$. As a result, (pitch class of) the dominant keynote is indicated by $TDK_k$[0] subdominant keynote by $TDK_k$[1], dominant of dominant keynote by $TDK_k$[2], and subdominant of subdominant keynote by $TDK_k$[3]. Then, the routine executes the loop 16-2 to 16-5 to produce four function names of the new and old chords, each name evaluated by a corresponding one of the four related keynotes. As a result, $FDK_k$[0] represents a new chord function name evaluated by the first related keynote, i.e., dominant keynote; the scale degree part of the new chord function name is indicated by $FDK_d$[0], and the type part by $FDK_t$[0]. Similarly, FDK[1] represents an old chord function name evaluated by the dominant keynote. FDK[2] and FDK[3] respectively represent new and old chord function names evaluated by the second related keynote (subdominant keynote), FDK[4] and FDK[5] respectively represent new and old function names evaluated by third related keynote (dominant of dominant keynote), and FDK[6] and FDK[7] respectively represent new and old function names evaluated by fourth related keynote (subdominant of subdominant keynote). Scale degree $FDK_d$[i×2] of the new chord, evaluated by the (i+1)-th related keynote, is computed by ($CDN_r$+12−$TDK_k$[i]) mod 12 in which $CDN_r$ represents the new chord root, and $TDK_k$[i]) indicates the (i+1)-th related keynote. Similarly, the scale degree $FDK_d$[i×2+1] of the old chord, evaluated by the (i+1)-th related keynote $TDK_k$[i], is computed by ($CDB_r$+12−$TDK_k$[i]) mod 12 in which $CDB_r$ represents the old chord root.

Figure 17:
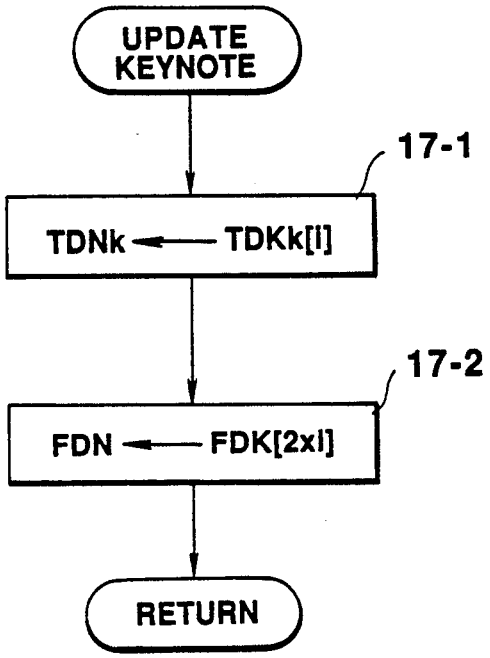
FIG. 17 is a flow chart of an update keynote routine.

In the loop 16-6 to 16-9, CPU 100 examines a possible modulation from the current keynote to any one of the four related keynotes for i=0 to 3. The chord pattern of the old and new chords CDB and CDN suggests a modulation to (i+1)-th related keynote if the following conditions are met (16-7). First, the pivot chord table PDB includes an entry identical with the old chord function name FDB evaluated by the current keynote $TDK_k$. Second, the pivot chord table PDB includes an entry identical with the old chord function name FDK[i×2+1] evaluated by the related keynote $TDK_k$[i]. Third, the post-modulation chord table MDB includes an entry identical with the new chord function name FDK[ix2] evaluated by the related keynote $TDK_k$[i]. If these conditions are all met, the PIVOT MODULATION TEST routine of FIG. 16 returns "found." At this point, $TDK_k$[i] has stored the correct keynote in the new chord time interval (i.e., one of the related keynotes that has satisfied the modulation conditions), while FDK[ix2] has stored the correct function of the new chord. Thus, CPU 100 executes step 7-10 in FIG. 7 by way of 7-9 to update the current keynote. Details of step 7-10 are shown in FIG. 17 according to which $TDK_k$[i] is copied into $TDN_k$(17-1) and FDK[2xi] is copied into FDN.(17-2)

If the modulation conditions are not met for either related keynote, the PIVOT MODULATION TEST routine will see i=4 at 16-9 and terminate with "not found" so that the process is moved to KEY ESTABLISHMENT SEARCH routine 7-11 in FIG. 7, branching from step 7-9. This routine 7-11 is also executed when the current keynote has not been identified (7-1).

The KEY ESTABLISHEMTNT SEARCH routine 7-11 analyzes an input chord pattern formed by new and its preceding chords to see whether it has established a particular key. To this end, the routine searches a key establishing chord sequence table resided in ROM 2. The key establishing chord sequence table memory stores a set of chord sequences each establishing or suggesting a key. Such a chord sequence is called a key establishing chord sequence. In general, the key establishing chord sequence is characterized in that those chords constituting the sequence have note members that define a pitch class set suggesting a particular key. By way of example, take up a chord pattern of D minor →G 7th→C MAJOR. The first chord D minor has members of D, F and A. The second chord G 7th is made up of G, B, D and F. The third chord C MAJOR has members of C, E and G. Collecting these members result in a pitch class set (C, D, E, F, G, A, B). This pitch class set specifies a key of C. Therefore, the chord pattern is a key establishing chord sequence establishing a particular key C. Using the key C, the chord pattern is analized as a pattern of function names II minor→V 7th→IMAJOR.

To determine, from the chord pattern (in which each chord is represented by a root and type), a keynote suggested thereby, there may be provided a stored musical rule (key establishing chord sequence knowledge) as follows: (if-part) in a chord pattern of second preceding chord→first preceding chord→new chord, (a) if new chord type is "MAJOR", (b) if first preceding chord type is "7th", (c) if first preceding chord root is "perfect fifth scale degree above" new chord root, (d) if second preceding chord type is "minor", and (e) if second preceding chord root is "perfect fourth scale degree below" first preceding chord root; (then-part) new chord function is "I." Since the above chord pattern of D minor→G 7th→C MAJOR meets the if-part of the rule, the new chord C Major is concluded as having "I" function. Further, from the "I" function and the new chord root of "C", it can be concluded that the chord pattern suggests or establishes a key note "C."

The above description explains the operation of the KEY ESTABLISHMENT SEARCH routine which utilizes the key establishing chord sequence table memory (regarded as stored rules of key establishing chord patterns) for determination of keynote and function.

Dominant (D) progressions and subdominant (S) progressions are typical of the key establishing chord sequences. Tables I-III show D-progression based key establishing chord sequences while tables IV-VI show S-progression based key establishing chord sequences.

TABLE I when first preceding chord root is "perfect fourth degree below" new chord root:

| first preceding chord type | new chord type | new chord function name |
|---|---|---|
| 7th | MAJOR | I |
| 7th | MAJOR6th | I6 |
| 7th | MAJOR7th | IM7 |
| 7th | MAJORadd9th | Iadd9 |
| 7th | Sus4 | ISus4 |
| 7Sus4 | MAJOR | I |
| 7Sus4 | MAJOR6th | I6 |
| 7Sus4 | MAJOR7th | IM7 |
| 7Sus4 | MAJORadd9th | Iadd9 |
| 7Sus4 | Sus4 | ISus4 |
| 7♭5 | MAJOR | I |

TABLE I-continued when first preceding chord root is "perfect fourth degree below" new chord root:

| first preceding chord type | new chord type | new chord function name |
|---|---|---|
| 7♭5 | MAJOR6th | I6 |

TABLE II when first preceding chord root is "minor third above " new chord root:

| first preceding chord type | new chord type | new chord function name |
|---|---|---|
| 7th | minor | IIIm |
| 7th | minor7 | IIIm7 |
| 7Sus4 | minor | IIIm |
| 7Sus4 | minor7 | IIIm7 |
| 7♭5 | minor | IIIm |
| 7♭5 | minor7 | IIIm7 |
| 7#5 | minor | IIIm |
| 7#5 | minor7 | IIIm7 |

TABLE III when first preceding chord root is "minor second degree above" new chord root:

| first preceding chord type | new chord type | new chord function name |
|---|---|---|
| 7th | MAJOR | I |
| 7th | MAJOR6 | I6 |
| 7th | MAJOR7 | IM7 |
| 7th | MAJORadd9 | Iadd9 |
| 7th | Sus4 | ISus4 |

TABLE IV when first preceding chord root is "major second degree below" new chord root

| first preceding chord type | new chord type | new chord function name |
|---|---|---|
| MAJOR | 7th | V7 |
| MAJOR | 7Sus4 | V7Sus4 |
| MAJOR | 7♭5 | V7♭5 |
| MAJOR | 7#5 | V7#5 |
| MAJOR6 | 7th | V7 |

TABLE V when first preceding chord root is "perfect fourth degree below" new chord root:

| first preceding chord type | new chord type | new chord function name |
|---|---|---|
| minor | 7th | V7 |
| minor | 7Sus4 | V7Sus4 |
| minor | 7♭5 | V7♭5 |
| minor | 7#5 | V7#5 |
| minoradd9 | 7th | V7 |

TABLE VI when first preceding chord root is "minor second degree above" new chord root

| first preceding chord type | new chord type | new chord function name |
|---|---|---|
| MAJOR | 7th | III7 |
| MAJOR | 7Sus4 | III7Sus4 |
| 7th | 7th | III7 |
| 7th | 7Sus4 | III7Sus4 |
| 7Sus4 | 7th | III7 |
| 7Sus4 | 7Sus4 | III7Sus4 |
| 7♭5 | 7th | III7 |
| 7♭5 | 7Sus4 | III7Sus4 |
| 7#5 | 7th | III7 |

TABLE VI-continued

| when first preceding chord root is "minor second degree above" new chord root | | |
|---|---|---|
| first preceding chord type | new chord type | new chord function name |
| 7#5 | 7Sus4 | III7Sus4 |

FIG. 18 shows a memory format of key establishing chord sequence table CPD, referenced by KEY ESTABLISHMENT SEARCH routine 7-11. The memory CPD stores a set of key establishing chord sequences including those listed in tables I–VI. According to the illustrated memory format, the first address CPD[i] of each chord sequence entry stores the type of the last chord in the sequence (the last chord to be compared with a new chord from the chord progression input device) at type location $CDP_t[i]$. The second address of each sequence entry stores the first preceding chord type at type location $CPD_t[i+1]$, and stores the root difference of the first preceding chord from the last chord at root location $CPD_r[i+1]$. Similarly, each succeeding address of key establishing sequence entry stores the condition of a further preceding chord (i.e., its type and root difference from the next chord). The last address of each sequence entry stores an end mark "100" of the sequence entry at type or higher digit location, and stores, as conclusion, the function of the last chord in the sequence at root or lower digit location. The key establishing chord sequence table CPD referenced by KEY ESTABLISHMENT SEARCH routine (FIG. 19) is assumed that the longest chord sequence in CPD has four chords (though this is merely illustrative and not limited in accordance with the invention).

Figure 19:
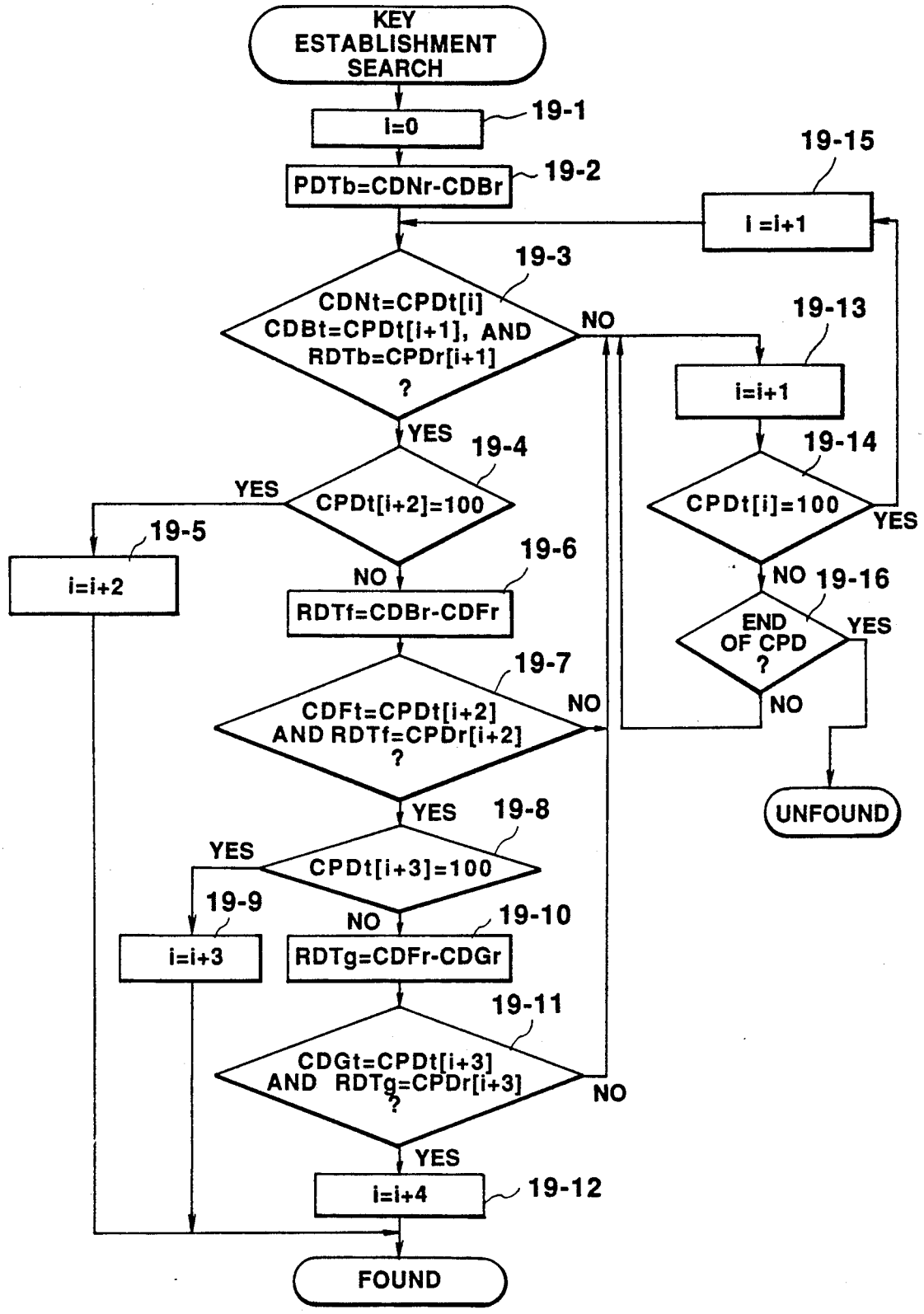
FIG. 19 is a key establishment search routine which involves searching the key establishing chord sequence table for an entry matching an input chord pattern formed by new and its preceding chords to see whether the input chord pattern establishes a key.
Figure 20:
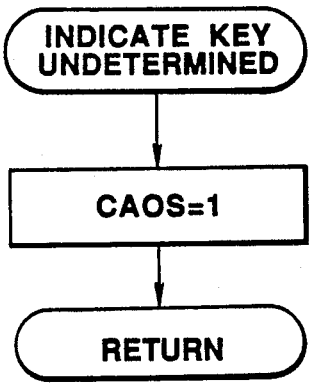
FIG. 20 is a flow chart of an indicate key undetermined routine.

FIG. 19 details the KEY ESTABLISHMENT SEARCH routine Y-11. First (19-1), the routine sets i=0, locating the start of the key establishing chord sequence table GPD. Then (19-2) it computes the root difference between the new and first preceding chords by $RDTb=CDN_r-CDB_r$. In the illustrated flow, other root differences, $RDT_f$(between first and second preceding chord roots $CDB_r$ and $CDF_r$), $RDT_g$ (between second and third preceding chord roots $CDF_r$ and $CDG_r$) are computed in the loop at 19-6 and 19-10. To speed up the search, all root differences should be computed at a time before the loop, as done in the actual search program.

At steps 19-3 to 19-16, the KEY ESTABLISHMENT search routine searches the key establishing chord sequence table GPD for a sequence entry matching an input chord pattern ending with a new chord.

If a two-chord-long chord pattern input formed by new and first preceding chords matches the condition of a two-chord-long key establishing chord sequence entry in CPD, steps 19-3 and 19-4 are met: $CDN_t=CPD$ t[i] $CDB_t=CPD_t[i+1]$, $RDT_b=CPD_r[i+1]$, and $CPD_t[i+2]=100$. In this case, KEY ESTABLISHMENT SEARCH routine locates the conclusion of the matched sequence entry (identified function of the new chord) by i=i+2 at step 19-5 and returns with "found" back to the DETERMINE KEYNOTE & FUNC routine of FIG. 7.

If a three-chord long chord pattern input formed by new and first and second preceding chords satisfies the condition of a (three-chord-long) key establishing entry in CPD, step 19-3 yields YES, step 19-4 yields NO, step 19-7 yields YES, meeting $CDFT=CPD_t[i+2]$ and $RDT_t=CPD_r[i+2]$, and step 19-8 yields YES, finding $CPD_t[i+3]=100$. In this case, the KEY ESTABLISHMENT SEARCH routine locates the conclusion of the matched key establishing entry by i=i+3 (19-9) and returns with "found."

Similarly, if a four-chord-long entered chord pattern formed by new to third preceding chords matches the condition of a (four-chord-long) key establishing chord sequence entry in CPD, this will result in YES at step 19-3, NO at step 19-4, YES at step 19-7, NO at step 19-8, and YES at step 19-11 meeting $CPG_t=CPD_t[i+3]$ and $RDT_g=CPD_r[i+3]$. Then, the KEY ESTABLISHMENT SEARCH routine locates the conclusion of the matched entry by i=i+4 at step 19-12, and returns with "found."

If an input chord pattern does not meet the condition of a key establishing chord sequence of interest, the routine will find NO at step 19-3, 19-7 or 19-11. Then the routine locates the next entry of key establishing chord sequence in CPD (19-13 to 19-16), and goes back to step 19-3 for matching test of the next entry against the input chord pattern.

If there is no entry in the key establishing table CPD, matching the input chord pattern, the routine will find the end of CPD at 19-16. Thus, the KEY ESTABLISHMENT SEARCH routine terminates with "unfound", returning back to the DETERMINE KEYNOTE & FUNC routine of FIG. 7.

In FIG. 7, at step 7-12, the DETERMINE KEYNOTE & FUNC routine checks whether the KEY ESTABLISHMENT SEARCH routine has terminated with "found" or "unfound." If found, CPU 100 executes steps 7-13 and 7-14 to indicate a key determined and set a keynote.

Figure 21:
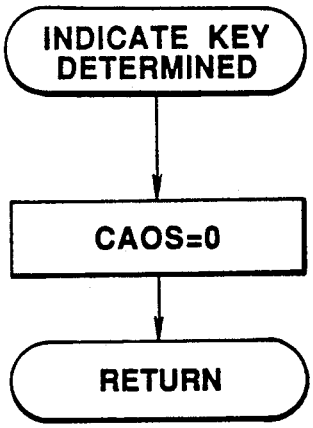
FIG. 21 is a flow chart of an indicate key determined routine.
Figure 22:
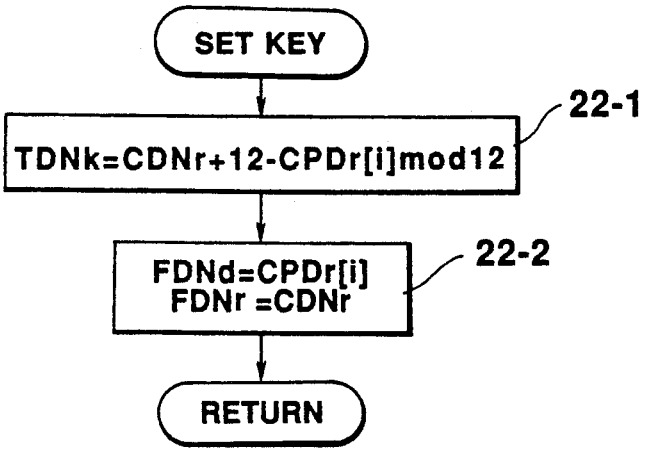
FIG. 22 is a flow chart of a set key routine.

Details of steps 7-13 and 7-14 are shown in FIGS. 21 and 22. As shown in FIG. 21 the key state flag is changed to "determined" or identified by CAOS=0, indicating that the current keynote has been identified. In SET KEY routine of FIG. 22 at step 22-1, CPU 100 computes an identified keynote $TDN_k$ from the new chord root and the conclusion (i.e., the new chord function) from the KEY ESTABLISHMENT SEARCH routine by $TDN_k=CDN_r+12-CPD_r[i]$mod12. At step 22-2, CPU 100 sets the new chord function register $FDN_d$ equal to the search conclusion $CPD_r[i]$.

If "unfound" in the KEY ESTABLISHMENT SEARCH, the DETERMINE KEYNOTE & FUNC routine changes the key state flag CAOS to "1" at step 7-15 (see FIG. 20), thus indicating that the current keynote has not been identified.

Figure 23:
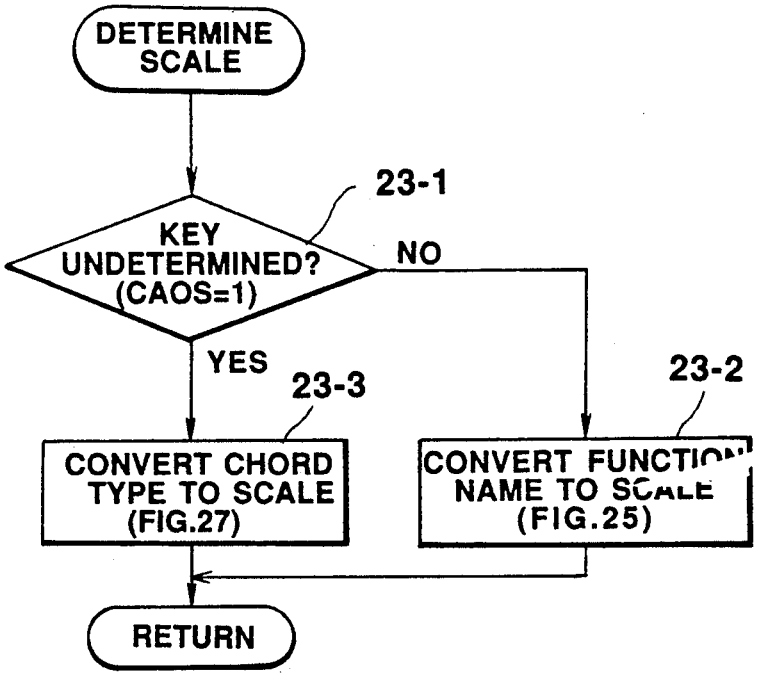
FIG. 23 is a flow chart of a determine scale routine.

FIG. 23 shows a flow chart of the DETERMINE SCALE routine 4—4. This routine is called after the DETERMINE KEYNOTE & FUNC routine has been completed, as indicated in FIG. 4. As noted from the flow of FIG. 7, if the DETERMINE KEYNOTE & FUNC routine has succeeded in the function identification of a new chord, the key state flag CAOS is set to "0" or determined key condition, whereas the flag CAOS is set to "1" or reserved key condition if the routine has failed to identify the new chord function. If CAOS=0 (23-1), the DETERMINE SCALE routine uses the identified function of the new chord and looks up the function name/scale converter table to thereby determine a scale available at the time of the (function-identified) new chord based on a narrow interpretation of tonality (23-2). With CAOS=1, the routine uses the new chord type to look up the type/scale converter table, thus determining a scale available at the time of the (function-unidentified) new chord based on a broader interpretation of tonality (23-3).

FIGS. 24A and 24B illustrate the function name/-scale converter table, designated SCT. The table memory SCT stores correspondence between function names and scales. According to the illustrated memory format (FIG. 24B), each two consecutive addresses store a function name (scale degree and type) of a chord at the even address, and a scale suitable therefor at the odd address. For example, data (7,0) at address 6 and data 2 at address 7 indicate that a scale "mixolydian" is suitable for a function name "V major." However, special chord types (Aug, dim and SUS4 other than $V_7$Sus4) at addresses 60, 62 and 64 have such a nature that appropriate scales are derived independently of their chord function (root scale degree from a keynote). Thus, they are called key independent chords. To indicate this, each degree (function) part of these chords stores a code "14." In other words, scales for these chords are obtained by converting their chord type (rather than function name) to scale. The last address, here "66" of the table SCT stores a code "15" indicative of end of the table.

Figure 25:
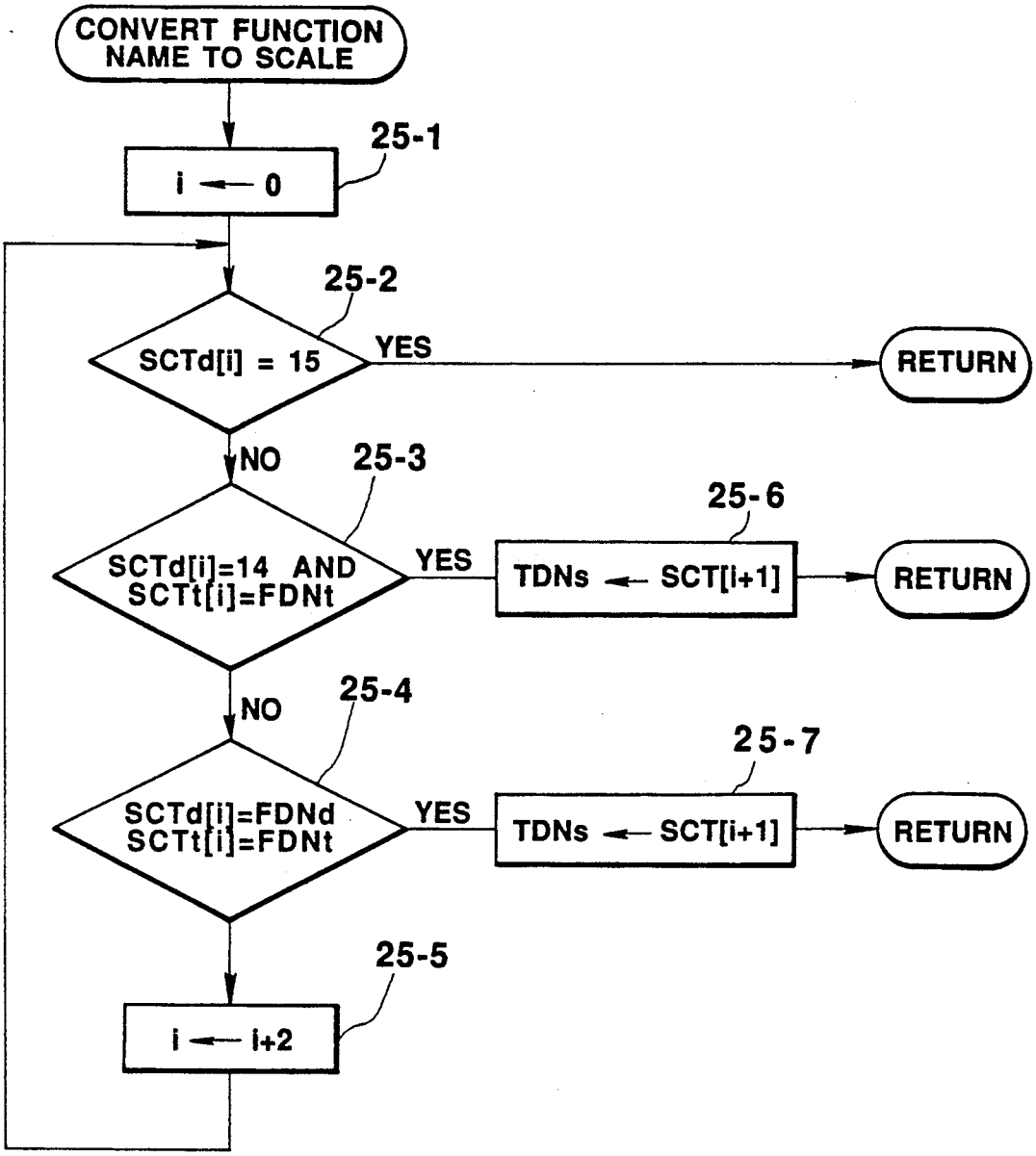
FIG. 25 is a flow chart of a convert function name to scale routine.

FIG. 25 details the CONVERT FUNCTION NAME TO SCALE routine 23-2. At the entry to this routine, FDN has stored the correct function name of the new chord, as a result of the DETERMINE KEYNOTE & FUNC routine of FIG. 7. $FDN_d$ indicates the new chord scale degree, and $FDN_t$ indicates the new chord type.

At first (25-1), CPU 100 initializes the pointer i to "0" to locate the start address of the function name/scale converter table SCT. In the loop 25-2 to 25-5, the pointer i is incremented two by two (25-5) from the table start (i=0) to the table end ($SCT_d[i]=15$). Step 25-4 compares the new chord function name FDN with a table element SCT[i] specified by the pointer i. If matched, the next table element scale data SCT[i] is loaded into scale part $TDN_s$ of the tonality data memory TDN (25-7). If the new chord is a key independent chord (either of augmented, diminished and suspended fourth), the CONVERT FUNCTION NAME TO SCALE routine will find a table element SCT[i] having $SCT_t[i]$ data identical with the new chord type $FDN_t$, and $SCT_d[i]$ data of "14" indicative of the key independent chord (25-3). Then, the scale data of the next table element SCT [i+1] is loaded into scale part $TDN_s$ of the tonality data memory TDN (25-6).

The table SCT may be modified such that it performs function name to scale conversion even for the special chords (by using their functional information). Whereas the table SCT illustrated in FIG. 24A does not provide one-to-one correspondence between function names and scales, it is preferred in the application of accompaniment performance (rather than mere scale display) to modify the table SCT so as to provide the one-to-one correspondence, i.e., to return a unique scale for each function name. This will realize an accompaniment with an increased variety of pitch line, varying in going from one chord function name to another.

FIG. 26 illustrates the type/scale converter table memory, designated CFD. This table resides in ROM 102, and stores, for each chord type, a scale suitable therefor. Such scales (type-based scales) may be determined according to the common PC method discussed in connection with FIG. 1F.

Figure 27:
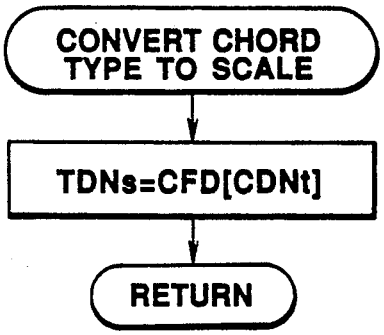
FIG. 27 is a flow chart of a convert chord type to scale routine.

FIG. 27 shows a flow of the CONVERT CHORD TYPE TO SCALE routine 23-3. This routine looks up the table CFD to get scale data corresponding to the new chord type $CDN_t$ and load it into $TDN_s$ by $TDN_s=CFD[CDN_t]$.

Figure 28:
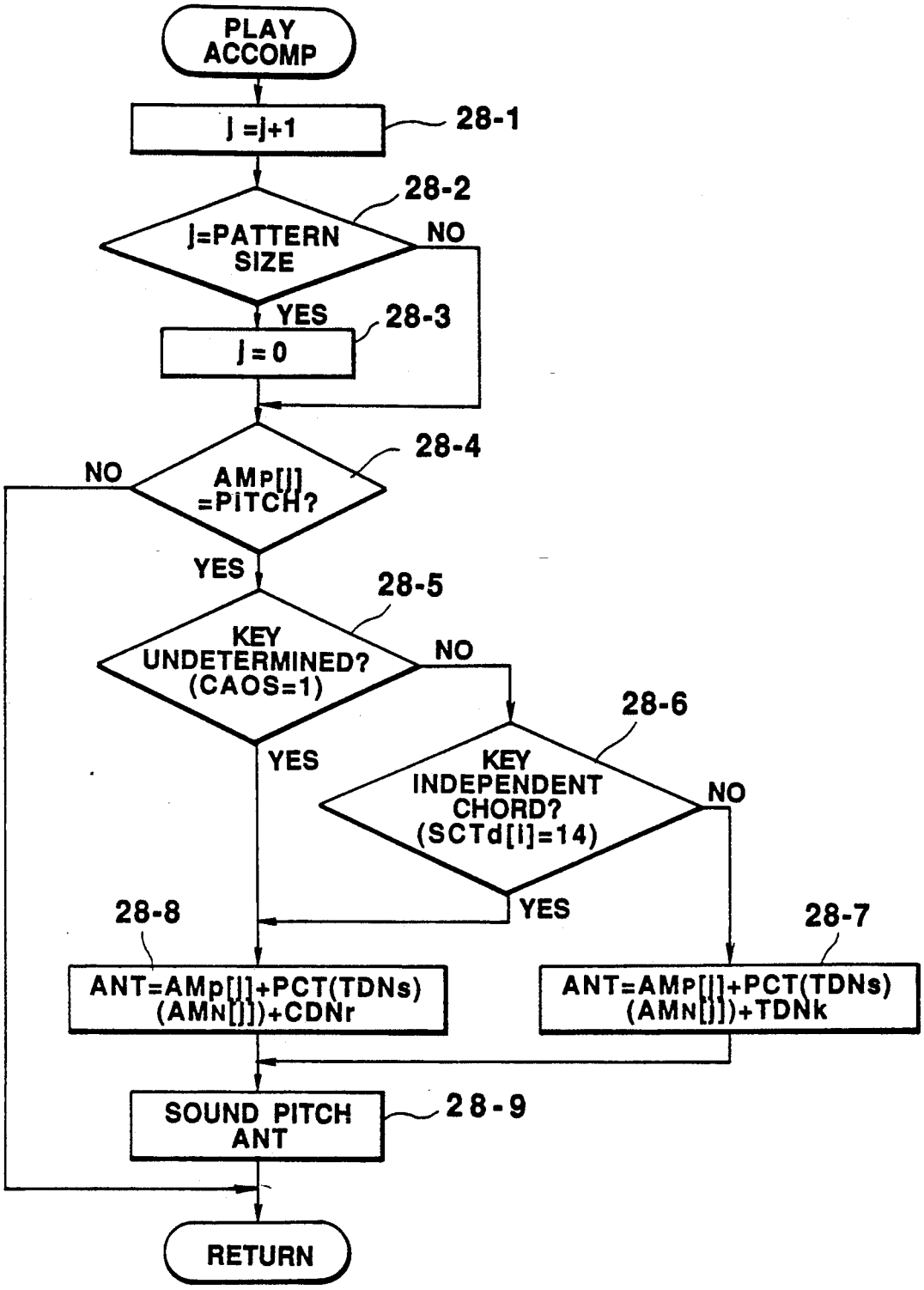
FIG. 28 is a flow chart of a play accompaniment routine in accordance with the second aspect of the invention.

FIG. 28 details the PLAY ACCOMP routine 4-5. This routine uses a reference accompaniment pattern, an example of which is shown in FIG. 29.

Figure 29:
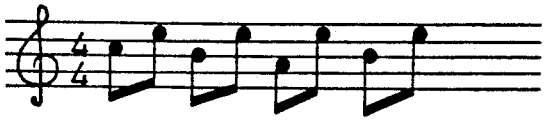
FIG. 29 is a staff illustrating an accompaniment pattern.

The accompaniment pattern of FIG. 29 is written in a keynote of C and chord function name of I MAJOR. FIG. 30 depicts an accompaniment pattern memory AM (residing in ROM 102) which stores data representative of the reference accompaniment pattern in FIG. 29. Specifically, each address of the accompaniment pattern memory AM stores data that comprises a first part $AM_p$ indicative of a reference pitch (if any), and a second part $Am_t$ indicative of a column pointer of a pitch change table PCT shown in FIG. 31. CPU 100 repeatedly reads the accompaniment pattern memory AM in accordance with the PLAY ACCOMP routine of FIG. 28. If the first part of the read data indicates a pitch, CPU 100 modifies that pitch in accordance with the chord function name FDN and in accordance with the keynote, and sends the modified pitch data to the tone generator 108 to produce an accompaniment tone of the modified pitch.

The pitch change table PCT in FIG. 31 stores entries of pitch modifying data indicative of a pitch difference for modifying pitch data from the accompaniment pattern memory AM in accordance with the tonality. Columns of the table PCT indicate respective pitches in the reference accompaniment pattern. In operation, a pitch-related column pointer in the reference accompaniment pattern is read out from the accompaniment pattern memory AM and specifies a particular column of the pitch change table PCT. Rows of the table PCT indicate respective scales. In operation scale data from the DETERMINE SCALE routine 4-4 specifies a particular row of the table PCT. At an intersection of a row and a column (i.e., address specified by the row and the column), there is stored a pitch difference for modifying the reference pitch specified by the column with the scale indicated by the row.

The pitch change table PCT basically comprises two subtables, first PCT subtable for function-based scales corresponding to those supplied from the function name/type converter table SCT, and second PCT subtable for type-based scales corresponding to those supplied from the chord type/scale converter table CFD. However, since both of the converter tables SCT and CFD contain key independent chords, a region in the pitch change table PCT is shared which deals with the key independent chords, or scales converted therefrom by SCT or GFD.

The PLAY ACCOMP routine of FIG. 28 first (28-1) increments an accompaniment pattern pointer j by one. If the pointer j has reached the accompaniment pattern memory AM size (16 in the case of FIG. 30) at step 28-2, the pointer j returns to the start of the accompaniment pattern memory AM (28-3). Then routine checks if the first part $AM_p[j]$ of the data AM[j] in the accompaniment pattern memory AM at a location specified by pointer j indicates a pitch. If this is not the case, the PLAY ACCOMP routine directly terminates. If $AM_p[j]$ indicates a pitch, the PLAY ACCOMP routine produces actual accompaniment pitch data in the following steps 28-5 to 28-8.

Specifically, if the current keynote has been identified (28-5), and if the new or current chord is not a key independent chord (28-6), step 28-7 computes actual accompaniment tone pitch data ANT to be actually played by:

$$ANT = AM_p[j] + PCT(TDN_s)(AM_N[j]) + TDN_k$$

That is, the reference pitch data $AM_p[j]$ from the accompaniment pattern memory AM is added to pitch difference data in the pitch change table PCT at $TDN_s$-th row and $AM_N[j]$-th column, and further added to the current keynote $TDN_k$, thus producing actual accompaniment pitch data ANT. Here, the difference pitch data $PCT(TDN_s)(AM_N[j])$ serves to modify the reference pitch in the reference accompaniment pattern written in keynote C and function name I MAJOR to the one suitable for the new chord function name specified by the DETERMINE KEYNOTE & FUNC routine (FIG. 7). Thus, the term "$AM_p[j]+PCT(TDN_s)(AM_n[j]$ indicates an accompaniment pitch for keynote C and the new or current chord function name. Thus, adding the current keynote to this term results in an accompaniment tone pitch suitable for the combination of the current keynote and the current function name.

If the current keynote has not been identified, step 28-8 of the PLAY ACCOMP routine computes actual accompaniment pitch ANT by $$ANT = AM_p[j] + PCT(TDN_s)(AM_N[j]) + CDN_r$$

That is, the reference pitch data $AM_p[j]$ from the accompaniment pattern memory AM is added to the difference pitch data in the pitch change table PCT at $TDN_s$-th row and $AM_N[j]$-th column, and is further added to the current chord root $CDN_r$, thus yielding the actual accompaniment pitch ANT. Here, the difference pitch data $PCT(TDN_s)(AM_N[j])$ modifies the pitch AMp[j] in the reference accompaniment pattern written in a scale "ionian" starting with a pitch class "C" so as to fit in a scale derived from the current chord type based on the broader interpretation of tonality. Thus, the term "$AMp[j]+PCT(TDN_s)(AM_N[j])$" indicates a pitch for a chord root of C and for a scale corresponding to the current chord type. Adding this term to the current chord root data $CDN_r$ results in an accompaniment pitch that fits in the current musical situation or pitch class set defined from the current chord type and root with an unidentified function according to the broad interpretation of tonality.

For a key independent chord (28-6), actual accompaniment pitch data is computed in the same manner as in the case of undetermined keynote (28-8).

Finally, the PLAY ACCOMP routine controls CPU 100 to send a note-on command including the produced pitch data ANT to the tone generator 108 which thus generates an accompaniment tone of pitch ANT (step 28-9).

Figure 32:
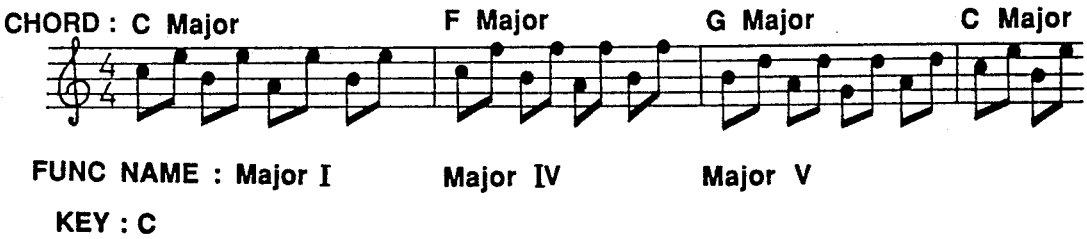
FIG. 32 illustrates a staff of an accompaniment played by the automatic accompaniment apparatus.

FIG. 32 illustrates an accompaniment example played by the automatic accompaniment apparatus of the specific embodiment in response to a chord progression of:

C major→F major→G major→C major.

This chord progression is analyzed by the DETERMINE KEYNOTE & FUNC routine (FIG. 7), resulting in keynote C and a function name progression of:

I major→IV major→V major→I major

Thus, an accompaniment segment in each C major chord time interval is formed without changing the pitch line from the accompaniment pattern memory AM. The stored pitch line is as follows:

C5→E5→B4→E5→A4→E5→B4→E5

In the F major chord time interval, however, the E5 pitch in the stored pitch line is raised by a half tone to F5 in accordance with the pitch difference data "1" in the pitch change table PCT because the F major chord has been evaluated as function name major IV. As a result, an accompaniment segment in the F major chord time interval will have a pitch line of:

C5→F5→B4→F5→A4→F5→B4→F5

For the G major chord, C5 pitch in the stored pitch line is lowered by a half tone to B4 in accordance with pitch difference data "−1", and E5, B4 and A4 pitches are lowered by a whole tone to D5, A4 and G4 respectively in accordance with pitch difference data "−2" because the G major chord function name is major V. As a result, an accompaniment segment in the G major chord time interval will have a pitch line of:

B4→D5→A4→D5→G4→D5→A4→D5

Figure 33:
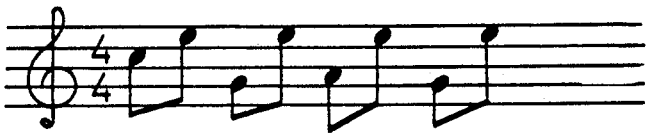
FIG. 33 is a staff of an accompaniment played when a key has not been determined in accordance with the second aspect of the invention.

FIG. 33 illustrates an accompaniment example played by the present apparatus during an unidentified key. More specifically, the illustrated accompaniment is formed in response to a chord C Major in the musical situation in which the current key is indefinite or absent, and played during the time interval of the C Major chord. In the musical situation of unidentified keynote, the DETERMINE KEYNOTE & FUNC routine (FIG. 7) fails to identify a newly supplied chord C Major with respect to its function. Thus, the pitch class set available in the time interval of the C major chord is given by C, D, E, G and A in accordance with the common PC method (see FIG. 1F). As a result of the CONVERT TYPE TO SCALE routine (FIG. 27), the row of SCALE 1 (corresponding to type Major) in the pitch change table PCT is located. This modifies the reference accompaniment pattern pitch line

C5→E5→B4→E5→A4→E5→B4→E5 into the actual accompaniment (FIG. 33) pitch line

C5→E5→G4→E5→A4→E5→G4→E5 that fits in the available pitch class set (C, D, E, G, A). From the comparison of these two pitch lines, it is noted that a reference pitch "B4" is changed into "G4" in the actual accompaniment, as the result of adding data "−4" in PCT table at SCALE1 row and second column to the reference pitch data "B4." This pitch change takes it into account that the available pitch class set (C, D, E, G, A) does not include a pitch class "B" of the reference pitch "B4." Since the accompaniment of FIG. 33 involves three possible keys C, F and G, it will not damage or weaken a succeeding tonality or key specified or established by a succeeding accompaniment whether the succeeding key is either C, F or G.

In this manner, the automatic accompaniment apparatus of the first specific embodiment utilizes a chord root and type for a function-unidentified chord to play an accompaniment in the time interval of the function-unidentified chord; the accompaniment allows a broad tonality covering several possible specific tonalities or keys and thus musically compatible with the surrounding (preceding or succeeding) specific tonality of or established by the surrounding accompaniment. This achieves a natural tonality stream in the whole accompaniment without introducing a sense of false modulation.

The first specific embodiment has been described. However, various modifications will fall well within the scope of the invention.

A modification employs a plurality of key determining modules, all operative for every chord in a chord progression for its tonal analysis. From the analyzed results obtained from the plurality of key determining modules, a final determination is made for the tonality of the chord. For example, in the musical situation with an identified preceding key, not only the first determining module 30 that utilizes the preceding key information for the determination of the new chord function, but also the second determining module 40 that determines the new chord function without relying on the preceding key information are put into operation. The results from the first and second determining modules 30 and 40 are combined into the final tonality according to predetermined logic. The logic may be such that (A) if only one of the plurality of key determining modules has succeeded in identifying the new chord function, the final tonality is determined by the results from the succeeded module, (B) if plural key determining modules have succeeded in determining the new chord function and provide the same results, then the same results define the final tonality, and (C) if plural determining modules have succeeded but obtained different results, the final tonality is determined according to either (C1) method or (C2) method stated below.

The method (C1) determines the final tonality from the results obtained from one of the succeeded modules and associated with an analyzed chord sequence of maximum length. For example, suppose that the first determining module has identified the new chord function as "I" from the application of a "two-chord-long" chord sequence, and that the second determining module has identified the function of the same chord as "V" from the application of a "three-chord-long" chord sequence. Then the new chord function "V" is selected to determine the final tonality of the new chord.

The method (C2) determines, as the final tonality, a broad tonality that covers all specific but different functions identified by the plural succeeded modules. (The method (C2) may also be applied after the method (C1) has found that the differently identified chord functions are derived from the analysis of chord sequences having the same length.) Suppose, for example, that for a chord C Major, the first determining module identified its function as I whereas the second determining module differently identified the function as V. The available pitch class set for I function of C Major chord is given by C, D, E, F, G, A and B whereas the available pitch class set PCS) for V function of C Major chord is given by C, D, E, F, G, A and B♭. The method (C2) takes common pitch classes C, D, E, F, G and A to the two PCSs as being finally available in the musical time of the chord C Major.

The data and/or program structure of the chord progression knowledge base 60 may take several forms. In one form, the same keynote keeping chord table 61 is arranged such that each bit memory cell has a location specified by different ones of the combinations of chord type and function, and stores a one bit that indicates whether the corresponding combination of type and function maintains the keynote (by bit "1") or not (by bit "0"). For total 16 types and total 12 chord functions, the same keynote keeping table 61 may be realized by a twelve word memory that stores a sixteen-bit word per address and has 12 consecutive addresses. With this arrangement, the same key search routine can be executed very rapidly since it can directly compute, from the supplied chord type and function combination, the memory location (word address and bit position within the word) where the information bit is stored which indicates whether the supplied combination maintains the keynote.

In another form, data of each table memory are ordered to enable a quick search such as binary search. This will speed up the process time required for tonality determination, and is therefore desirable in real-time applications. For example, to adapt the key establishing chord sequence table 63 to the binary search, the stored chord sequence entires are ordered such that type data of sequence-ending chords are arranged in data increasing order, and that within those entries having the same type of sequence-ending (last) chord, first root difference data (indicative of root difference of last chord to first preceding chord) are ordered in data increasing order, and so on. Each entry of key establishing chord sequence is arranged such that it has the last chord type stored at the second part of the first address, the first root difference at the first part of the second address, the first preceding chord type at the second part of the second address, and so on, and the end-of-sequence mark at the first part of the end address and the identified function of the last chord at the second part of the end address. A sequence-start index table memory is provided which has consecutive addresses specified by key establishing chord sequence entry numbers, and stores sequence-start indexes each indicative of an address in the key establishing chord sequence table where a corresponding chord sequence entry begins. The key establishment search routine operates as follows. (Al) It reads a key establishing chord sequence located at the center of the key establishing chord sequence table by looking up the index table by ($\frac{1}{2}\times$size of the key establishing chord sequence table in which "size"=total entry number of key establishing chord sequences) and using the looked-up index indicative of the location where the central chord sequence begins. (A2) It compares the type data, denoted x1, of the sequence-ending chord with the new chord type data, denoted y1, of the input chord pattern to be analyzed. (A3) if $x1>y1$, it reads a key establishing chord sequence located at the center of the first half of the key establishing chord sequence table by using the index looked up from the index table at ($\frac{1}{2}\times$tested chord sequence entry number, here, of the central sequence of the key establishing chord sequence table). (A4) If $x1<y1$, it reads a key establishing chord sequence located at the center of the second half of the key establishing chord sequence table by using the address index looked up from the index table at (tested sequence entry number+(table size-tested sequence entry number)$\times\int$). If $x1=y1$, it compares the first root difference x2 in the tested sequence with the first root difference y2 in the input chord pattern. If $x2>y2$, it executes (the reading of) step(A3). If $x2<y2$, it executes (A4) step. If $x1=y1$ and $x2=y2$, it compares the first preceding chord type x3 in the tested sequence with the first preceding chord type y3 in the input chord pattern. If $x3>y3$ (symbolized, here by x1, x2, x3>y1, y2, y3), the routine executes the step (A3). If $x3<y3$ i.e., x1, x2, x3<y1, y2, y3, it executes the step (A4). In a similar manner, if x1, x2, x3, . . . >y1, y2, y3, . . . , (A3) step is executed whereas if x1, x2, x3, . . . <y1, y2, y3, (A4) step is executed. (A5) Next, the routine compares the key establishing chord sequence read by step (A3) or (A4) with the input chord pattern. If x1, . . . <y1, it reads a key establishing chord sequence located at the center of the lower $\frac{1}{4}$ area of the key establishing chord sequence table. The above process continues so that the search area is progressively reduced ($1 \rightarrow \frac{1}{2} \rightarrow \frac{1}{4} \rightarrow \frac{1}{8}$ etc). The search terminates with "found" (r1) when the routine detects an end-of-sequence mark with the conditional part of a key establishing chord sequence entry matching the input chord pattern. The search terminates with "unfound" (r2) when the address of the current key establishing chord sequence remains the same as that of the last tested key establishing chord sequence table. In this manner, using the binary search technique, the key establishment search process can be completed in a very short time since the binary search of the key establishing chord sequence table having, say, a total of 127 entries only involves at most seven times of comparison between the input chord pattern and key establishing chord sequence entry.

Storage saving can be achieved by representing the chord sequence table according to AND-OR based musical rules. Consider, for example, (a) an AND-OR musical rule stating that (if the sequence-ending chord type is t1) and (if the first root difference is r1 and if the first preceding chord type is t2) or (if the first root difference is r2 and if the first preceding chord type is t3), then the sequence-ending chord function is f1. This AND-OR based musical rule can readily be represented by data t1, r1, t2, f1, an end-of-sequence mark (or sequence length), and AND/OR identifying bits. Let us compare this with an equivalent of two AND-based musical rules (b) and (c) in which the first rule (b) states that (if the sequence-ending type is t1) and (if the first root difference is r1) and (if the first preceding chord type is t2), then the sequence ending chord function is f1 whereas the second rule (C) states that (if the sequence-ending type is t1) and (if the first root difference is r2) and (if the first preceding chord type is t3), then the sequence-ending chord function is f1. As noted, the AND-OR based single musical rule representation needs a smaller amount of data, avoiding repeated data of the sequence-ending chord type t1, sequence-ending chord function f1 and end-of-sequence mark.

Figure 34A:
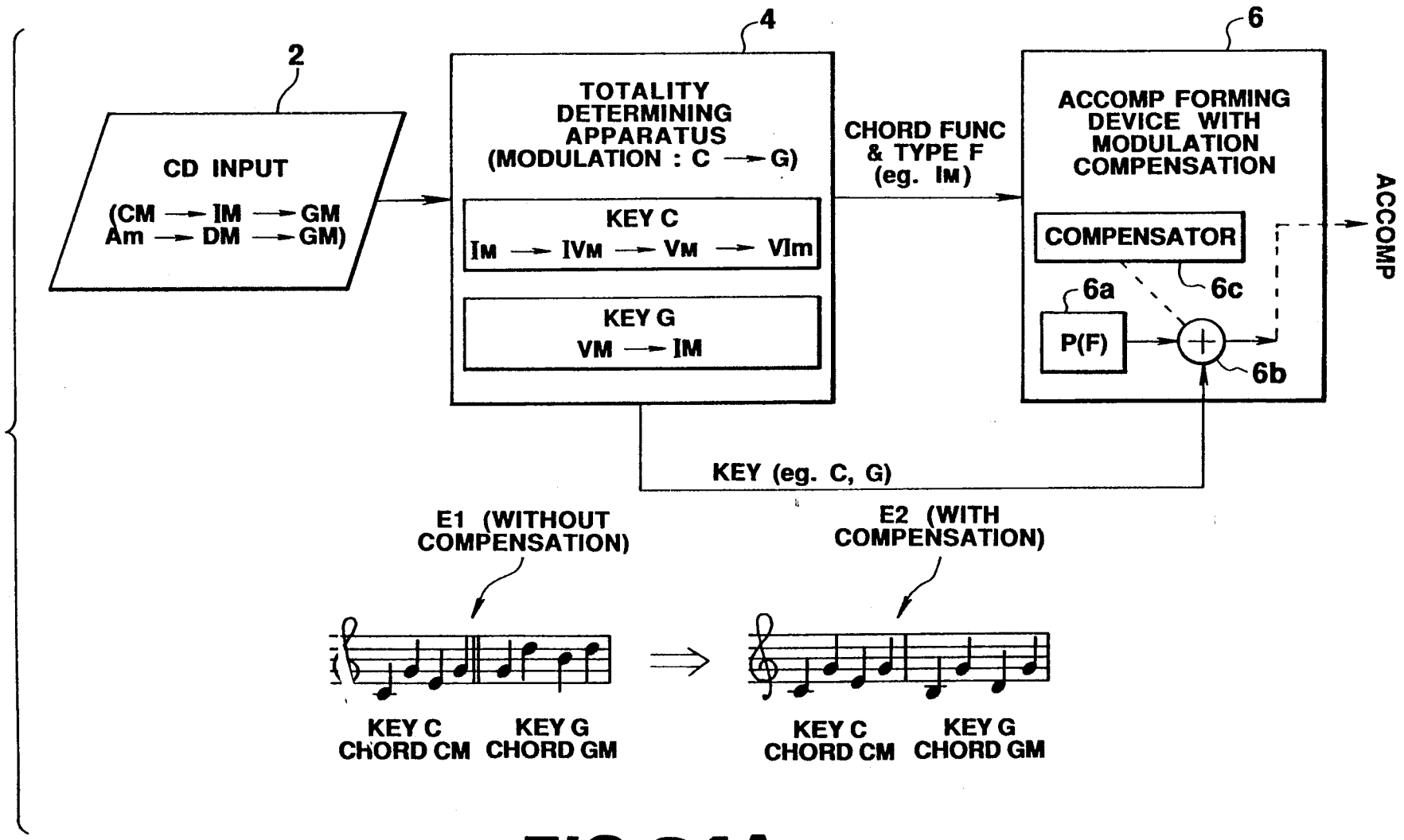
FIG. 34A is a functional block diagram of an automatic accompaniment apparatus incorporating a modulation compensating feature for maintaining or adjusting pitch range of the accompaniment in accordance with the third aspect of the invention.

FIG. 34A is a functional block diagram of an automatic accompaniment apparatus in accordance with the second aspect of the invention. As will be more apparent, the present accompaniment apparatus has the modulation compensating feature that maintains or adjusts the accompaniment pitch line or range over an extented time without introducing a leap motion or pitch range shift in the event of modulation (change of key).

In FIG. 34A, the chord progression input device 2 inputs a succession of chords (chord progression) in which each chord is represented by a root and a type. The tonality determining apparatus 4 analyzes a chord progression supplied from the input device 2 with respect to tonality. The apparatus 4 includes a modulation detecting feature which detects a modulation (change of key) from the chord progression. Suppose, for example, that the input device 2 has entered a chord progression of CM→FM→GM→Am→DM→GM (in which M and m denote "major" and "minor" types, respectively. In response to such chord progression, the tonality determining apparatus 4 determines keynote C during the period from the first to fourth chords CM-AM, and determines the succession of these four chords as having a function succession of IM→IVM→VM→VIm. For the fifth and sixth chords DM and GM, the tonality determining apparatus 4 determines keynote G, identifying the chords DM and GM as having functions VM and IM, respectively.

In accordance with the invention, the accompaniment forming device 6 includes a modulation compensating feature, and forms an accompaniment based on results from the tonality determining apparatus 4.

In the prior art accompaniment forming device, a pitch forming means for forming an actually performed accompaniment pitch includes a transposing adder 6*b* which adds a keynote or related signal (e.g., chord root related to keynote through function) to a pitch output from an accompaniment pattern generator 6*a*.

With such prior art arrangement, the actual accompaniment pitch line moves up or down, or shifts vertically in response to a modulation (change of key) since the formed accompaniment pitches depend on keys. A shifting phenomenon is illustrated in the left staff E1 in FIG. 34A. In the illustration, the prior art accompaniment forming device element 6*a* generates an accompaniment pitch line of C→G→E→G for chord CM. Since the key C is represented by "0", the adder 6*b* output i.e., the actual accompaniment output has the same pitch line of C→G→E→G in the musical time of key C and chord CM. However, for the last chord GM in the above chord progression, the transposing adder 6*b* adds the determined key G (having value "7") to the element 6*a* output pitch line (G→G→E→G) so that the prior art accompaniment forming device produces a shifted pitch line G→D→B→D, as shown in the right measure of the staff E1. It is noted that the pitch line of G→D→B→D at the time of key G and chord GM (postmodulation pitch line) is up-transposed by perfect fifth from the premodulation pitch line C→G→E→G at the time of key C and chord CM. This is called "leap motion" or "range shift" in connection with the modulation. A similar leap motion also occurs between adjacent chords Am and DM in the mentioned chord progression.

Such leap motion phenomenon of the accompaniment is caused by modulation, and undesirable except when the music has such intention.

In accordance with the third aspect of the invention, this leap motion problem is essentially solved by the provision of a modulation compensator 6*c* which adjusts the accompaniment pitch line so as to compensate for the key difference between keys before and after a modulation (e.g., perfect fifth degree difference formed between keys C and G in the above example).

In FIG. 34A, the right staff E2 illustrates a compensated accompaniment. Here, the accompaniment pitch line C→G→E→G played at the time of the premodulation key C and chord CM is moved in a very smooth manner to the pitch line B→G→D→G played at the time of the postmodulation key G and chord GM.

The accompaniment forming device 6 having the modulation compensating feature, discussed in connection with FIG. 34A may take several forms in accordance with the invention.

A first embodiment of the modulation compensating accompaniment device comprises a combination accompaniment pattern memory which stores accompaniment patterns for respective combinations of key, chord function and type in a one-to-one correspondence manner. In operation, in response to a particular combination of key, chord function and type supplied from the tonality determining apparatus the accompaniment device selects and reads, from the combination accompaniment pattern memory, an accompaniment pattern corresponding to the supplied combination for accompaniment reproduction thereof. In this arrangement, the modulation compensating feature is realized by the combination accompaniment pattern memory since the stored accompaniment patterns are given those pitch lines or contents which compensate for key differences for respective combinations. However, this arrangement requires a large amount of storage for accompaniment.

Figure 34B:
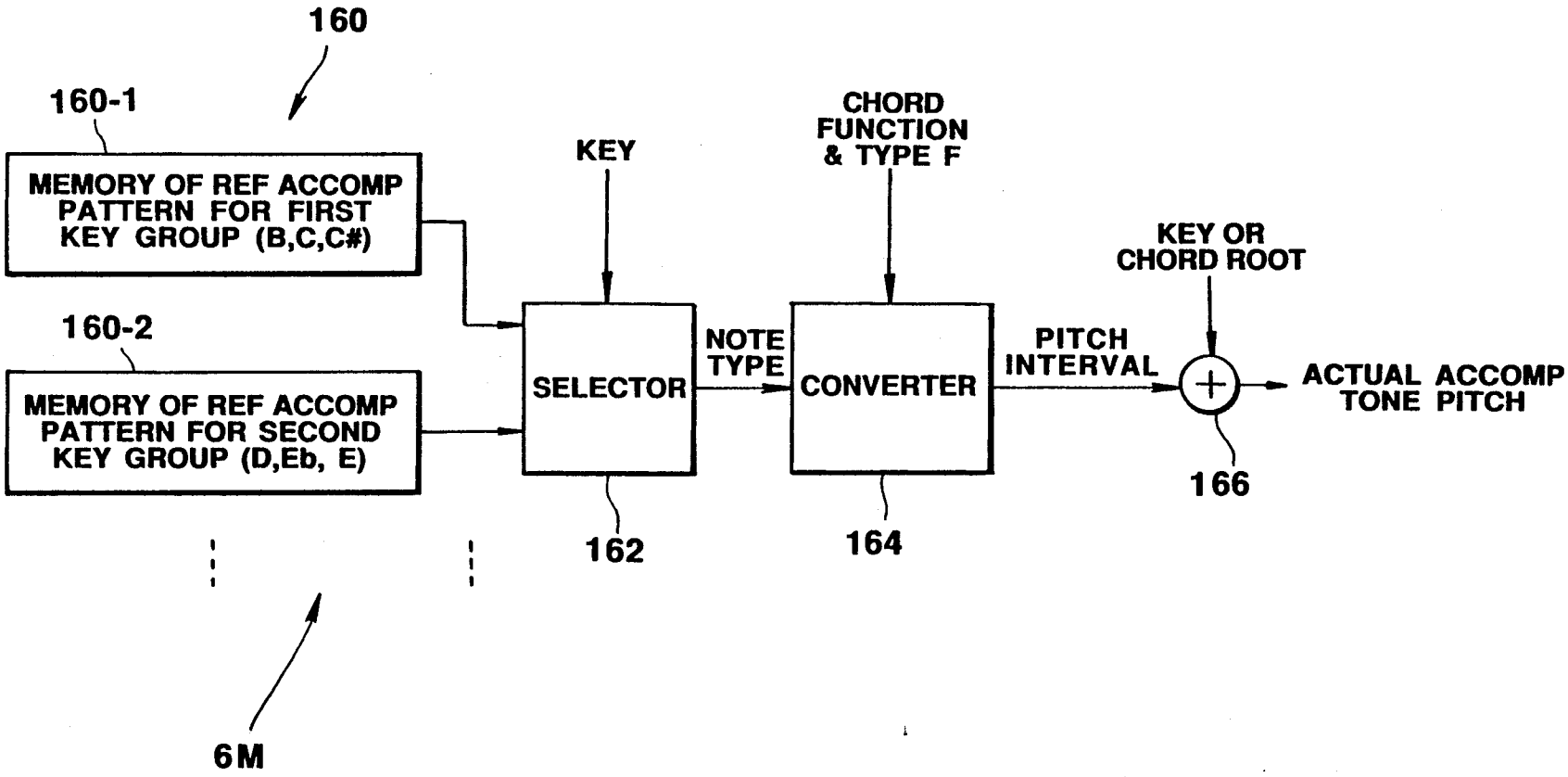
FIG. 34B is a functional block diagram of a modulation compensating feature.
Figure 34C:
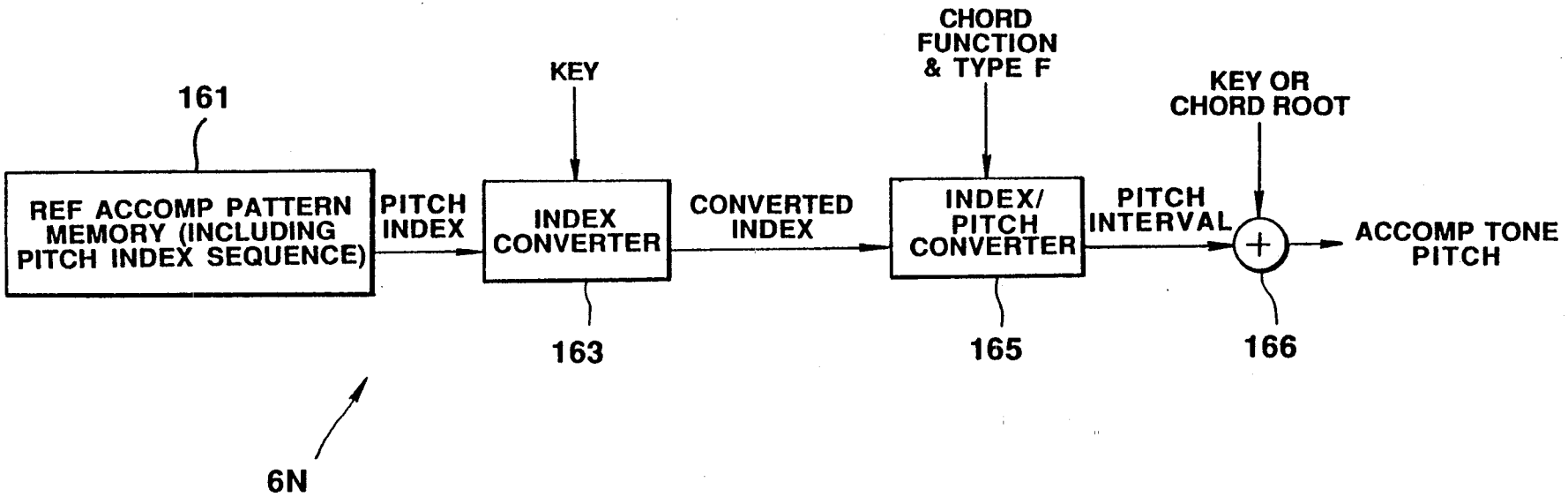
FIG. 34C is a functional block diagram of a modified modulation compensating feature.

FIGS. 34B and 34C show second and third embodiments of the modulation compensating accompaniment device.

The accompaniment forming device 6M of FIG. 34B comprises a key-group based reference accompaniment pattern memory 160 which stores accompaniment patterns grouped by key groups. Specifically, the memory 160 comprises a first memory 160-1 for storing a reference accompaniment pattern to be used for a first key group, a second memory 160-2 for storing a reference accompaniment pattern for a second key group, and so on. The term "key group" refers to a single key, or two or more adjacent keys. A selector 162 responds to a key KEY supplied from the tonality determining apparatus 4 and selects from the accompaniment pattern memory 160, a reference accompaniment pattern for a key group to which the supplied key KEY pertains. Suppose, for example, that the first key group is made up of keys B, C and C♯. If the supplied key KEY is C, then the first key group reference accompaniment pattern memory 160-1 is selected. A converter 164 receives each note type (pitch index) contained in the selected reference accompaniment pattern and converts it to pitch data indicative of a pitch interval from a keynote (or chord root) in accordance with a chord function and type F supplied from the tonality determining apparatus 4. An adder 166 adds the supplied key KEY (or chord root) to the converted pitch data, thus forming an actual accompaniment pitch.

With this arrangement, the modulation compensating feature is realized by the provision of reference accompaniment patterns for individual key groups each located within a narrow pitch range. Providing the key group reference accompaniment patterns with such pitch contents as compensating for the key pitch difference between key groups will avoid a leap motion in the accompaniment pitch line, caused by modulation.

The modulation compensating accompaniment device 6N of FIG. 34C includes a single reference accompaniment pattern memory 161 which stores a reference accompaniment pattern common to all keys. The reference accompaniment pattern contains a sequence of pitch indexes (note types). In the performance of the accompaniment, at each note-on time, the reference accompaniment pattern memory 161 outputs a pitch index of the note to be sounded. This pitch index is supplied to a first (index) converter 163. The index converter 163 converts the pitch index to a first converted index according to a key KEY supplied from the tonality determining apparatus. By this conversion, key differences are compensated or cancelled in the first converted index. A second converter 165 receives the first converted index and further converts it to a second converted index in accordance with a chord function and type F supplied from the tonality determining apparatus, thus obtaining pitch information appropriate for the supplied chord function and type F. The second converted index indicates a pitch interval from a keynote (or chord root). An adder 166 adds a current keynote (or chord root) from the tonality determining apparatus to the pitch interval to thereby produce an accompaniment pitch to be actually sounded.

In the third embodiment, the first converter 163 realizes the modulation compensating feature that adjusts the pitch range of the accompaniment without introducing any leap motion in the course of musical modulation.

Among the three embodiments, the first embodiment requires the largest amount of storage. The third embodiment requires the smallest amount of storage while assuring an accompaniment free of leap motion or pitch range shift.

The description now takes up two specific embodiments of an automatic accompaniment apparatus incorporating the modulation compensating feature. The two specific embodiments will be referred to as second and third specific embodiments.

Such specific embodiments may be implemented on the microcomputer based organization of FIG. 2 which has been described with respect to the first specific embodiment of the invention. The second specific embodiment is now described in detail.

For the implementation of the second specific embodiment, ROM 102 in FIG. 2 includes a combination accompaniment pattern memory which stores accompaniment patterns grouped by combinations of key and chord function name (function and type).

FIG. 35 exemplifies such a combination accompaniment pattern memory, showing pattern data partly. The illustrated data indicate three accompaniment patterns respectively used for C, D and A keys with the chord function I and type major (M). Actually, the combination accompaniment pattern memory stores accompaniment patterns for all keys and all chord functions, each pattern provided for different ones of the combinations of key, function and type. Each memory word comprises a pattern pitch element (e.g., C4) and a note on/-off bit. In FIG. 35, each accompaniment pattern has sixteen words defining a two-measure pattern. Thus, each word defines a musical time of an eighth note. The duration of a note is determined by a number of those words beginning with a word containing a note-on bit ON and ending with a word containing a note-off bit OFF.

Figure 36:
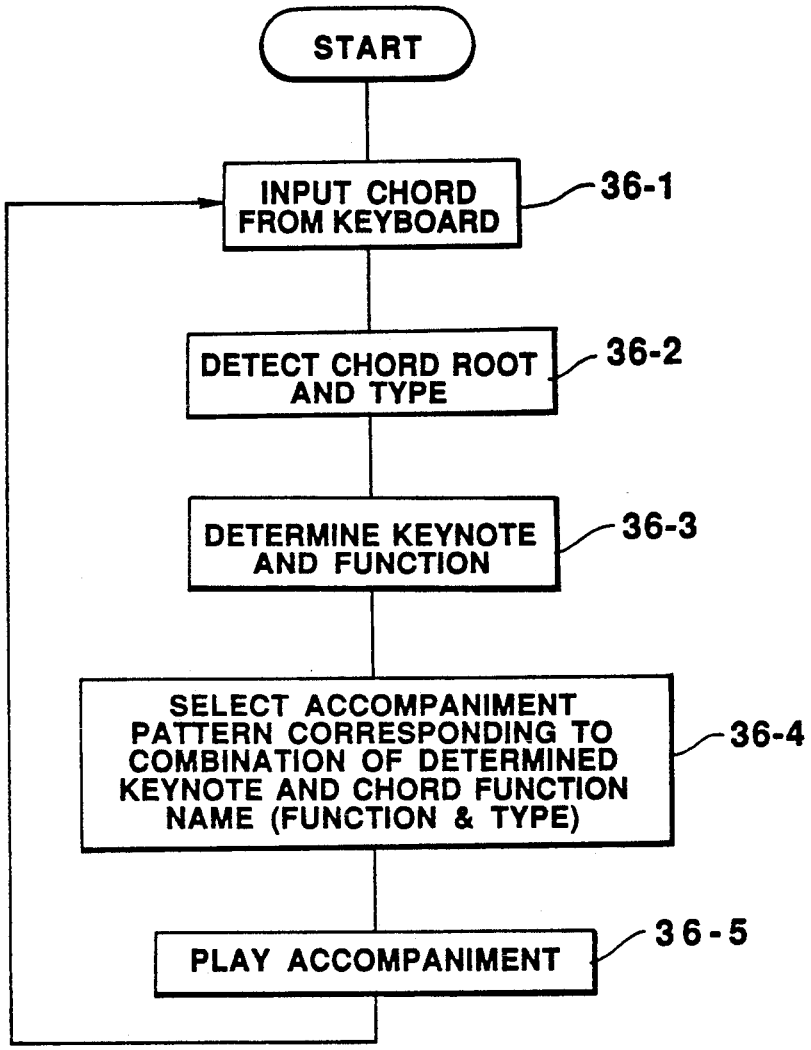
FIG. 36 is a flow chart illustrating the operation of the second embodiment incorporating the modulation compensating feature.

FIG. 36 is a flow chart showing the operation of the second specific embodiment.

CPU 100 receives, from the musical keyboard, depressed key information designating a new chord (36-1). Then CPU 100 detects a type and root of the newly designated chord in a conventional manner (36-2). Next, CPU 100 executes DETERMINE KEYNOTE & FUNCTION routine 36-3 to determine the keynote and function of the new chord.

Figure 37:
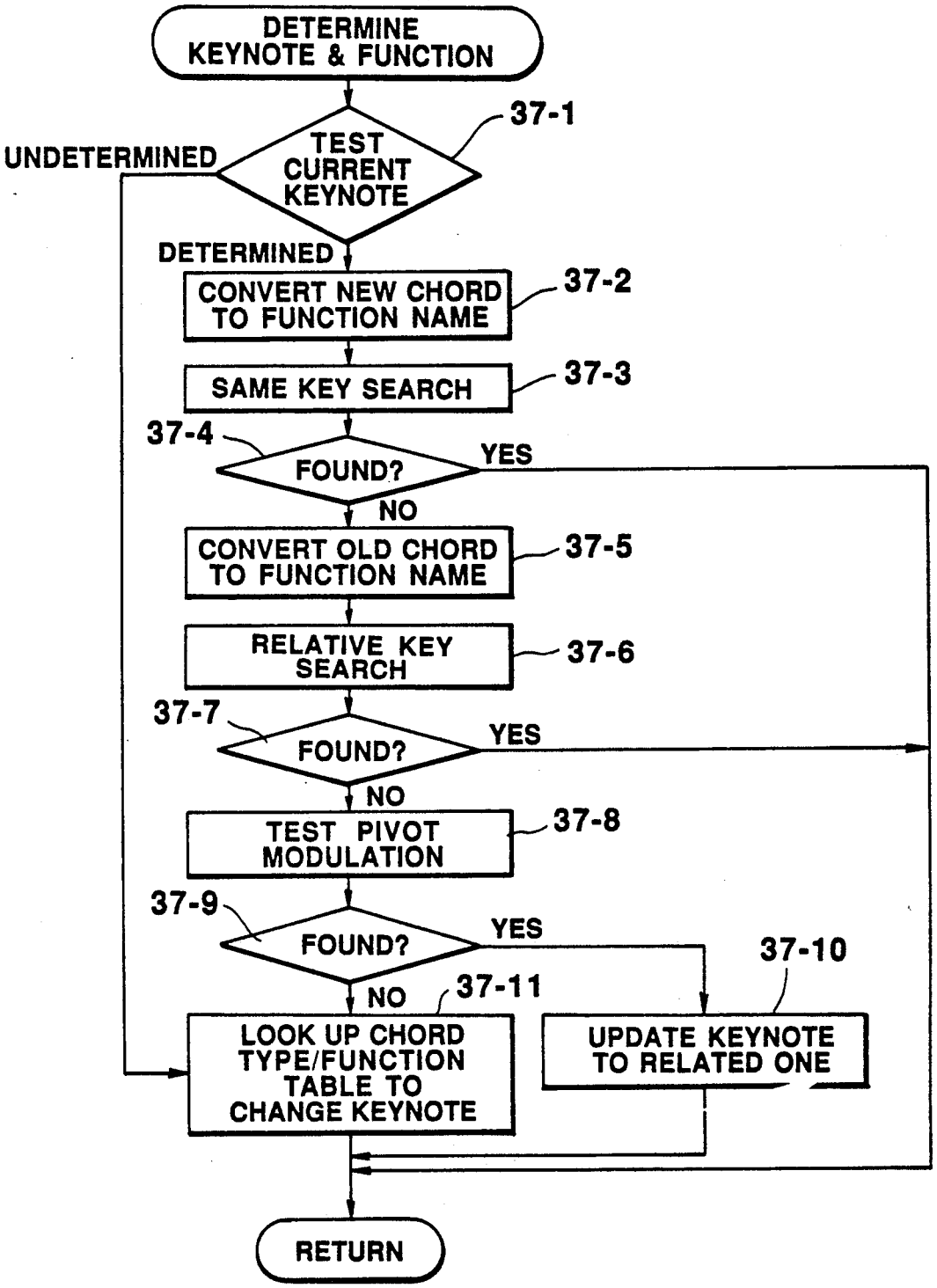
FIG. 37 is a flow chart of a determine keynote and function routine which may be used in the second to fifth embodiments of the invention.

FIG. 37 is a flow chart showing an example of the KEYNOTE & FUNCTION routine 36-3. If the current keynote has been determined (37-1), CPU 100 converts the new chord to a function name (function and type) according to the current keynote (37-2). Then CPU 100 executes SAME KEY SEARCH routine to search the same keynote keeping table (resided in ROM 102) for the function name of the new chord. If the same keynote keeping chord table includes an entry matching the new chord function name generated at step 37-2, step 37-4 yields YES. This means that the generated function name is correct and that the keynote of the new chord is the same as the current keynote. If the SAME KEY SEARCH routine has failed, CPU 100 converts the first preceding (old) chord to a function name by using the current keynote (37-5) and executes the RELATIVE KEY SEARCH routine, searching the relative key chord sequence table for the sequence of the old and new chord function names generated in steps 37-2 and 37-5. If the relative key chord sequence table contains an entry matching the generated function name sequence, step 37-7 yields YES. This means that the keynote and function of the new chord has been successfully determined. Thus, the DETERMINE KEYNOTE & FUNCTION routine returns to the main program. If such sequence has not been found (37-7), CPU 100 executes the PIVOT MODULATION TEST routine 37-8. This routine 37-8 generates several chord functions of the old chord with respect to several related keys to the current key assuming that the old chord is a pivot chord. Then the routine 37-8 searches the pivot modulation chord sequence table storing a set of chord sequences indicative of a modulation to see whether the table contains an entry matching one of the function name sequences of the old and new chord with respect to the several related keys. If a matching entry is found, step 37-9 yields YES. Then the step 37-10 is executed to update the current keynote to the appropriate related keynote associated with the matching entry. If no matching entry is found in the pivot modulation chord sequence table (37-9), or if the current keynote has not been determined (37-1), CPU 100 executes the direct conversion routine 37-11 in which the type/function converter table, resided in ROM 102 and storing correspondence between chord types and functions, is looked up to directly determine the keynote and function of the new chord.

In place of the flowcharted program of FIG. 37, the program shown in flow chart of FIG. 7 may be used as the DETERMINE KEYNOTE & FUNCTION routine 36-3 of FIG. 36 for the second or third specific embodiment of the invention.

Turning back to FIG. 36, after the keynote and function has been determined for the new chord, CPU 100 selects, from the combination accompaniment pattern memory (FIG. 35), an accompaniment pattern corresponding to and specified by the combination of the determined keynote and function name (function and type), as indicated in step 36-4. Then (36-5), CPU 100 reads the selected accompaniment pattern and controls the tone generator 108 based on the selected accompaniment pattern, thus playing an accompaniment. Actually, the PLAY ACCOMPANIMENT routine 36-5 is a time process which is repeated periodically per musical resolution time. Each time when a predetermined amount of time has elapsed, CPU 100 reads the next word from the indicates a note-on event, CPU 100 uses the pitch data contained therein to send a note-on command to the tone generator 108. If the word indicates a note-off command, CPU 100 sends a note-off command including the pitch data of the word to the tone generator 108 which thus releases the corresponding accompaniment tone.

Figure 38:
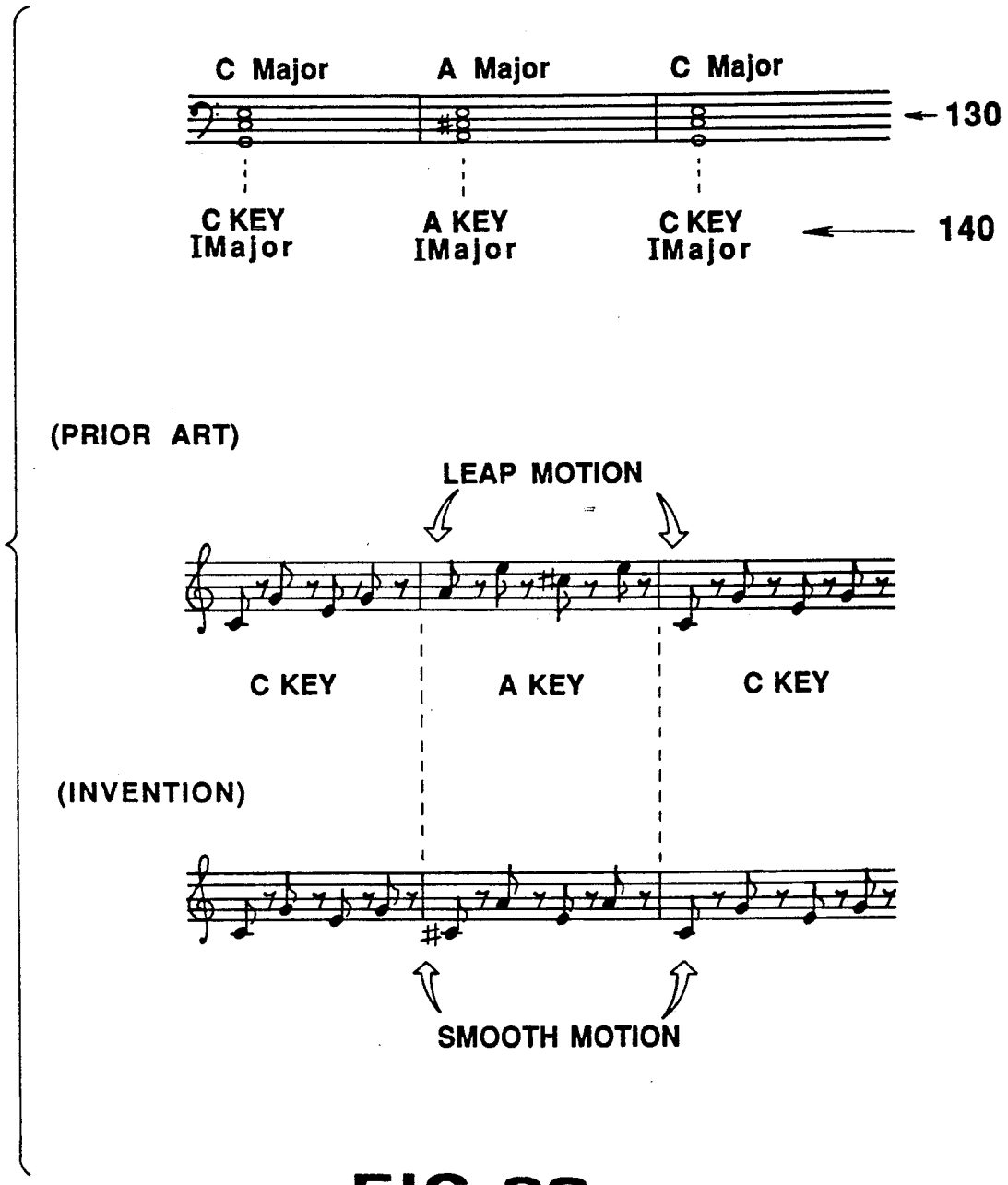
FIG. 38 are staves showing operation of and results from the modulation compensating feature of the invention in comparison with those from the prior art.

FIG. 38 illustrates the function and results of the modulation compensating feature built in the second and third specific embodiments of the invention in comparison with those of the prior art.

As indicated in the top staff 130 of FIG. 38, the musical keyboard enters a chord progression of C Major, A Major and C Major. In response to this chord progression, the DETERMINE KEYNOTE & FUNCTION routine 36-3 determines key C for the first chord C Major, key A for the second chord A Major and Key C for the third chord C Major, as denoted by 140. Thus, modulation (change of key) occurs in this example, from key C to A and then back to C. From this tonality analysis, the prior art accompaniment device forms an accompaniment having a leap motion comparable to the key difference, as indicated in the middle staff of FIG. 38. Whereas the accompaniment pitch line in the first keynote C time interval is C→G→E→G, the line in the second keynote G is A→E→C#→E, thus introducing a leap motion in the accompaniment pitch range. A reverse leap motion is observed when the second keynote A is changed to the third keynote C. The leap motion of this kind is undesirable except when the music has the special intension.

In contrast, in accordance with the modulation compensating feature of the invention, the accompaniment forming device of the second and third specific embodiments maintains a smooth stream in the pitch line or range of the accompaniment even if the music experiences modulation, as demonstrated in the bottom staff of FIG. 38. In the illustration, the first key C time interval has a pitch line of C→G→E→G which is smoothly led to C#→A→E→A in the second or postmodulation key G time interval. A similar smooth voice-leading is also assured when the music changes back to the key C from A.

Since the second specific embodiment employs the combination accompaniment pattern memory storing accompaniment patterns each for different ones of the combinations of keynote, chord function and type, it is possible to prepare the desired pitch line and rhythm of accompaniment for each combination independently from each other. Thus the accompaniment forming device of the second specific embodiment may form an accompaniment pitch line of, say, A→C#→A#→E for the second key A in place of the illustrated line of C#→A#→E#→A.

However, the use of the combination accompaniment pattern memory requires a large amount of storage capacity. A typical automatic accompaniment apparatus is arranged to play a plurality of (e.g., three) accompaniment parts with respect to each of plural (e.g., 20) musical styles. In addition, each accompaniment part includes distinct segments such as introduction, normal, fill-in and ending. If this accompaniment capacity applies to the second specific embodiment, it requires as many as 7200 accompaniment patterns, as readily computed from the musical style number (20)×part number (3)×chord function name number (here 30)×segment number (4).

A modified automatic accompaniment apparatus, which is arranged to save the storage capacity, makes the stored accompaniment pattern data common to all chord functions and types. The commonly-used accompaniment pattern is called reference accompaniment pattern. A pitch change table memory is provided to adapt (modify) the reference accompaniment pattern to respective chord functions and types. The use of the pitch change table in combination with the reference accompaniment pattern memory requires only a fraction (1/chord function name number 30) of the storage capacity of the combination accompaniment pattern memory of the second specific embodiment.

FIG. 39 illustrates a pitch change table, designated PCH[11]. The table PCH[11] may reside in ROM 102 and returns pitch change data when looked up by a pitch index (note type) from the reference accompaniment pattern memory and a determined function name.

The returned pitch change data indicates a pitch interval from a stored reference pitch associated with the pitch index. Adding the pitch interval to the reference pitch results in the goal pitch i.e., the actually played accompaniment pitch.

Figure 40:
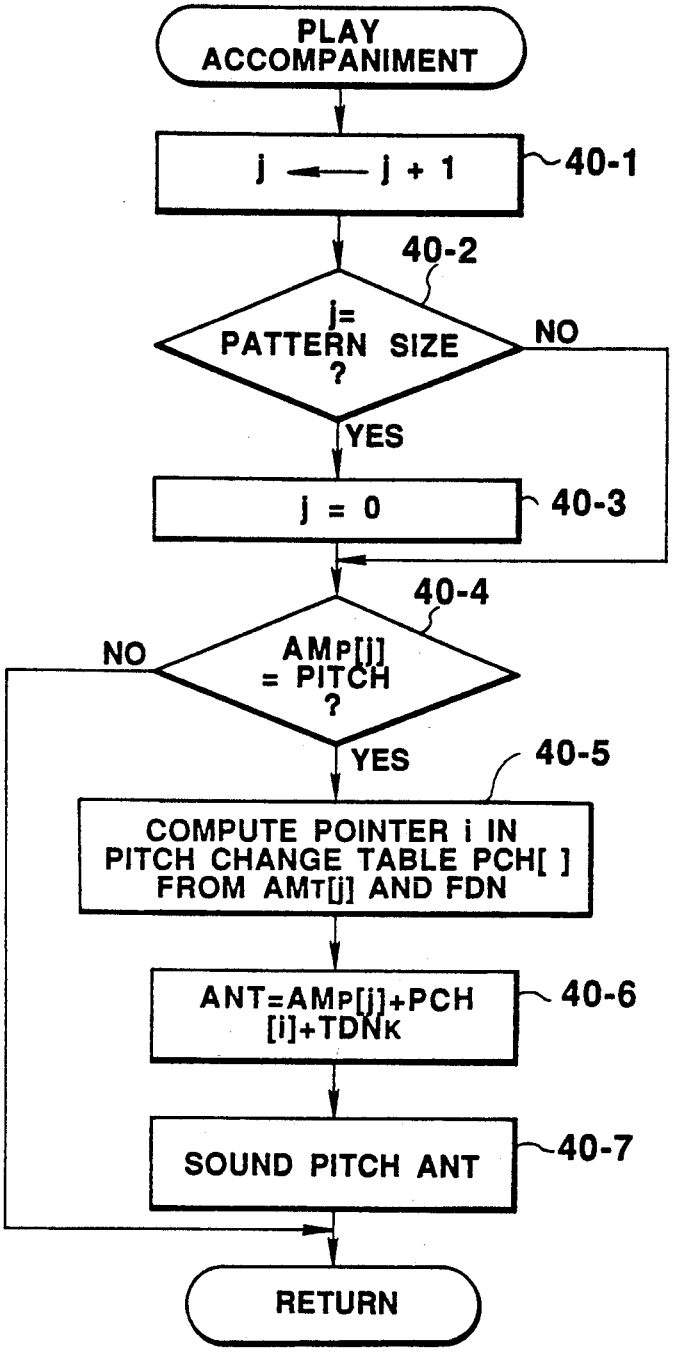
FIG. 40 is a flow chart of a play accompaniment routine which may utilize the pitch change table shown in FIG. 39 and the accompaniment pattern memory shown in FIG. 35.

FIG. 40 is a flow chart of a PLAY ACCOMPANIMENT routine of the modified automatic accompaniment apparatus. Steps 40-1 to 40-3 locate the next element is the selected reference accompaniment pattern. Specifically, address pointer j is incremented (40-1). If j has become equal to the pattern size (40-2), j is reinitialized to "0" pointing to the first element of the selected accompaniment pattern. Step 40-4 tests the pitch data $AM_p[j]$ contained in the located pattern element (word) to see whether it is a note-on event. If detected a note-on event, the PLAY ACCOMPANIMENT routine executes step 40-5 to compute pointer i in the pitch change table PCH[11] from the pitch index $AM_7[j]$ contained in the pattern word and the current function name FDN determined in the DETERMINE KEYNOTE & FUNCTION routine. The next step 40-6 computes data ANT indicative of an actual accompaniment pitch by:

$$ANT = AM_p[j] + PCH[i] + TDN_k$$

That is, the reference pitch $AM_p[j]$ is added to the pitch interval or difference data PCH[il from the pitch change table, and further added to the current keynote (pitch class) from the DETERMINE KEYNOTE & FUNCTION routine. Finally (step 40-7), CPU 100 sends the tone generator 108 a note-on command including the pitch data ANT so that the tone generator 108 generates an accompaniment tone of pitch ANT.

The third specific embodiment of the invention is now described.

Figure 41:
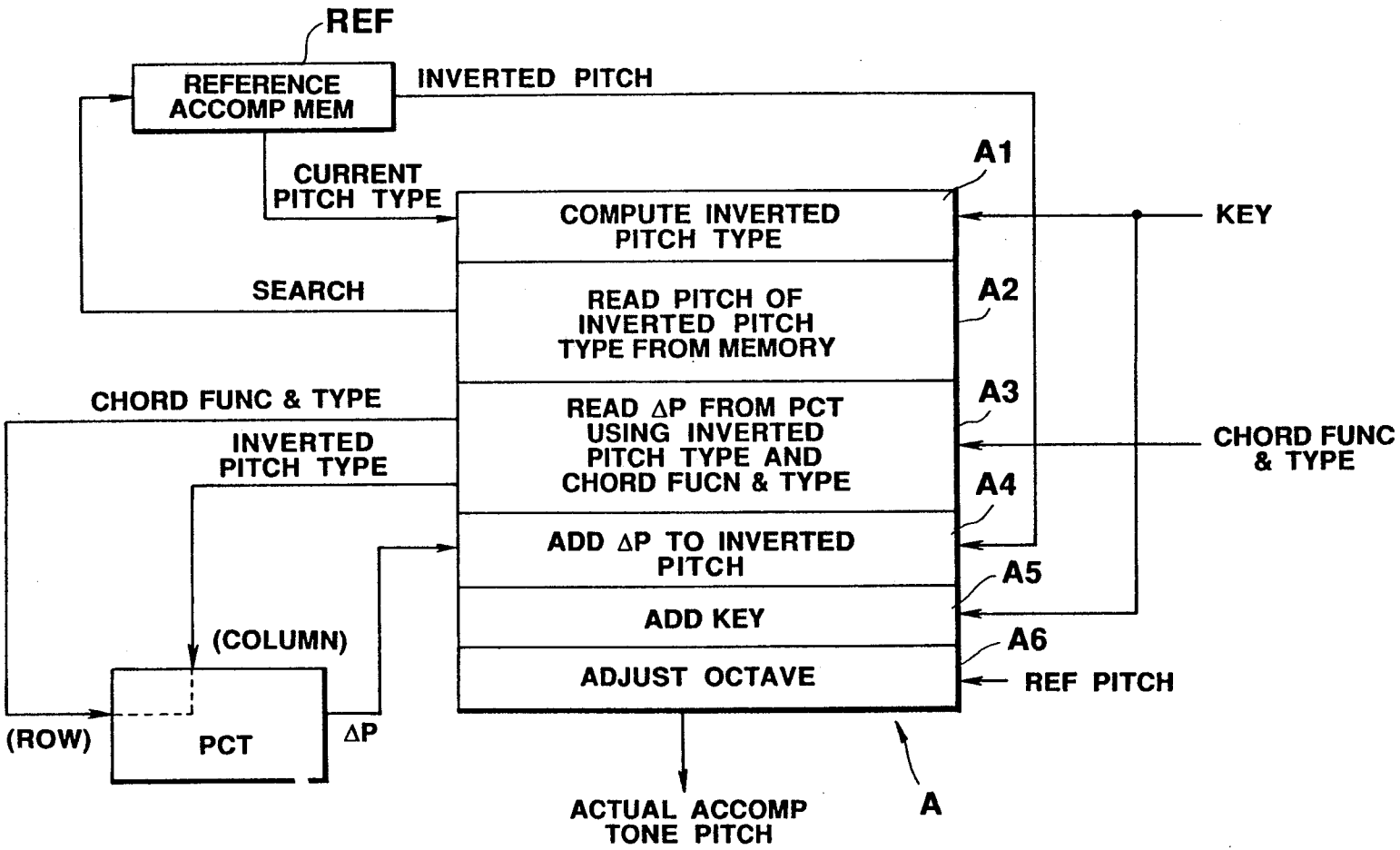
FIG. 41 is a functional block diagram of an accompaniment forming device with modulation compensating feature in accordance with the third embodiment of the invention.

FIG. 41 is a functional block diagram of a modulation compensating accompaniment forming device built in the automatic accompaniment apparatus of the third specific embodiment.

In FIG. 41, the reference accompaniment pattern memory REF stores a reference accompaniment pattern. The reference accompaniment pattern represents a pitch pattern by a sequence of paired data items of reference pitch and note type (pitch index). The pitch change table PCT is essentially identical with the pitch change table PCH[11] of FIG. 39, and returns pitch difference data ΔP when looked up by a note type (first argument), and a chord function and type (second argument).

The arrangement of FIG. 41 includes a pitch decoding module A for the realization of the modulation compensating feature. The pitch decoding module A uses the reference accompaniment pattern memory REF, pitch change table PCT and tonality information (key, chord function and type) from the tonality determining apparatus to produce actual accompaniment pitches. The pitch decoding module A may be constructed by submodules A1–A6 which operates sequentially in the order of A1–A6. The first submodule A1 reads a current pitch type from the reference accompaniment pattern memory REF and modifies it depending on a supplied key KEY from the tonality determining apparatus to thereby compute an inverted pitch type. The second submodule A2 searches the reference accompaniment pattern memory REF for the inverted pitch type and reads pitch data (called inverted pitch data) associated with the inverted pitch type. The inverted pitch data is supplied to the fourth submodule A4. The third submodule A3 looks up the pitch change table memory PCT at the address specified by the combination of the inverted pitch type from the first submodule A1, and the chord function and type from the tonality determining apparatus to retrieve the corresponding pitch difference data ΔP. The fourth submodule A4 adds the retrieved pitch difference data ΔP to the inverted pitch read by the second submodule A2 from the reference accompaniment pattern memory REF. The added result is supplied to the fifth submodule A5 which further adds to it the supplied key KEY from the tonality determining apparatus. The resultant pitch data (inverted pitch + ΔP + KEY) is then passed to the sixth submodule A6. The sixth submodule A6 adjusts the octave of the pitch data from the fifth submodule A5, thus forming an actual accompaniment pitch. This octave adjustment can be accomplished by using a reference pitch. Specifically, the submodule A6 compares the pitch data (inverted pitch + ΔP + KEY) with the reference pitch to compute the difference. If the difference is greater than a predetermined interval (e.g., ½ octave), the submodule A6 raises or lowers the pitch data by one octave in a direction of reducing the difference. If the computed difference is small enough, no octave adjustment is needed so that the pitch data from the submodule A5 directly indicates an actual accompaniment pitch.

The pitch decoding module A stated above may be implemented on the microcomputer organization of FIG. 2 by a pitch decoding program built in ROM 102 and CPU 100 executing it.

FIG. 42 illustrates a table of computation formulae, designated KPM, according to which the pitch decoding module A computes actual accompaniment pitches.

In the formula table KPM, k1, k2 and k3 each indicates a current pitch type PMN to be supplied from the reference accompaniment pattern memory REF. The table rows C(O), C♯(1), D(2), E♭(3), E(4), F(5), F♯(6), G(7), A♭(8), A(9), B♭(10) and B(11) indicate all possible keys KEY from the tonality determining apparatus. A table item at the intersection of a column (e.g., k1 column) and a row (e.g., C(O) row) shows a computation formula for computing an actual accompaniment pitch for the combination of the current pitch type and the key. For example, for the combination of the current pitch type k1 and the key C, the computing formula PNT + PCT(CCM)(PMN) is shown. In each computing formula, PNT indicates a current reference pitch from the reference accompaniment pattern memory REF, PNT(ki) indicates the reference pitch of pitch type ki, PCT(x)(y) indicates pitch difference data for the combination of chord function name x and pitch type y, and CCM indicates a current chord function name from the tonality determining apparatus.

Figure 46:
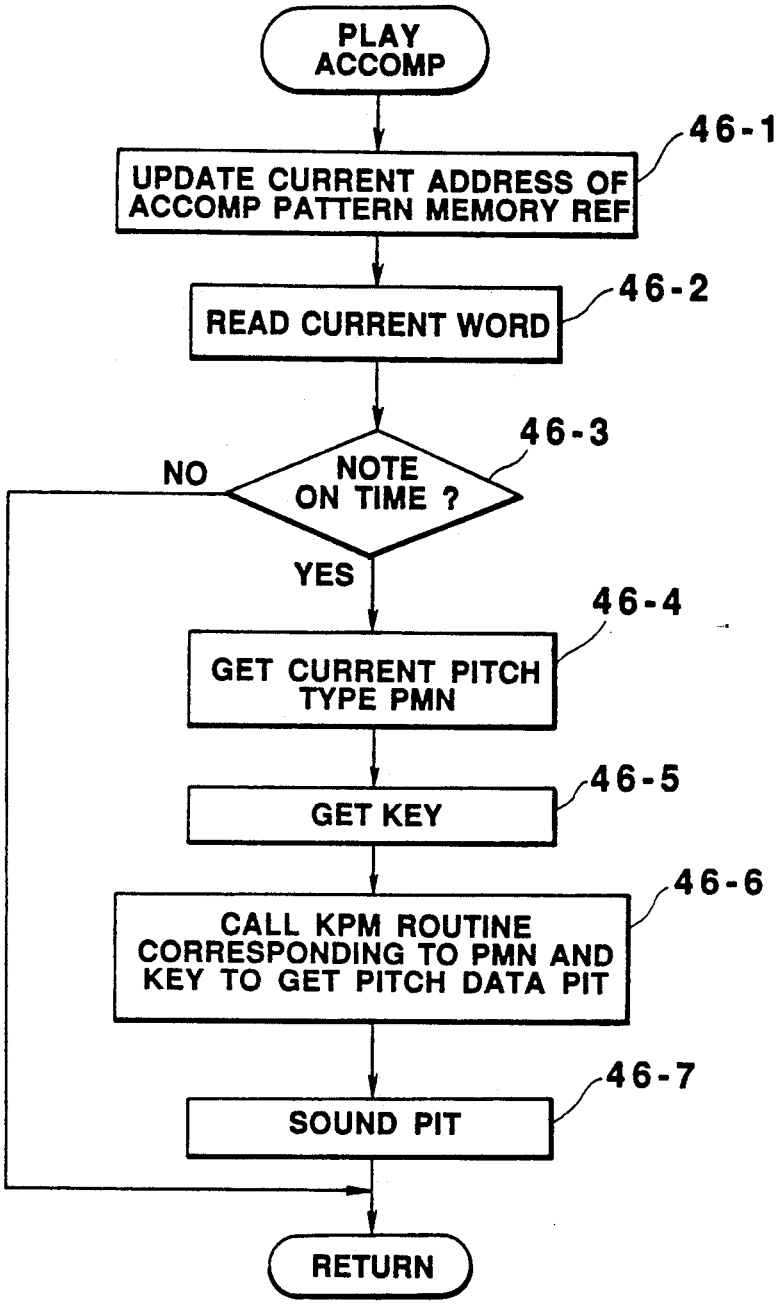
FIG. 46 is a flow chart of a play accompaniment routine, showing the operation of the third embodiment.

Direct implementation of the pitch formula table KPM is to provide ROM 102 with a plurality of computing subroutines each for performing different one of the computing formulae in FIG. 42. The PLAY ACCOMP routine of FIG. 46 is arranged to selectively call one of the computing subroutines for the accompaniment performance. A current pitch type PMN and a current key KEY specify the computing subroutine to be called.

FIG. 43 illustrates the pitch change table memory PCT to be looked up by the formula table KPM.

Figures 44, 45:
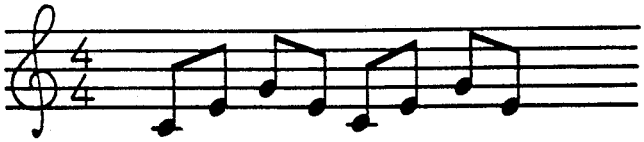
FIG. 44 is a staff of an accompaniment pattern.
FIG. 45 illustrates an accompaniment pattern memory useful in the third embodiment and storing coded data of the accompaniment pattern shown in FIG. 44.

FIG. 44 is a staff illustrating a reference accompaniment pattern.

FIG. 45 shows the reference accompaniment pattern memory REF in which the reference accompaniment pattern of FIG. 44 has been coded.

FIG. 46 is a flow chart of a PLAY ACCOMP routine executed by CPU 100. This routine is called each time when a musical resolution time has elapsed.

At first (46-1), CPU 100 updates the current address in the reference accompaniment pattern memory REF, corresponding to the current time. Then (46-2), CPU 100 reads a current word stored at the updated current address. Next (46-3), CPU 100 tests the current word to see whether it is a note-on time event. If so, CPU 100 gets a current pitch type PMN contained in the current word (46-4). Then (46-5) it calls a KPM (formula computing) subroutine specified by PMN and KEY, so that the called subroutine is executed and returns pitch data PIT indicative of an actual accompaniment pitch. Finally (46-7), CPU 100 sends a note-on command including the pitch data PIT to the tone generator 108 which thus generates an accompaniment tone having the pitch PIT.

In this manner, the automatic accompaniment apparatus of the third specific embodiment successfully avoids a leap motion in the accompaniment due to a modulation while at the same time saving storage. The key role of solving the leap motion problem is played by the pitch type modifying submodule A1 discussed in connection with FIG. 41. The submodule A1 modifies a current reference pitch from the reference accompaniment pattern memory into the appropriate one for the current keynote in such a manner that the pitch difference between the keys before and after the modulation will be compensated or cancelled in the actually played accompaniment line.

Various modifications of the second or third specific embodiments will be obvious to one of ordinal skill in the art. For example a modified automatic accompaniment apparatus includes a mode select input device which allows a user to select in advance either a first mode of operation in which a modulation does not introduce a leap motion in the accompaniment or a second mode in which a modulation introduces an intended leap motion in the accompaniment. The selected mode is stored in a mode flag. In the operation of automatic accompaniment, the apparatus examines the mode flag. If the first mode (leapless mode) has been selected, the apparatus forms an accompaniment in the manner described above. However, if the second mode has been selected, the apparatus does not modify the current reference pitch type read from the reference accompaniment pattern but uses it directly to look up the pitch change table, getting the pitch difference data which is then added to the current reference pitch associated with the current pitch type, and added to a current key. This will introduce an intended leap motion in the accompaniment.

Figure 47:
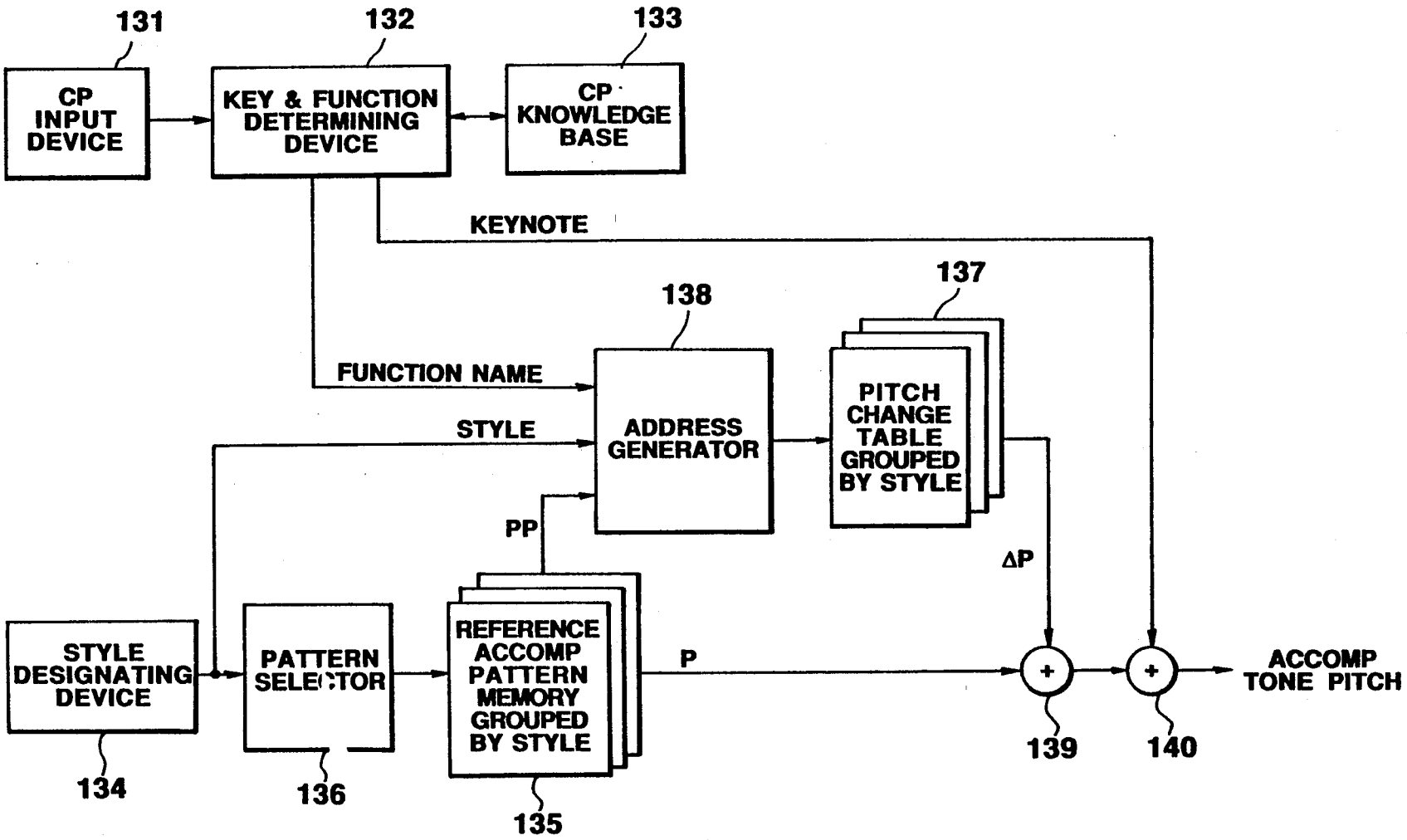
FIG. 47 is a functional block diagram of an automatic accompaniment apparatus in accordance with the fourth aspect of the invention.

FIG. 47 is a functional block diagram of an automatic accompaniment apparatus capable of providing natural and realistic accompaniment of various musical styles with a minimum of storage capacity in accordance with the fourth aspect of the invention.

In FIG. 47, the chord progression input device 131 enters a chord progression in which each chord is represented by a root and a type. The key and function determining device 132 receives the chord progression and analyzes it by applying musical knowledge stored in the chord progression (CP) knowledge base 133 to thereby determine the chord function name (function and type) and keynote of each chord in the chord progression. The style input device 134 designates a desired musical style of accompaniment. In accordance with the invention, there is provided a style-grouped accompaniment pattern memory 35 which stores reference accompaniment patterns grouped by musical styles. A pattern selector 136 receives the designated style and selects, from the style-grouped accompaniment pattern memory 35, an accompaniment pattern corresponding to the designated style of accompaniment. An pitch element contained in the selected accompaniment pattern is denoted by "P." A pointer index, denoted PP is associated with each pitch element P in the accompaniment pattern. Further in accordance with the invention, there is provided a style-grouped pitch change table 137 which stores pitch change data ΔP grouped by musical styles to modify the reference pitch P from the accompaniment pattern memory in accordance with the designated style. Each pitch change data item in the style-grouped pitch change table 137 is specified by a combination of style, function name and pointer index. Thus, an address generator 138 receives the chord function name from the key and function determining device 132, the designated style from the style input device, and the pointer index PP (associated with the reference pitch P to be modified) from the style-grouped reference accompaniment pattern memory 135, and generates (computes), from the received data combination, an address location storing a pitch change data item ΔP corresponding to the combination. The addressed pitch change data item ΔP is added by an adder 139 to the reference pitch P in the selected accompaniment pattern. The adder 139 output is further added by a transposing adder 140 to a keynote from the key and function determining device 132, thus forming an actual accompaniment pitch.

The use of style-grouped pitch change table 137 cooperative with the style-grouped reference accompaniment pattern memory 135 makes it possible to provide realistic accompaniments enriched with a plenty of variations and desired pitch contents optimized to respective musical styles while at the same time saving the amount of stored data.

If the memories 135 and 137 were replaced by a combination-grouped accompaniment memory storing accompaniment patterns grouped by combinations of function name and style, this would require a vast amount of data. For example, for a total of 20 function names and 40 styles, 800 groups of accompaniment patterns are required. Suppose that the accompaniment is made up of four (instrumental) parts, and that each part uses four variations i.e., introduction pattern to be played at the beginning of music, normal pattern normally played, fill-in pattern played at the fill-in time, and ending pattern played at the ending of music. Then each accompaniment pattern group is made up of 16 accompaniment patterns. Suppose that the average amount of data of each pattern is $\frac{1}{4}$K bits. Then the total accompaniment data amounts to more than 3 megabits as seen from the computation $\frac{1}{4} \times 16 \times 800 = 3200$K bits). It is unfeasible to implement, on a one-chip microcomputer, the accompaniment system with this large storage capacity.

In contrast, with the arrangement of FIG. 47, the style-grouped reference accompaniment memory 135 requires only 40 accompaniment pattern groups, and the style-grouped pitch change table requires only 40 pitch change data sets, one for one musical style.

A specific embodiment of the automatic accompaniment apparatus incorporating the features discussed in connection with FIG. 47 will now be described. This embodiment will be referred to as the fourth specific embodiment.

The fourth specific embodiment may be implemented on the microcomputer-based organization of FIG. 2 which has been described with respect to the first specific embodiment of the invention. For the implementation of the fourth specific embodiment, the input device 106 includes a style select switch. ROM 102 stores appropriate programs including the main program (shown in flow chart of FIG. 48) and the time interrupt routine (shown in flow chart of FIG. 49). ROM 102 also stores permanent data including those for the style-grouped reference pattern memory AM[11] (FIG. 51) and the style-grouped pitch change table PCT(FIG. 52). In other respects, the earlier description of FIG. 2 for the first specific embodiment applies to the fourth specific embodiment so that further description is omitted.

Figure 48:
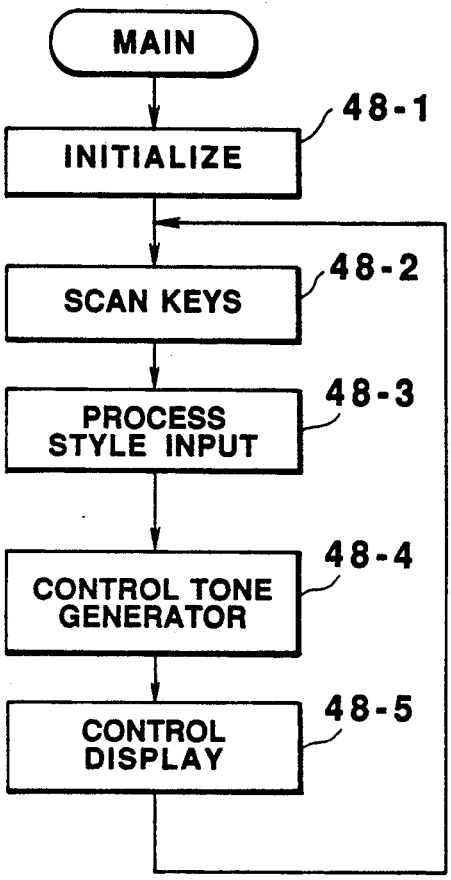
FIG. 48 is a flow chart of a main program executed by CPU 100 in FIG. 2 for the implementation of the fourth and fifth embodiments of the invention.

FIG. 48 is a flow chart of the main program executed by CPU 100 in accordance with the fourth specific embodiment. Upon power-on, CPU 100 initializes the system (step 48-1). In the main loop at step 48-2, CPU 100 scan the keys of the input device 106. If a style select key has been operated, CPU 100 processes the style input at step 48-3. If the melody keyboard has been played, CPU 100 controls the tone generator 108 to produce a melody tone associated with the operated melody key (48-4). At step 48-5, CPU 100 controls the display device 114 to display appropriate data and message.

Figure 49:
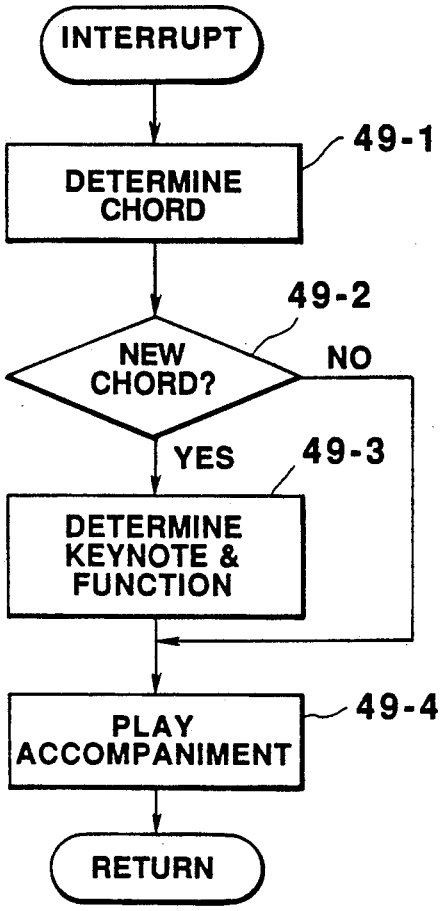
FIG. 49 is a flow chart of a time interrupt routine executed by CPU 100 in FIG. 2 for the implementation of the fourth and fifth embodiments of the invention.

FIG. 49 is a flow chart of a time interrupt routine of the fourth specific embodiment. This routine is periodically executed by CPU 100 in response to a time-out interrupt request signal from the timer 112, indicative of elapse of a predetermined time (i.e., musical resolution time). At step 49-1, CPU 100 examines the accompaniment key information (acquired in the key scan 48-2) to detect a type and root of the designated chord in a conventional manner. If a new chord has been detected (49-2), CPU 100 executes the DETERMINE KEYNOTE & FUNCTION routine 49-3 to determine the new chord function and keynote. This routine 49-3 may be identical with either the routine of FIG. 37 already described with respect to the second specific embodiment, or the routine of FIG. 7 described earlier for the first specific embodiment of the invention. Then CPU 100 executes a PLAY ACCOMPANIMENT routine 49-4 to thereby form accompaniment data based on the selected musical style and determined current chord function and keynote, and control the tone generator 108 accordingly to generate an accompaniment tone.

Figure 50:
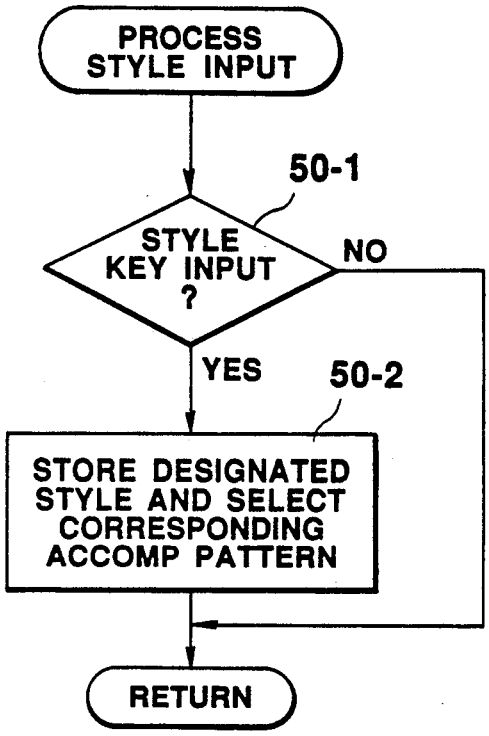
FIG. 50 is a flow chart of a process style input routine in accordance with the fourth embodiment of the invention.

FIG. 50 is a flow chart of the process style input routine 48-3. If a style key input has been detected (50-1), CPU 100 stores a selected musical style number specified by the style key input, and selects a corresponding accompaniment pattern (or pattern group) from the style-grouped accompaniment pattern memory AM[11].

FIG. 51 illustrates the style-grouped accompaniment pattern memory AM[11]. The memory AM[11] resides in ROM 102. The style-grouped accompaniment pattern memory AM[11] stores accompaniment data sets each written in reference keynote C and reference chord function name I Major and used for a different one of the musical styles. Actually, each accompaniment data set comprises a plurality of accompaniment parts, each part having four individual patterns of introduction, fill-in, normal and ending. However, for simplicity, FIG. 51 shows a single accompaniment pattern. Each accompaniment pitch element $AM_p$ is linked to a pointer $AM_t$ for selecting a column of the style-grouped pitch change table. The selected musical style from the style key locates an area of the style-grouped accompaniment pattern memory AM[11] where the accompaniment data set of that style are stored.

FIG. 52 illustrates the style-grouped pitch change table PCT residing in ROM 102. A row of the style-grouped pitch change table indicates a combination of musical style and function name. A particular combination locates a specific row. A column of the style-grouped pitch change table PCT is located by a pointer $AM_t$ from the style-grouped accompaniment pattern memory AM[11]. At the intersection of each row and column, there is stored pitch difference data for modifying a pitch from the style-grouped accompaniment pattern memory AM[11]. For example, with style "1" and chord function name "Major V" the pitch difference data items "−1", "−2", "−2" and "−2" stored at columns 0–3 of PCT are used to modify pattern pitch elements associated with pointers 0–3, respectively. Here the data "−1" indicates lowering the pitch by one semitone, and "−2" lowers by two semitones.

The style-grouped pitch change table PCT discussed above serves to realize the actual accompaniment with pitch contents optimized to respective musical styles while at the same time minimizing the amount of data required for the forming of the accompaniment.

Figure 53:
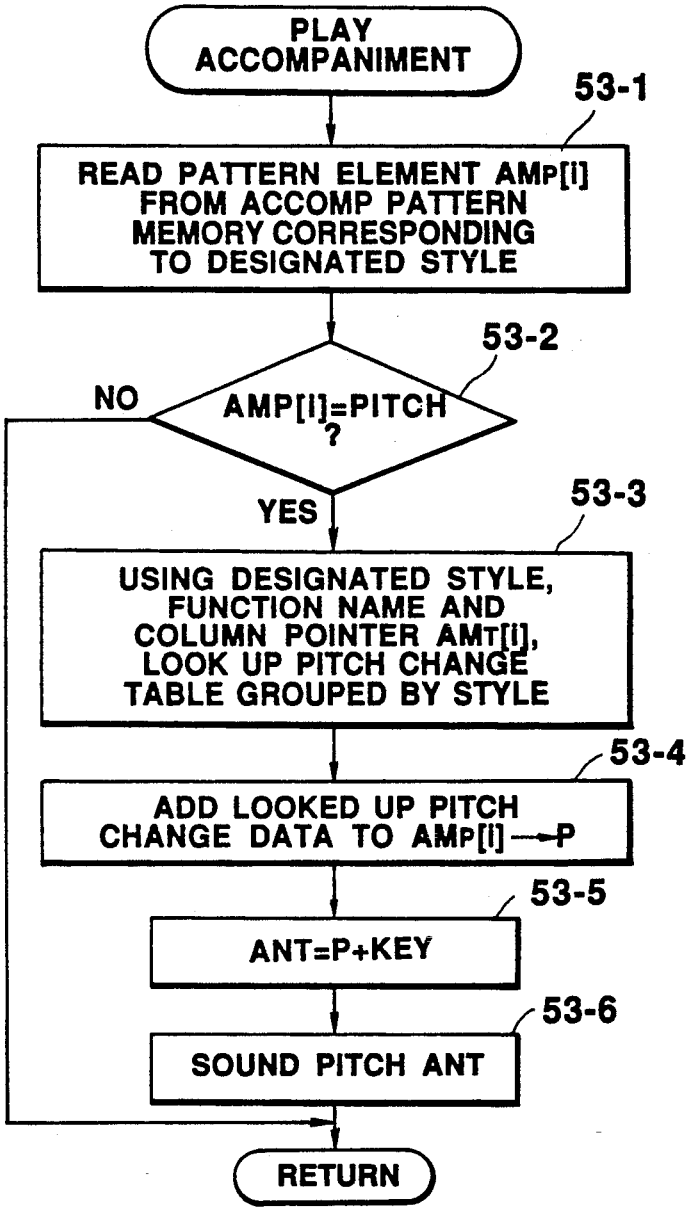
FIG. 53 is a flow chart of a play accompaniment routine which may utilize the style-grouped accompaniment pattern memory in FIG. 51 and the style-grouped pitch change table memory in FIG. 52 in accordance with the fourth embodiment.

FIG. 53 is a detailed flow chart of the PLAY ACCOMPANIMENT routine 49-4, showing the operation of the fourth specific embodiment.

At first (53-1), CPU 100 reads, from the selected accompaniment pattern memory AM[11] specified by the selected musical style, a pattern element $AM_p[i]$ to be processed. If the pattern element indicates a pitch (53-2), CPU 100 executes step 53-3 to locate a particular row of the style-grouped pitch change table PCT by the selected style and the current chord function name, locates a specific column of PCT by the pointer $AM_t[i]$ linked to the pitch element, and reads the pitch change data specified (addressed) by the row and column. Then (53-4) CPU 100 adds the read pitch change data to the pitch data $AM_p[i]$, thus obtaining a modified pitch P suitable for keynote C, selected style and current chord function name. Further (53-5), CPU 100 adds the current keynote to the pitch P to obtain the final pitch data ANT indicative of an actual accompaniment pitch. Finally (53-6), CPU 100 sends a note-on command containing the actual pitch data ANT to the tone generator 108 which thus generates a corresponding accompaniment tone of pitch ANT.

This concludes the description of the fourth specific embodiment.

Figure 54:
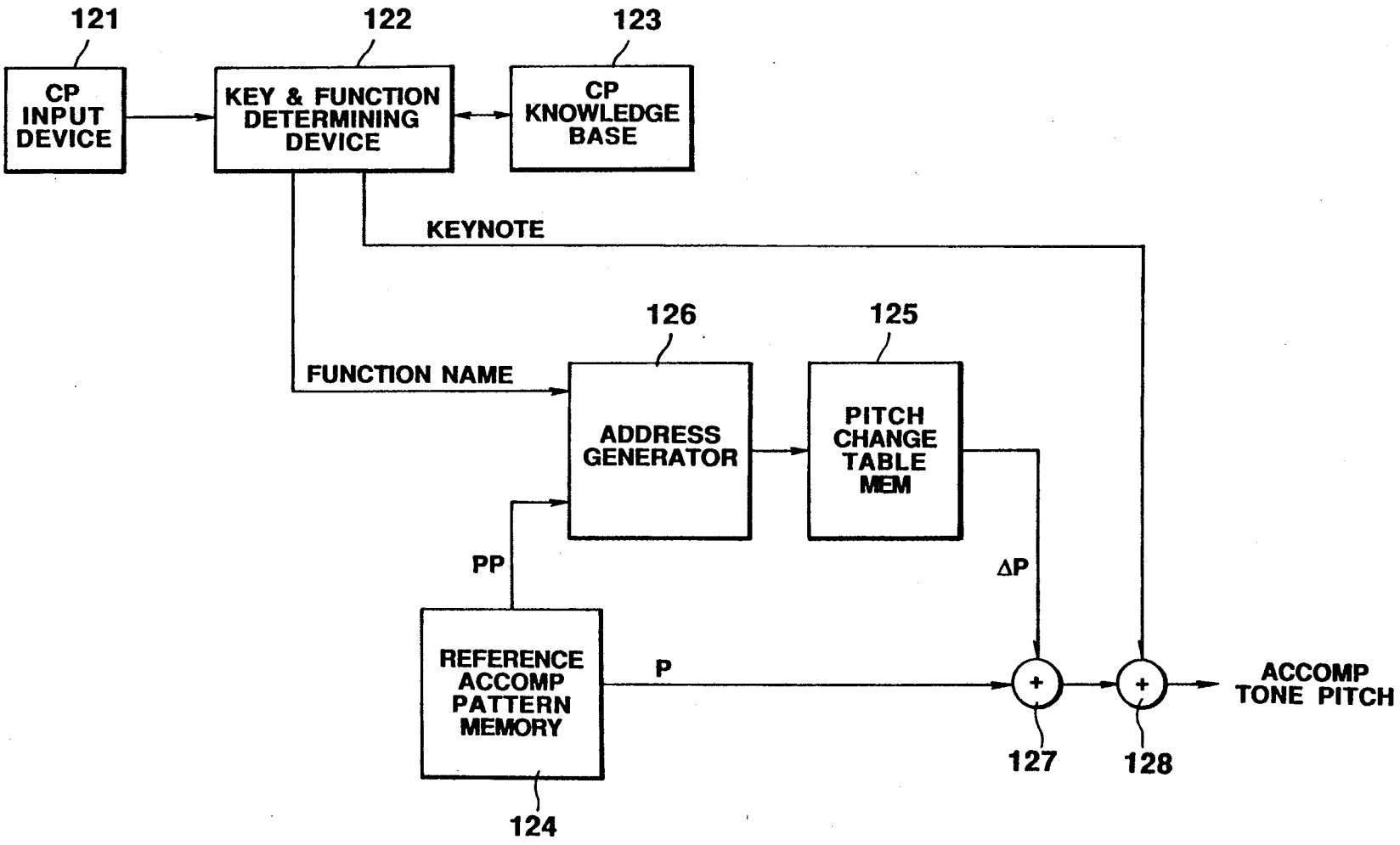
FIG. 54 is a functional block diagram of automatic accompaniment apparatus in accordance with the fifth aspect of the invention.

FIG. 54 is a functional block of an automatic accompaniment apparatus capable of providing a desired accompaniment pitch line varying with tonalities in a complex, subtle and pleasing manner while saving the storage capacity in accordance with the fifth aspect of the invention.

In FIG. 54, the chord progression input device 121 enters a chord progression in which each chord is represented by a root and a type. The key and function determining apparatus 122 analyzes the entered chord progression based on the musical knowledge stored in the chord progression (CP) knowledge base (e.g., knowledge of chord patterns keeping the keynote, knowledge of chord patterns suggesting a modulation) to thereby determine tonality i.e., chord function name (function and type) and keynote of each chord in the chord progression. In accordance with the invention, there is provided a reference accompaniment pattern memory 124 which stores a reference accompaniment pattern written in a reference tonality. Each pitch element P contained in the reference accompaniment pattern is associated with an index PP which serves as an argument to a pitch change table memory 125. In accordance with the invention, the pitch change table memory 125 stores pitch difference data ΔP for respective combinations of chord function name and index PP. To locate a specific pitch difference data item ΔP, an address generator 126 receives a chord function name from the key and function determining device 122, and an index PP from the reference accompaniment pattern memory 124 and computes therefrom an address specifying the pitch difference data item. Thus, each pitch difference data item ΔP is defined by a function of index PP and chord function name. It should be noted that this function or pitch difference data ΔP can have values independent of those of reference accompaniment pitches P in the stored accompaniment pattern. It is the index PP rather than the reference pitch P that has a functional relation with the pitch difference ΔP. It should be noted that different indexes PP can be associated with or assigned to those reference pitch elements P having the same pitch or pitch class. Such different indexes are denoted, here by PP1, PP2 etc. For a first chord function name, denoted, N1, the pitch difference function of index PP1, denoted f(N1, PP1) may have the same value as the pitch difference function f(N1, PP2) with respect to index PP2 (and chord function name N1). However, for a second function name N2, the pitch difference function f(N2, PP1) can have a different value from the pitch difference function f(N2, PP2). This data arrangement enables the desired pitch modification that modifies those notes in the reference accompaniment pattern having the same pitch or pitch class into actual accompaniment notes having different pitches or pitch classes from each other in accordance with tonalities. To this end, the adder 127 adds the pitch difference ΔP from the pitch change table 125 to the pitch element P from the reference accompaniment pattern memory 124, thus controlling the pitch contents of the accompaniment such that they vary depending on chord function names in a complex and pleasing manner to the subtleness of music. The adder 127 output is added by the second adder 128 to the keynote from the key and function determining device 122, thus forming an actual accompaniment pitch.

In this manner, the arrangement of FIG. 54 realizes natural and real accompaniments having pitch contents or line optimally adjusted to respective tonalities and music subtleness while requiring a minimum of storage. The arrangement of FIG. 54 is particularly desirable for an automatic accompaniment apparatus performing accompaniments of various musical styles.

A specific embodiment incorporating the features discussed in connection with FIG. 54 as well as those discussed for FIG. 47 will now be described and referred to as the fifth specific embodiment.

The fifth specific embodiment can be implemented on the microcomputer-based organization of FIG. 2 described earlier with respect to the first specific embodiment of the invention. For the implementation of the fifth specific embodiment programs residing in ROM 2 may include the main routine of FIG. 48 described earlier for the fourth specific embodiment, the time interrupt routine of FIG. 49 already described for the fourth specific embodiment, the process style input subroutine of FIG. 50 also described for the fourth specific embodiment, and the DETERMINE KEY & FUNCTION routine of FIG. 37 (described for the third specific embodiment) or FIG. 7 (described for the first specific embodiment). Further description of these figures is omitted here.

Those features unique to the fifth specific embodiment will now be described in detail.

FIG. 55 illustrates data of reference accompaniment pattern set of a musical style "rhythm and blues", designated AM(R & B). The illustrated patterns are used during a normal period of music and are called normal patterns. Actually, the complete pattern set of each musical style further includes introduction, fill-in, and ending pattern data (not shown) in addition to the normal pattern data. The accompaniment is constituted by four instrumental parts, i.e., first part, denoted c1, second part c2, third part b for bass instrument, and fourth part r for rhythm instrument. In FIG. 55, G5, D5, A#4, D5 etc., indicate reference accompaniment pitches which are directly used for a reference tonality of key C and chord function name I Major. Each reference accompaniment pitch element is associated with an index such as rt6, rt7, rt8 etc., in FIG. 55. Although the reference pitches are shown in FIG. 55, the actual reference pattern memory AM[R & B] of rhythm and blues does not contain the reference pitch data but merely store timing data and index data of each note in the accompaniment. For example, the first note of the first accompaniment part c1 is identified by index rt6, and played at the second beat of the first (odd) measure, lasting 8/12 beat time, and having pitch G5 in the tonality of C Major. This is illustrated at the first row of first accompaniment part c1 in FIG. 55 by data 1-2/4-00/12 G5 08 rt6 in which "1" indicates an odd or first measure (of two-measure accompaniment pattern), "2/4" reads second beat in four-tour time music, indicating a note-on timing measured in terms of beat number/one measure length, "00/12" indicates a note-on timing within one beat in terms of clock number/12 clocks per beat, "G5" indicates a reference pitch used in the reference tonality C Major, "08" indicates a gate time (note duration) in terms of clock number, and r6 indicates an index.

The pattern memory AM[R & B] of rhythm and blues style forms part of the style-grouped reference accompaniment pattern memory AM[11] which resides in ROM 102 and store reference accompaniment pattern data grouped by musical styles.

ROM 102 further contains a style-grouped pitch change table PGT which stores pitch change data grouped by musical styles. As part of the table PCT, there is provided a pitch change table RCT(R & B) of rhythm and blues style.

FIG. 56 illustrates the rhythm and blues pitch change table PCT(R & B). Rows of the rhythm and blues pitch change table PCT(R & B) are specified by indexes from reference accompaniment pattern memory AM(R & B) of the rhythm and blues style in a one-to-one correspondence manner. Columns of the pitch change table PCT(R & B) are specified by chord function names from the DETERMINE KEY & FUNCTION routine. For convenience, FIG. 56 show absolute pitches after pitch modification at respective intersections of rows and columns (e.g., C4 at the intersection of bb1 row and 1M column). Actual pitch change table PCTLR & B] stores pitch differences rather than absolute pitches at the intersections (accurately memory locations specified by indexes and function names) to minimize the required data length. The column BAS stores reference pitch data (e.g., C4, C5) to be added to the pitch difference data to form pitches modified or adapted to respective function names.

In FIG. 56, IM indicates a reference function name I Major. Pitch G4 is shown at the intersection of column 1M and row r25, whereas pitch G5 is shown at the intersection of column 1M and row rt6. This means that accompaniment notes of indexes r25 and rt6 are played with the same pitch class G in the, case of the reference function name I Major. Looking through column 37 indicative of chord function name III 7th, pitch B4 is found at row r25, and G5 at row rt6. This means that in the case of function name III 7th the accompaniment note of the index r25 is played with a pitch class B whereas the accompaniment note having the index rt6 is played with a different pitch class G.

In this manner, the data arrangement makes it possible to achieve dessired pitch modification or adjustment of accomparliment such that those accompaniment notes played as having the same pitch or pitch class for the reference function name or tonality are played with different pitches or pitch classes from each other as the tonality changes. This feature delicately controls the pitch line of accompaniment as a function of tonalities and realizes a subtle aspect of music while minimizing the storage capacity.

Figure 57:
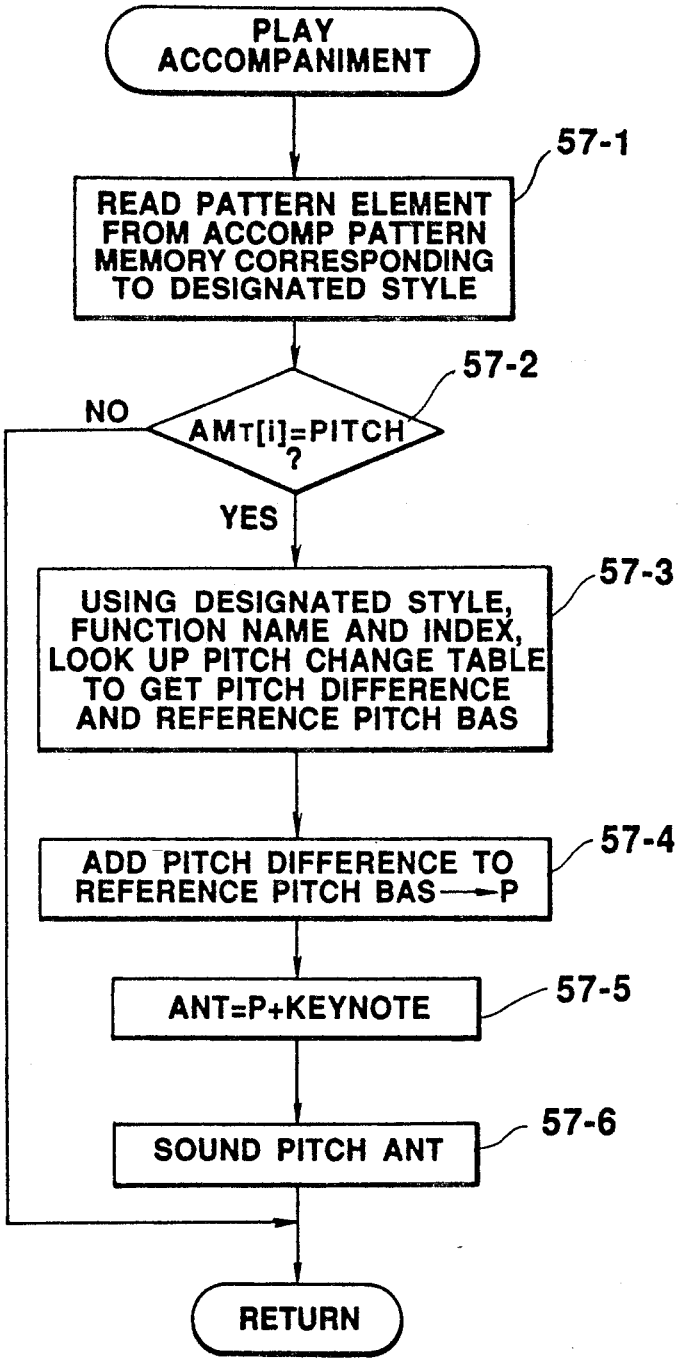
FIG. 57 is a flow chart of a play accompaniment routine which may utilize the accompaniment pattern memory in FIG. 55 and the pitch change table in FIG. 56 to provide increased variety of the accompaniment pitch contents as a function of tonality in accordance with the fifth embodiment of the invention.

FIG. 57 is a flow chart of the PLAY ACCOMPANIMENT routine of the fifth specific embodiment.

At first (57-1), CPU 100 reads the next pattern element from the accompaniment pattern memory AM[S] of the selected musical style S. if the pattern element is a pitch element containing an index (57-2), CPU 100 executes step 57-3 which uses the selected musical style, current function name and index $AM_i$[il to look up the pitch change table, thus getting the appropriate pitch difference data and the reference data BAS. These data are added into modified pitch data P (57-4). The modified pitch data P indicates a pitch (of the accompaniment note specified by the index) suitable for the current style and chord function name. The modified pitch data is further added to the current keynote, thus forming actual accompaniment pitch data ANT (57-5). Finally (57-6) CPU 100 sends a note-on command containing the pitch data ANT to the tone generator 108 to generate an accompaniment tone of pitch ANT.

This concludes the detailed description. However, various modifications are obvious to one of ordinary skill in the art. Therefore, the scope of the invention should be limited only by appended claims.

What is claimed is:

1. A tonality determining apparatus comprising:

chord progression providing means for providing a chord progression in which each chord is represented by a root and a type;

current keynote storage means for storing data indicative of a current keynote of a current tonality;

first tonality determining means for determining a tonality of a new chord from said chord progression based on said current keynote; and second tonality determining means for analyzing a chord pattern formed by said new chord and its preceding at least one chord to thereby determine a tonality of said new chord without relying on said current keynote.

2. The tonality determining apparatus of claim 1 wherein:

said first tonality determining means is operative when said current keynote has been identified; and said second tonality determining means is operative when said current keynote has not been identified.

3. The tonality determining apparatus of claim 1 wherein said second tonality determining means is operative when said first tonality determining means has failed to identify a tonality of said new chord.

4. The tonality determining apparatus of claim 1 wherein said first tonality determining apparatus comprises:

same keynote keeping table storage means for storing a set of chords keeping a keynote unchanged;

modulation chord sequence table storage means for storing a set of chord sequences indicative of a modulation from a keynote to a different keynote;

first function and keynote determining means for analyzing said chord progression by using said current keynote storage means, said same keynote keeping table storage means and said modulation chord sequence table storage means to thereby determine a function name and keynote of said new chord; and first tonality data producing means for producing tonality data defining a pitch class set available in a time interval of the new chord based on said function name and keynote from said first function and keynote determining means; and wherein said second tonality determining means comprises:

key establishing chord sequence table storage means for storing a set of chord sequences establishing a keynote;

second function and keynote determining means for analyzing said chord progression by using said key establishing chord sequence table storage means to thereby determine a function name and keynote of said new chord; and second tonality data producing means for producing tonality data defining a pitch class set available in said time interval of said new chord based on said function name and keynote from said second function and keynote determining means.

5. The tonality determining apparatus of claim 4 wherein said first function and keynote determining means comprises:

same key search means for searching said same keynote keeping table storage means to see whether said new chord has a function of keeping said current keynote; and modulation search means for searching said modulation chord sequence table storage means to see whether a chord pattern formed by the new and its preceding chords has a function of suggesting a modulation from said current keynote to a related keynote;

wherein second function and keynote determining means comprises key establishment search means for searching said key establishing chord sequence table storage means to see whether a chord pattern formed by the new and its preceding chords has a function of establishing a particular key; and wherein the tonality determining apparatus further comprises:

first keynote updating means for updating said current keynote storage means to said related keynote when said first tonality determining means determines said related keynote; and second keynote updating means for updating said current keynote storage means to said particular key when said second tonality determining means determines said particular key.

6. An automatic accompaniment apparatus comprising:

chord progression providing means for providing a chord progression in which each chord is represented by a root and a type;

current keynote storage means for storing data indicative of a current keynote of a current tonality;

first tonality determining means for determining a tonality of a new chord from said chord progression based on said current keynote;

second tonality determining means for analyzing a chord pattern formed by the new chord and its preceding at least one chord to thereby determine a tonality of said new chord without relying on said current keynote;

first accompaniment forming means responsive to when said first tonality determining means specifies a tonality of said new chord for forming an accompaniment in a time interval of said new chord according to said specified tonality of said new chord from said first tonality determining means; and second accompaniment forming means responsive to when said second tonality determining means specifies a tonality of said new chord for forming an accompaniment in a time interval of said new chord according to said specified tonality of said new chord from said second tonality determining means.

7. The automatic accompaniment apparatus of claim 6 wherein:

each of the first and second tonality determining means comprises means for supplying a function name and keynote of the new chord as determined tonality information to the first and second accompaniment forming means, respectively; and each of the first and second accompaniment forming means comprises accompaniment pattern generating means for generating an accompaniment pattern according to said supplied function name, and accompaniment pitch forming means for transposing each pitch in said accompaniment pattern from said accompaniment pattern generating means according to said supplied keynote to thereby form an actual pitch of an accompaniment tone.

8. An automatic accompaniment apparatus comprising:

chord progression input means for inputting a chord progression;

chord progression analyzing means for analyzing said input chord progression with respect to tonality and for detecting a modulation in said input chord progression; and accompaniment forming means for forming an accompaniment based on results from said chord progression analyzing means; and wherein said accompaniment forming means comprises modulation compensating means for controlling a pitch line of said accompaniment defined by a succession of pitches thereof so as to compensate a pitch difference formed between keys before and after said modulation.

9. The automatic accompaniment apparatus of claim 8 wherein said modulation compensating means comprises:

key group classified accompaniment pattern storage means for storing accompaniment patterns classified by key groups;

reading means responsive to a determined key from said chord progression analyzing means for selectively reading an accompaniment pattern of a key group to which said determined key pertains; and forming means for forming contents of the accompaniment based on said read accompaniment pattern.

10. The automatic accompaniment apparatus of claim 9 wherein said forming means comprises:

converting table storage means for storing a table of converting data to be used for converting a note type to a pitch; and converting data reading means for receiving an accompaniment pattern from said reading means and tonality information from said chord progression analyzing means and for using said received tonality information note type information contained in said received accompaniment pattern and to thereby read appropriate converting data from said converting table storage means.

11. The automatic accompaniment apparatus of claim 8 wherein said modulation compensating means comprises:

reference accompaniment pattern storage means for storing a reference accompaniment pattern;

first converting means for converting pitch information contained in said reference accompaniment pattern according to a keynote contained in tonality information supplied from said chord progression analyzing means to thereby form a first converted accompaniment pattern; and second converting means for converting pitch information contained in said first converted accompaniment pattern according to a chord type and function combination contained in said tonality information supplied from said chord progression analyzing means to thereby form a second converted accompaniment pattern defining an actually performed accompaniment.

12. The automatic accompaniment apparatus of claim 11 wherein said second converting means comprises:

converting table storage means which is addressed by a first argument specified by the pitch information in said first converted accompaniment pattern and a second argument specified by the chord type and function combination to thereby return pitch interval data indicative of an pitch interval from a keynote or chord root; and computing means for combining data of a pitch class of keynote or chord root supplied from said chord progression analyzing means with said returned pitch interval data to thereby form pitch data of said second converted accompaniment pattern.

13. An automatic accompaniment apparatus comprising:

chord progression providing means for providing a chord progression;

tonality determining means for determining a tonality of each chord in said chord progression; and accompaniment forming means for forming an accompaniment based on said determined tonality;

wherein said accompaniment forming means comprises:

style designating means for designating a musical style; and accompaniment pattern generating means for generating a plurality of accompaniment patterns each for a different combination of musical style and tonality such that generated accompaniment patterns may have different pitches from one another depending on musical styles even for the same tonality; and wherein said accompaniment pattern generating means comprises style-grouped reference accompaniment pattern storage means for storing accompaniment patterns grouped by musical styles and pitch modifying means for modifying each pitch in an accompaniment pattern from said style-grouped reference accompaniment storage means according to a combination of musical style and tonality to thereby form a pitch of an accompaniment to be actually performed.

14. An automatic accompaniment apparatus comprising:

chord progression providing means for providing a chord progression;

tonality determining means for analyzing said chord progression to thereby determine a tonality of each chord in said chord progression; and accompaniment forming means for forming an accompaniment based on said determined tonality;

wherein said accompaniment forming means comprises:

reference accompaniment pattern storage means for storing an accompaniment pattern for a reference tonality; and accompaniment pitch modifying means for modifying a pitch of each note in the accompaniment pattern read out from said reference accompaniment pattern storage means; and wherein said accompaniment pitch modifying means comprises means for modifying accompaniment notes such that those notes contained in the read accompaniment pattern and having an identical pitch class, wherein pitch class refers to a pitch without reference to octave, are modified to have different pitch classes from each other for a determined tonality different from said reference tonality.

* * * * *